United States Patent [19]

Ihama et al.

[11] Patent Number: 5,059,517

[45] Date of Patent: Oct. 22, 1991

[54] SILVER HALIDE PHOTOGRAPHIC EMULSION AND MULTILAYER PHOTOGRAPHIC LIGHT-SENSITIVE MATERIAL HAVING THE SAME

[75] Inventors: Mikio Ihama; Yuji Kume; Koji Tamoto; Hiroshi Ayato, all of Kanagawa, Japan

[73] Assignee: Fuji Photo Film Co., Ltd., Kanagawa, Japan

[21] Appl. No.: 542,683

[22] Filed: Jun. 25, 1990

Related U.S. Application Data

[63] Continuation of Ser. No. 186,991, Apr. 27, 1988, abandoned.

[30] Foreign Application Priority Data

Apr. 27, 1987 [JP] Japan ..... 62-103808
Jan. 18, 1988 [JP] Japan ..... 63-7855

[51] Int. Cl.[5] ..... G03C 1/005
[52] U.S. Cl. ..... 430/567; 430/569
[58] Field of Search ..... 430/567, 569

[56] References Cited

U.S. PATENT DOCUMENTS 4,414,306 11/1983 Wey et al. ..... 430/569
4,459,353 7/1984 Maskasky ..... 430/567
4,686,176 8/1987 Yagi et al. ..... 430/506

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

Disclosed is a silver halide photographic emulsion containing tabular silver bromide series grains having a mean aspect ratio of 2 or more, which is characterized by the grains having no projection on the grain surface and by the silver chloride content in the surface part of the grains being higher than that in the part of the grain which is underneath the grain surface. Also disclosed is a multi-layer photographic light-sensitive material having at least two silver halide emulsion layers on a support in which at least one of the silver halide emulsion layers contains the tabular silver bromide series grains as defined above. By the incorporation of the emulsion, the sensitivity, the storage stability and the manufacture stability properties of the photographic material are improved without deteriorating its graininess property.

27 Claims, 2 Drawing Sheets

SILVER HALIDE PHOTOGRAPHIC EMULSION AND MULTILAYER PHOTOGRAPHIC LIGHT-SENSITIVE MATERIAL HAVING THE SAME

This is a continuation of application Ser. No. 07/186,991 filed Apr. 27, 1988, now abandoned.

FIELD OF THE INVENTION

The present invention relates to a silver halide photographic emulsion. In particular, it relates to a silver halide photographic emulsion comprising a dispersion medium and tabular silver halide grains having a mean aspect ratio of 2 or more. Further, the present invention also relates to a multilayer photographic light-sensitive material having at least two light-sensitive silver halide emulsion layers on a support, which has a high sensitivity and improved graininess and sharpness and which is suitable for taking pictures with an excellent storage stability.

BACKGROUND OF THE INVENTION

Currently, silver halide photographic materials are being developed to have a higher sensitivity and to have a more small-sized format, and photographic light-sensitive materials having far higher sensitivity and image-forming quality are strongly required.

Accordingly, the requirements for silver halide emulsions for photographical use have become even more sever, and the photographic characteristics of photographic materials are required to have an even higher level of an already high sensitivity, a high contrast, excellent graininess and sharpness, etc.

Methods of manufacturing tabular grains and techniques for the use of the grains are disclosed in U.S. Pat. Nos. 4,386,156, 4,504,570, 4,478,929, 4,414,304, 4,411,986, 4,400,463, 4,414,306, 4,439,520, 4,433,048, 4,434,226, 4,413,053, 4,459,353, 4,490,458 and 4,399,215, which are intended to attain the elevation of the sensitivity, including the elevation of the color sensitization efficiency by the use of sensitizing dyes, as well as the improvement of the relation of sensitivity/graininess, the improvement of the sharpness and the elevation of the covering power, for the purpose of satisfying the above-mentioned requirements.

Further, Japanese Patent Application (OPI) Nos. 113930/83, 113934/83 and 119350/84 (the term "OPI" as used herein means a "published unexamined Japanese patent application") illustrate multilayer color photographic materials which have an emulsion of tabular silver halide grains with an aspect ratio of 8/1 (also expressed, e.g., 8:1, or simply 8) or more in the high sensitive layer and which have an elevated high sensitivity and improved graininess, sharpness and color reproducability.

These patent publications mention that the incorporation of tabular grains into a blue-sensitive layer is effective for improving the sharpness of photographic materials, since the tabular grains are hardly scatterable, and the incorporation of the grains into a green-sensitive or red-sensitive layer is also effective for improving the graininess of the materials.

Japanese Patent Application (OPI) No. 77847/86 illustrates multilayer color photographic materials which have an emulsion of tabular silver halide grains with an aspect ratio of 5/1 or more in a high sensitive layer and a monodispersed silver halide emulsion in a low sensitive layer and which have improved sharpness and color reproducability.

*Research Disclosure* No. 25330 illustrates a technical means of adjusting the thickness of the tabular grains in a photographic material so that the reflection of the light for the layer above the tabular grain-containing layer is enhanced to elevate the sensitivity of the upper layer or the reflection of the light for the said layer is minimized so it does not detract from the sharpness of the upper layer.

U.S. Pat. Nos. 4,435,501 and 4,459,353 illustrate a technical means of improving the sensitivity of tabular grains having a specific shape, in which silver chloride guest grains are epitaxially deposited on an already limited surface part of the host tabular grains as projections.

The epitaxial deposition of silver halide guest grains on host grains is disclosed by Berry and Skillman in their "Surface Structure and Epitaxial Growth in Silver Bromide Crystals" in *Journal of Applied Physics*, Vol. 35, No. 7, pages 2165–2169 (July, 1964).

U.S. Pat. No. 3,804,629 illustrates a means of depositing silver chloride on silver halide grains after the physical ripening and desalting of the silver halide emulsion, but prior to the chemical ripening thereof so as to improve the stability of the silver halide emulsion to metal dusts. This patent mentions that the silver chloride forms small projections on the silver halide host grains by the deposition.

British Patent 2,038,792A illustrates a method of selectively depositing silver chloride on corner parts of tetradecahedral silver bromide grains.

U.S. Pat. Nos. 3,505,068, 4,094,684 and 4,142,900 illustrate a technical means of epitaxially depositing silver chloride on silver iodide host grains.

However, the grains in which silver chloride has been epitaxially deposited on the host grains as mentioned above (that is, the grains having projections on the surface thereof) are thermodynamically extremely unstable so that these would be deformed when kept at a high temperature for a long period of time and, as an inevitable consequence, result in the decrease of sensitivity and the increase of fog, and accordingly, these grains are unfavorable in view of the manufacture step of silver halide emulsions.

In multilayer photographic light-sensitive materials having two or more emulsion layers, one emulsion is influenced by the other layer(s). For example, upon coating emulsion layers, one layer is influenced by the diffusion of halide ions, etc. from the other layer(s) so that the grains having projections on the surface thereof would easily be deformed, and therefore, it is difficult for the multilayer materials to obtain the same characteristics as those of single layer photographic light-sensitive materials. In addition, the multilayer materials are noticeably influenced by the storing conditions, for example, storing temperature, storing humidity, storing time, etc., because of the transference of the dye(s), anti-foggant(s), etc. from one emulsion layer to other(s). Accordingly, because of the same reason as mentioned above, the use of grains with projections in multilayer photographic materials is problematic with respect to the storage stability of the photographic materials.

On these grounds, although the technique of a) improving the graininess, sharpness and color reproducibility of multilayer photographic light-sensitive materials by the incorporation of tabular grains thereinto, as mentioned above, and the technique of b) elevating the sensitivity of silver halide emulsions by the epitaxial deposition of silver chloride on tabular grains, also as mentioned above, are excellent only independently, the combination of techniques a) and b) is, in practice, problematic for multilayer photographic light-sensitive materials.

Further, the epitaxial deposition of silver chloride on silver halide grains is often accompanied by deterioration of graininess together with the elevation of the sensitivity of the resulting grains. This means that the technique of such epitaxial deposition is not always sufficient for sensitization of the silver halide grains in view of the evaluation of the relation of sensitivity/-graininess of the resulting grains.

British Patent 1,027,146 illustrates a technical means of coating a silver chloride shell over a monodispersed cubic silver bromide core grain to give silver halide grains having both the spectral responsiveness of the silver bromide and the developability of the silver chloride.

U.S. Pat. No. 4,414,306 illustrates silver halide grains containing silver chloride in the circular range of tabular grains.

However, the grains, which have been coated with a silver chloride shell to such degree that these may have the developability of the silver chloride, are accompanied by deterioration of the graininess, and additionally the coated grains often cause deterioration of the adsorbability of dyes.

SUMMARY OF THE INVENTION

One object of the present invention is to provide an emulsion containing tabular silver halide grains having a high sensitivity along with improved storage stability and manufacture stability.

Another object of the present invention is to provide an emulsion containing tabular silver halide grains which have a high sensitivity but are not accompanied by deterioration of graininess.

Still another object of the present invention is to provide a silver halide emulsion which is complete in the points of the elevation of the sensitivity, including the elevation of the color sensitization efficiency by the use of sensitizing dyes, as well as the improvement of the relation of sensitivity/graininess, the improvement of the sharpness and the elevation of the covering power.

Still another object of the present invention is to provide a method of sensitization of tabular grains which are suitable for multilayer photographic light-sensitive materials.

Still another object of the present invention is to provide an emulsion containing tabular silver halide grains which have improved storage stability in multilayer photographic light-sensitive materials.

Still another object of the present invention is to provide a multilayer photographic light-sensitive material which is excellent in the relation of sensitivity/-graininess, the sharpness and the storage stability.

In order to attain these objects, the present invention provides a silver halide photographic emulsion containing tabular silver bromide series grains having a mean aspect ratio of 2 or more, which is characterized by the said grains having no projection on the grain surface and by the silver chloride content in the surface of the grains being higher than that in the part of the grain which is underneath the grain surface. Additionally, the present invention further provides a multilayer photographic light-sensitive material having at least two silver halide emulsion layers on a support in which at least one of the said silver halide emulsion layers contains tabular silver bromide series grains having a mean aspect ratio of 2 or more and which is characterized by the said grains having no projection on the grain surface and by the silver chloride content in the surface of the grains being higher than that in the part of the grain which is underneath the grain surface.

DETAILED DESCRIPTION OF THE INVENTION

Figure 1:
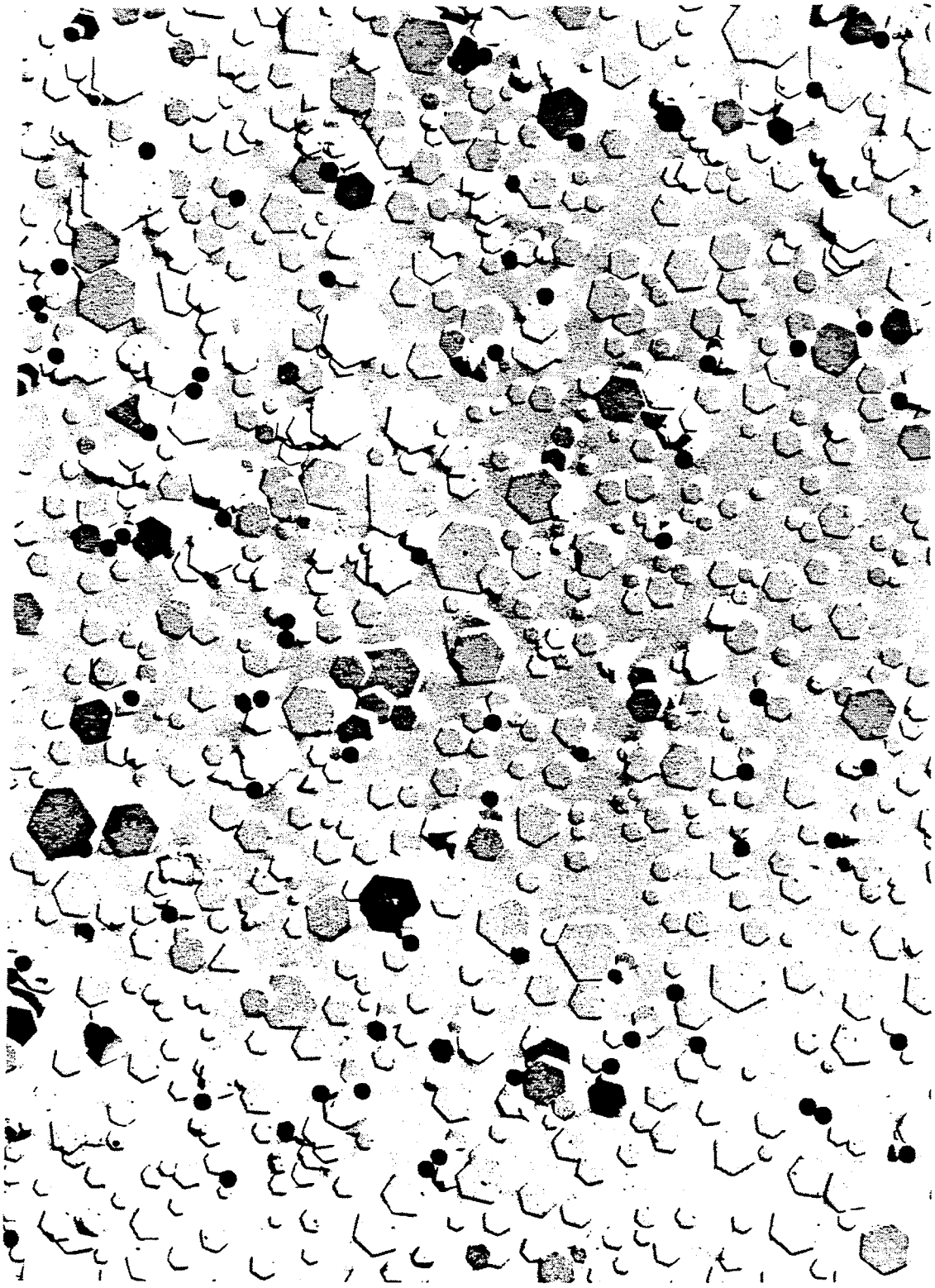
FIG. 1 is an electron-microphotograph of 6000 magnifications to show the crystal structure of silver halide grains of the silver halide emulsion Em-G of the present invention, prepared in Example 3.

The silver chloride layer on the surface of the silver halide grains in the emulsion of the present invention is deposited on the base silver halide grains at a high temperature after the substantial completion of the formation of the base grains. The deposition of the silver chloride layer may be carried out either before or after desalting of the base grains, provided that the precipitation of the base silver-halide grains has substantially been finished. The silver chloride may also be deposited on the base grains before, during, or after chemical ripening. For the deposition of the silver chloride layer, a silver salt solution and a substantial chloride solution can be added to the base silver halide grains so that the silver chloride is deposited on the base grains, or alternatively, an emulsion substantially comprising silver chloride can be added to the base grains so that the said base grains are ripened and the silver chloride is deposited thereon. It is preferred that the temperature for the deposition of the silver chloride layer on the base silver halide grains is high, or after the deposition the resulting grains are preferably put in a high temperature condition (desirably for 5 minutes to 60 minutes). The temperature is therefore preferably 30° C. or higher, more preferably 35° C. or higher, most preferably 40° C. or higher. The upper limit of the temperature is preferably 80° C. By the high temperature deposition of the silver halide layer, the silver chloride layer is not deposited in the form of a thermodynamically unstable epitaxial deposition but can be deposited on the base grains in the form of a stable silver halide layer with no projection on the surface of the resulting grains. If the deposition of the silver chloride layer is to be carried out at a low temperature, the epitaxial deposition can be evaded by addition of a pertinent halide solvent. As the silver halide solvent for the purpose, for example, ammonia, potassium thiocyanate as well as the thioethers and thione compounds described in U.S Pat. No. 3,271,157, Japanese Patent Application (OPI) Nos. 12360/76, 82408/78, 144319/78, 100717/79 and 155825/79, etc. are useful. Of these, potassium thiocyanate, thioethers and thione compounds are particularly preferred. The amount of the silver halide solvent used varies depending on the kind of base gains, the amount of silver chloride to be deposited and the condition for the deposition but it generally ranges from $10^{-2}$ to 10 mol %, most preferably from $10^{-1}$ to 1 mol % per mol of silver in the base gain. They may be added either before, during, or after deposition of the silver chloride layer, and preferably before or during the deposition.

Even if the silver chloride layer is deposited in the form of an epitaxial deposition, the resulting grains may thereafter be kept in a high temperature condition preferably at 40° C. or higher, more preferably at 50° C. or higher, for 5 to 60 minutes, and preferably in the presence of the aforesaid silver halide solvent, so that the object of the present invention can effectively be attained.

In the description herein, "with no projection" means that any projection, for example, by a so-called epitaxial deposition, etc. does not substantially exist on the surface of the tabular silver halide grains in the emulsion of the present invention. In other words, the parallel surfaces of the tabular grains are substantially plane, having no projection thereon. More precisely, when an electron-microscopic sample of the grains is observed under the condition of 3000 magnifications by carbon-replica method as described, for example, in J. F. Hamilton and L. E. Brady, *J. Appl. Phys.*, 29, 994 (1958), no projection is confirmed in the limited part on the parallel surfaces of the tabular grains.

The silver halide grains of the present invention may have, as a natural consequence, a higher silver chloride content in the surface part thereof, as mentioned above. The method for preparation of such grains is not specifically limited but, as one typical embodiment for the preparation, a silver halide can be deposited on the surface of the base silver halide grains, after the formation of the base grains, so that the surface of the resulting grains may have a higher silver chloride content. By the typical method, the silver halide grains of the present invention can easily be prepared. The "higher silver chloride content in the surface part" means that the silver chloride content in the surface part is higher than that in the inside part by 1 mol % or more, preferably 3 mol % or more.

Silver halide grains to be the base grains for preparation of the photographic emulsion of the present invention will be explained in detail hereunder.

The silver halide grains to be the base grains in the practice of the present invention are silver bromide series grains. The silver bromide series grains are meant to contain a bromide ion in an amount of 50 mol % or more.

The silver halide grains to be the base grains for use in the practice of the present invention may be any one of silver bromide, silver iodobromide, silver iodochlorobromide, and silver chlorobromide grains. Preferably, the grains contain an iodide ion in an amount of 1 mol % or more, and more preferably 3 mol % or more.

The shape of the base silver halide grains is tabular, or the base grains are tabular grains. The phrase "tabular grains" as used herein is intended to denote a general term for grains having one twin plane or two or more parallel twin planes. The "twin plane" in this case means (111) plane, provided that all the ions in the lattice points in both sides of the said (111) plane each are in a mirror-image relation.

The tabular grains have a triangular, hexagonal or roundish circular shape as a plane view. The triangular grains have parallel triangular outer surfaces. The hexagonal grains have parallel hexagonal outer surfaces, and the circular grains have parallel circular outer surfaces.

The tabular grains to be the base grains, and also the tabular grains having a high silver chloride content in the surface part, are preferred to have a mean aspect ratio of 2 or more. More preferably, the aspect ratio is 3 or more, especially preferably 4 or more, for the tabular grains for use in the present invention. The upper limit of the aspect ratio is preferably 30 or less, more preferably 20 or less.

The elevation of the sensitivity of the grains can sufficiently be attained without being accompanied by the deterioration of the graininess by the deposition of the silver chloride layer on the surface of the base grains, provided that the grains have a mean aspect ratio of 2 or more. The "mean aspect ratio" of the tabular grains for use in the present invention is intended to mean a mean value of the grain diameter divided by the grain thickness for tabular grains having a grain diameter of 0.1 μm or more. Measurement of the thickness of the grains can easily be carried out by 1) applying a metal to the grains for vacuum evaporation plating at an angle together with a latex for reference, then 2) measuring the length of the resulting shadow by electron-microscopic photography and 3) calculating the thickness of the grains by reference to the length of the shadow of the latex.

The "grain diameter" as herein mentioned refers to a diameter of a circle having the same area as the project area of the parallel outer surfaces of the grains.

The project area of the grains can be obtained by measuring the area on the electron-microscopic photograph and correcting the photographing magnification.

The diameter of the tabular grains to be the base grains is preferably from 0.15 μm to 5.0 μm. The thickness of the tabular grains is preferably from 0.05 μm to 1.0 μm.

The proportion of the above-mentioned surface silver chloride-rich tabular grains is preferably 30% or more, more preferably 50% or more, most preferably 80% or more, of the total project area.

The tabular grains to be the base grains for use in the present invention may be either multilayer grains having two or more substantially different halogen compositions in the silver halide grains or single layer grains having an even halogen composition.

In the emulsion containing multilayer silver halide grains having different halogen compositions in the grains, the grains may be either those comprising an iodine-rich core part and an iodine-poor outermost layer part or those comprising an iodine-poor core part and an iodine-rich outermost layer part. Further, the structure of the multilayer grains may be a three or more layered structure.

The base tabular grain-containing emulsion for use in the present invention can be prepared by a flocculation-forming method as mentioned below. A dispersion medium is put in a conventional silver halide precipitate-forming reactor as equipped with a stirring means. In general, the amount of the dispersion medium to be put in the reactor in the initial stage is at least about 10%, preferably from 20 to 80%, of the amount of the dispersion medium existing in the final emulsion. The dispersion medium to be put in the reactor in the initial stage is water or a water dispersion of a deflocculant, and the dispersion medium may contain, if necessary, other component(s), for example, one or more silver halide ripening agents and/or metal doping agents which will be mentioned hereinafter in detail. If a deflocculant is to be present at the start, the deflocculant concentration is preferably at least 10%, preferably at least 20% of the total amount of the deflocculant to be present in the final stage of the formation of the silver halide precipitate. An additional dispersion medium is added to the reactor together with silver and halide salt(s), and this can also be introduced into the reactor from a different jet. In general, in order to especially increase the proportion of the deflocculant, the proportion of the dispersion medium is adjusted after the completion of the introduction of halide salt(s).

In general, less than 10% by weight of the bromide salt to be used for the formation of the silver halide grains is to be present in the reactor at the start so that the bromide ion concentration in the dispersion medium at the beginning of the formation of the silver halide precipitate is adjusted. The dispersion medium in the reactor does not substantially contain an iodide ion in the initial stage. This is because if the iodide ion is present in the reactor prior to the simultaneous addition of silver and a bromide ion, non-tabular grains are often formed. The statement "dispersion medium in the reactor does not substantially contain an iodide ion" as used herein means that the dispersion medium contains an iodide ion only in an amount insufficient for forming a precipitate of a different silver iodide phase, as compared with the bromide ion. The iodine concentration in the reactor before the introduction of a silver salt is preferably less than 0.5 mol % of the total halide ion concentration in the reactor. If the pBr value of the dispersion medium is too high in the initial stage, the thickness of the resulting tabular silver iodobromide grains to be formed would become large so that the distribution of the thickness of the resulting grains would become broad, and further, non-tabular, grains would increase. On the other hand, if the pBr value is too low, non-tabular grains would also be formed noticeably. The pBr value as herein referred to is defined to be a negative value of the logarithm of the bromide ion concentration.

During the formation of the precipitate, silver and bromide and iodide salts are added to the reactor in accordance with the conventional technique well known for formation of the precipitate of silver halide grains. In general, an aqueous solution of a soluble silver salt, such as silver nitrate, is introduced into the reactor simultaneously with the introduction of bromide and iodide salts. The bromide and iodide salts are introduced each in the form of an aqueous salt solution, such as an aqueous solution of a soluble ammonium, alkali metal (e.g., sodium or potassium) or alkaline earth metal (e.g., magnesium or calcium) halide. The silver salt is to be introduced into the reactor separately from the bromide salt and iodide salt (at least at the start). The bromide salt and the iodide salt can be introduced into the reactor individually or in the form of a mixture of the two.

When the silver salt is introduced into the reactor, the nuclei-forming stage is initiated. The continuation of the introduction of the silver, bromide and iodide salts results in the formation of a base group of grain nuclei which may be useful as the position for the formation of precipitates of silver bromide and silver iodide. By the precipitation of the silver bromide and silver iodide on the already existing grain nuclei, the grains are to enter the growing stage. For the condition of the formation of the nuclei, the method described in Japanese Patent Application (OPI) No. 11928/88 can be referred to. However, the method is not limited but, for example, the nuclei-forming temperature can be within the range of from 5° to 55° C.

The size distribution of the tabular grains as formed in accordance with the present invention is greatly influenced by the concentration of the bromide concentration and the iodide concentration in the growing stage. If the pBr value is too low, although tabular grains having a high aspect ratio can be formed, the fluctuation coefficient of the project area is extremely large. Accordingly, by maintaining the pBr value to fall within the range of from 2.2 to 5, tabular grains with a small project area fluctuation coefficient can be formed.

The concentration and the introduction rate of the silver, bromide and iodide salts can be same as conventional ones, provided that the above-mentioned pBr condition is satisfied. It is desired that the silver and halide salts are introduced each in a concentration of from 0.1 to 5 mols/liter, but a broader concentration range than a conventional one, for example, from 0.01 mol/liter to the saturated degree can be employed in the practice of the present invention. An especially preferred precipitate-forming technique is to elevate the introduction rate of silver and halide salts so as to shorten the precipitate forming time. The introduction rate of silver and halide salts can be elevated by elevating the introduction rate of a dispersion medium and silver and halide salts or by elevating the concentration of the silver and halide salts in the dispersion medium to be introduced. By keeping the addition rate of silver and halide salts to be near the limit value of forming new grain nuclei, as described in Japanese Patent Application (OPI) No. 142329/80, the fluctuation coefficient of the project area of the grains formed can further be reduced.

The amount of gelatin in the reactor during the formation of nuclei has a great influence on the distribution of the grain size of the grains formed. The gelatin concentration is preferably from 0.5 to 10% by weight, more preferably from 0.5 to 6% by weight.

Further, the stirring rotation number and the size of the reactor also have an influence on the grain size distribution.

As the stirring and blending apparatus, the apparatus described in U.S. Pat. No. 3,785,777 is preferred where a reaction solution is added to a liquid and blended. The stirring rotation number must not be too large or too small. If the stirring rotation number is too small, the proportion of non-parallel twin grains would increase, but on the other hand, if the rotation number is too large, the frequency of the formation of tabular grains would decrease and the grain size distribution of the grains formed would become broad.

Regarding the shape of the reactor to be used, it is most preferred that the bottom of the reactor is semicircular.

The amount of the silver chloride layer to be deposited on the base tabular silver halide grains is preferably from 0.3 to 20 mol % on the basis of the silver of the base grains. More preferably, the said amount is from 0.5 to 15 mol %, and most preferably from 0.5 to 10 mol %.

The deposition of the silver chloride layer is preferably effected on the main planes of the tabular grains. The thickness of the silver chloride layer is preferably 200 Å or less, most preferably 100 Å or less, as calculated on the basis of the provision that the layer has uniformly been deposited on the grains.

The phrase "silver chloride layer" as herein used does not mean a pure silver chloride layer. The silver chloride layer is recrystallized when being deposited on the base tabular silver halide grains, and therefore, the substantial halogen composition of the resulting silver chloride layer depends upon the composition of the base tabular silver halide grains. Accordingly, the silver halide grains in the emulsion of the present invention are intended to be tabular grains which are characterized by the higher silver chloride content in the surface part of the grains than in the part of the grain which is undernearth the grain surface.

The word "surface" as herein used denotes the range capable of being measured by the XPS method mentioned below. In general, this range is up to 50 Å or so.

The silver chloride content in the grain surface can be measured by an X-ray photoelectro-spectrography (XPS). For the principle of the XPS method, for example, J. Aizawa et al. *Spectrography of Electrons* (Kyoritsu Library 16, by Kyoritsu Publishing Co., 1978) can be referred to.

For standard measurement by XPS, there may be mentioned a method in which Mg-Ka is used as an excited X-ray and the strength of the respective photoelectrons of chlorine (Cl) and silver (Ag) as emitted from silver halide grains which are in a pertinent specimen form is measured.

For obtaining the content of chlorine, several kinds of standard samples in which the chlorine content is known are used an a calibration curve of the strength ratio of chlorine (Cl) photoelectrons to silver (Ag) photoelectrons (strength (Cl)/strength (Ag)) is formed, and the intended chlorine content can be obtained from the calibration curve. For actual XPS measurement of silver halide emulsions, the gelatin as adsorbed on the surface of the silver halide grains is required to be decomposed with a protease or the like and removed prior to the initiation of the measurement.

In the grains for use in the present invention, the silver chloride content in the grain surface as measured by the XPS method is 3 mol % or more, preferably 5 mol % or more, more preferably 7 mol % or more, per mol of silver in the grain surface. The mean silver chloride content of the grains can be obtained, for example, by a fluorescent X-ray method.

Since the silver halide grains for use in the present invention are characterized by the silver chloride content in the surface part of the grains being higher than the content underneath the grain's surface. The silver chloride content in the surface part of the grains as measured by XPS method is generally higher than the mean silver chloride content of the silver halide grains. The mean silver chloride content of the grains can be obtained, for example, by a fluorescent X-ray method, and the mean silver chloride content of the grains measured by the method is 20 mol % or less, more preferably 15 mol % or less, especially preferably 10 mol % or less.

The silver halide emulsion of the present invention can contain a cadmium salt, a zinc salt, a thallium salt, an iridium salt or a complex salt thereof, a rhodium salt or a complex salt thereof or an iron salt, a complex salt thereof, etc., in the step of formation or physical ripening of the base tabular silver halide grains on which a silver chloride layer is to be deposited or in the step of the deposition of the silver chloride layer on the base grains.

The silver halide emulsion of the present invention is generally and preferably spectrally sensitized.

The spectral sensitizing dyes for use in the present invention are generally methine dyes, which include cyanine dyes, merocyanine dyes, complex cyanine dyes, complex merocyanine dyes, holopolar cyanine dyes, hemicyanine dyes, styryl dyes and hemioxonole dyes. To serve as these dyes, various nuclei which are usually utilized for cyanine dyes as basic heterocyclic nuclei can be applied. That is, such nuclei include pyrroline nuclei, oxazoline nuclei, thiazoline nuclei, pyrrole nuclei, oxozole nuclei, thiazole nuclei, selenazole nuclei, imidazole nuclei, tetrazole nuclei, pyridine nuclei, etc.; the nuclei obtained by fusing aliphatic hydrocarbon rings to these nuclei; and the nuclei obtained by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. Each of these nuclei may be substituted on the carbon atom of the dye.

For the merocyanine dyes or complex merocyanine dyes, 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., can be applied as nuclei having a ketomethylene structure.

Among the above-mentioned sensitizing dyes, those which are especially advantageous for the present invention are cyanine dyes. Specific examples of cyanine dyes which are preferred for the present invention are dyes of formula

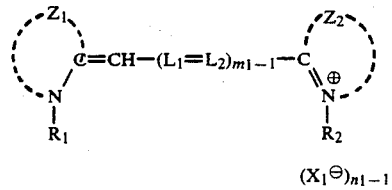

(I)

In the formula (I), $Z_1$ and $Z_2$ each represents an atomic group necessary for completing a heterocyclic nucleus which is usually used in cyanine dyes, for example, a thiazole nucleus, a thiazoline nucleus, a benzothiazole nucleus, a naphthothiazole nucleus, an oxazole nucleus, an oxazoline nucleus, a benzoxazole nucleus, a naphthoxazole nucleus, a tetrazole nucleus, a pyridine nucleus, a quinoline nucleus, an imidazoline nucleus, an imidazole nucleus, a benzimidazole nucleus, a naphthoimidazole nucleus, a selenazoline nucleus, a selenazole nucleus, a benzoselenazole nucleus, a naphthoselenazole nucleus or an indolenine nucleus. These nuclei can optionally be substituted by a lower alkyl group such as a methyl group, a halogen atom, a phenyl group, a hydroxyl group, an alkoxy group having from 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, a nitro group, etc.

$L_1$ and $L_2$ each represents a methine group or a substituted methine group. The substituted methine group include a methine group substituted by a lower alkyl group such as a methyl group or an ethyl group, a phenyl group, a substituted phenyl group, a methoxy group, an ethoxy group, etc.

$R_1$ and $R_2$ each represents an alkyl group having from 1 to 5 carbon atoms; a substituted alkyl group having a carboxyl group; a substituted alkyl group having a sulfo group such as β-sulfoethyl group, a γ-sulfopropyl group, a δ-sulfobutyl group, a 2-(3-sulfopropoxy)ethyl group, a 2-(2-(3-sulfopropoxy)ethoxy)ethyl group, a 2-hydroxy-sulfopropyl group, etc.; an allyl group or a substituted alkyl group which is usually used as the N-substituted for cyanine dyes. $m_1$ represents 1, 2 or 3.

$X_1\ominus$ represents an acid anion group which is generally used for cyanine dyes, such as an iodine ion, a bromide ion, a p-toluenesulfonic acid ion, a perchloric acid ion, etc. $n_1$ represents 1 or 2, and when the formula has a betaine structure, $n_1$ is 1.

Typical compounds of the spectral sensitizing dyes which are especially advantageously used in the present invention are mentioned below. However, these examples are not intended to limit the scope of the present invention.

I-1

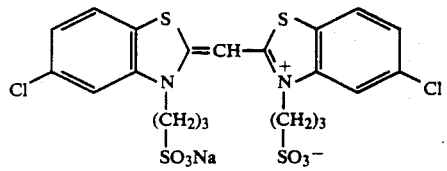

I-2

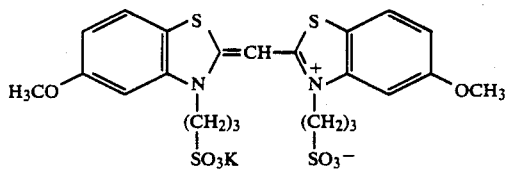

I-3

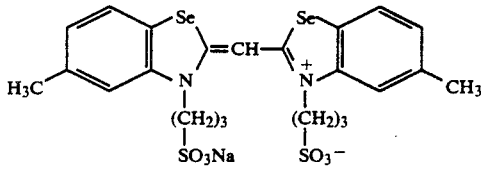

I-4

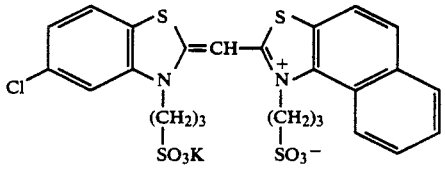

I-5

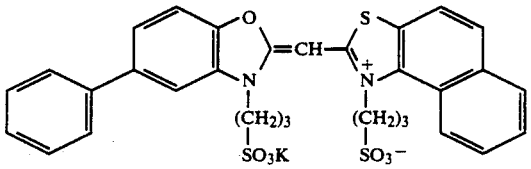

I-6

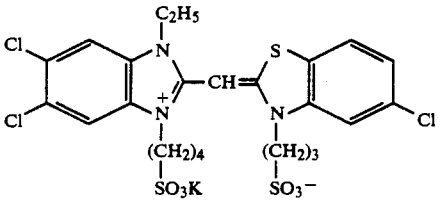

I-7

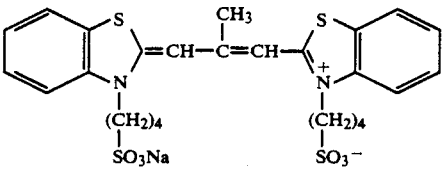

-continued
I-8
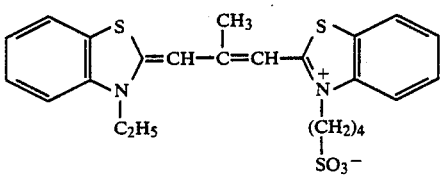
I-9
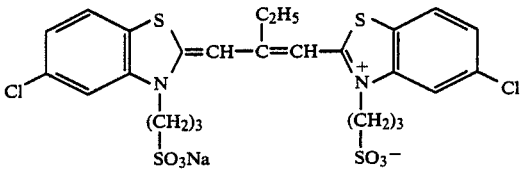
I-10
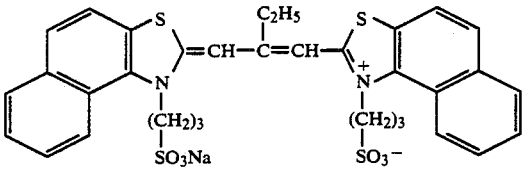
I-11
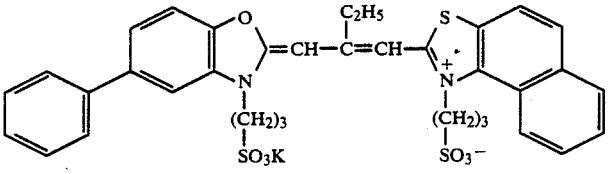
I-12
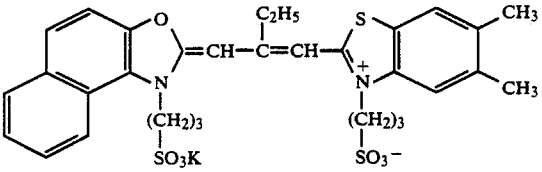
I-13
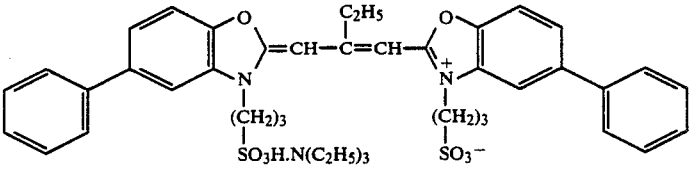
I-14
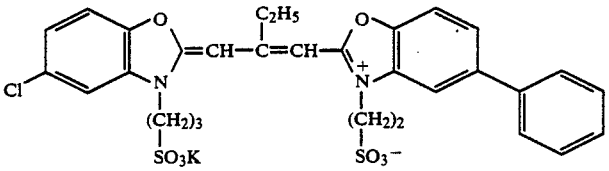
I-15
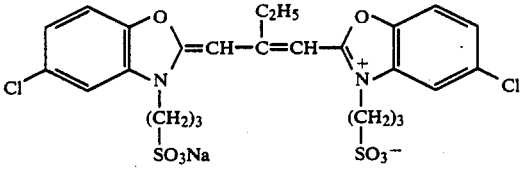

-continued
I-16
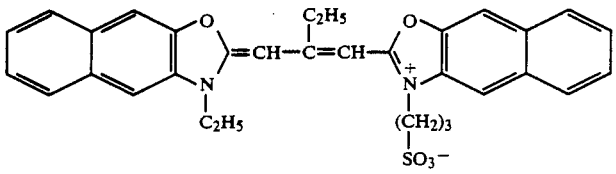
I-17
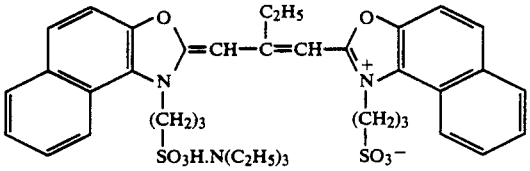
I-18
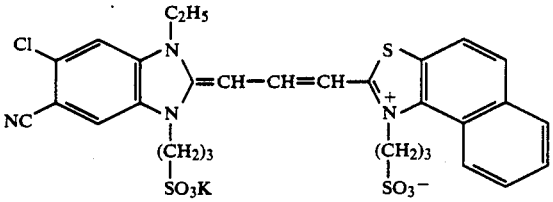
I-19
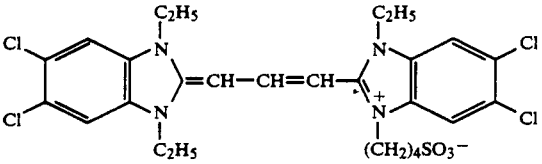
I-20
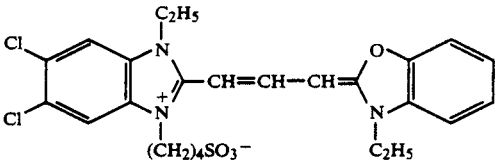
I-21
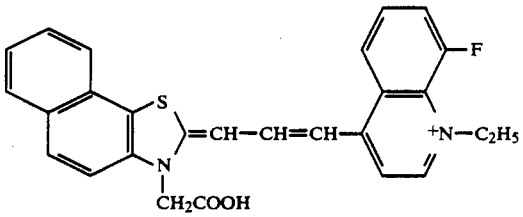
I-22
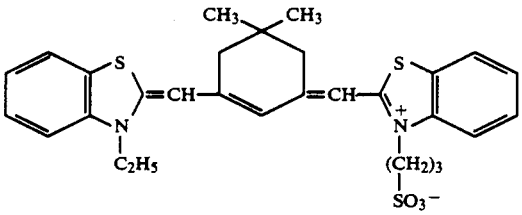
I-23
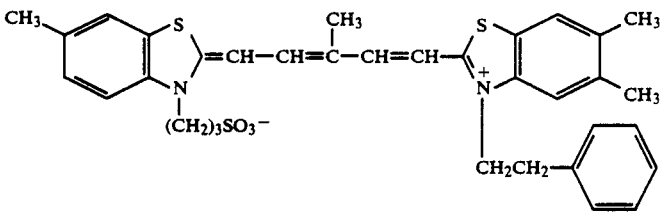

-continued
I-24
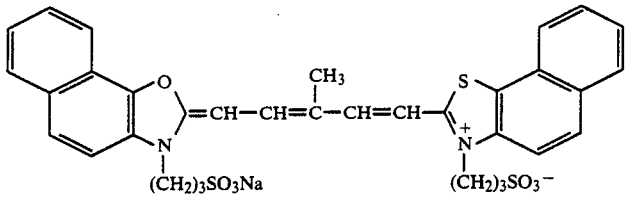
I-25
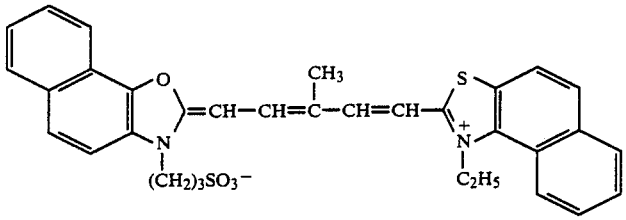
I-26
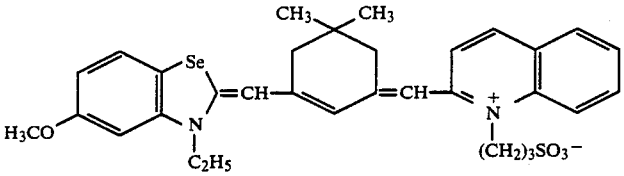
I-27
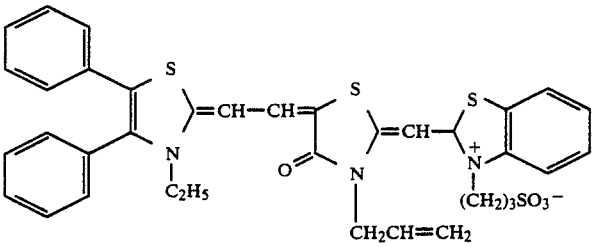
I-28
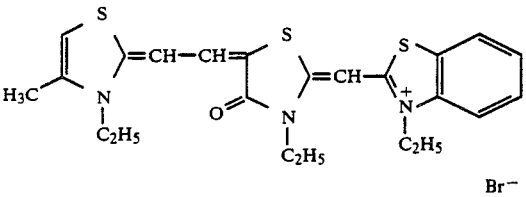
I-29
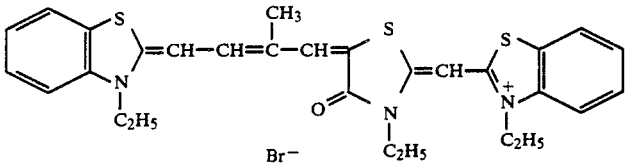
I-30
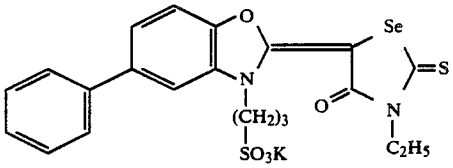
I-31
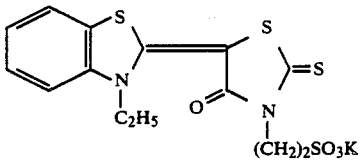

-continued
I-32
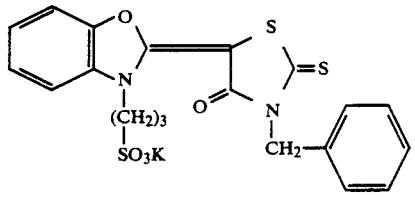
I-33
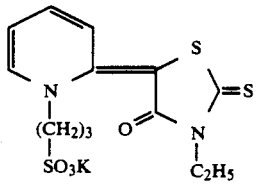
I-34
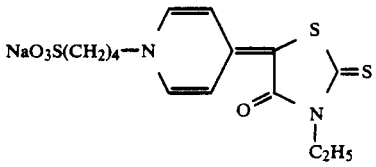
I-35
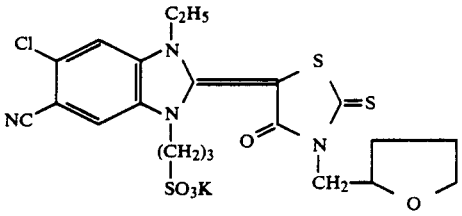
I-36
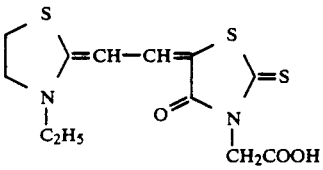
I-37
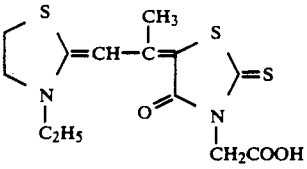
I-38
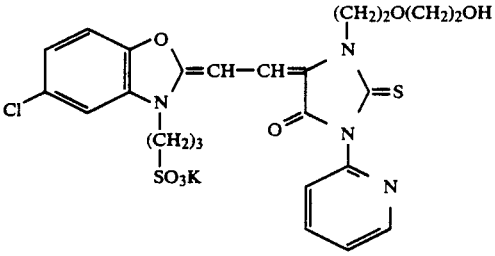
I-39
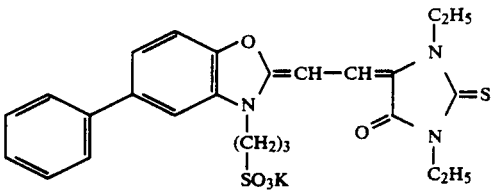

-continued

I-40

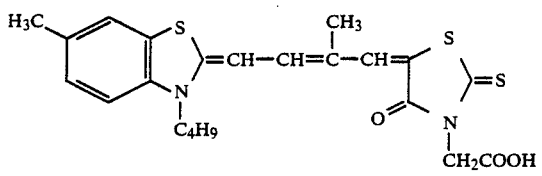

I-41

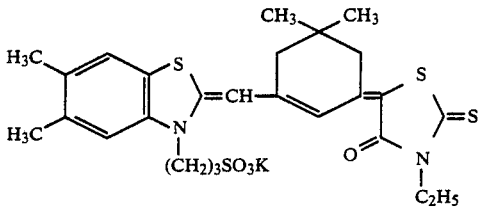

I-42

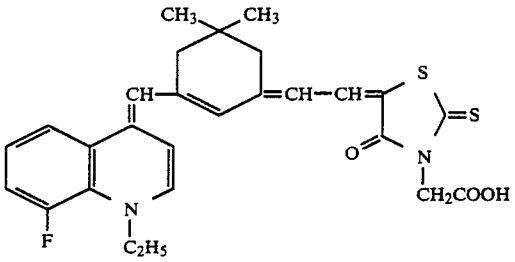

I-43

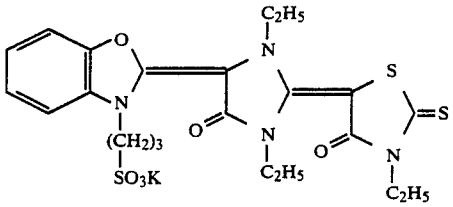

I-44

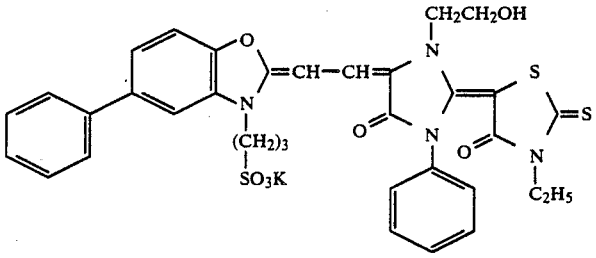

I-45

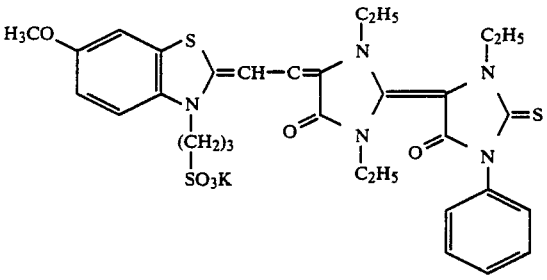

As the spectral sensitizing dyes, the compounds described in the following patent publications can also be used in the present invention, in addition to the above-mentioned compounds. These examples are not intended to limit the scope of the present invention. The patent publications include German Patent 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, 4,026,707, British Patents 1,242,588, 1,344,281, 1,507,803, Japanese Patent Publication Nos. 14030/69, 24844/77, 4936/68, 12375/78, Japanese Patent Application (OPI) Nos. 110618/77, 109925/77, 80827/75, etc.

Although the amount of the sensitizing dye to be added to the silver halide emulsion during the preparation of the emulsion cannot be generically defined as depending upon the kind of additives to be added to the emulsion or the amount of the silver halide in the emulsion, almost the same amount as that to be added in a conventional method can also be used in the present invention.

For example, the amount of the sensitizing dye to be added is preferably from 0.001 to 100 mmol, more preferably from 0.01 to 10 mmol, per mol of the silver halide in the emulsion.

The sensitizing dye is added to the emulsion before or after chemical ripening thereof. For the silver halide grains for use in the present invention, the sensitizing dye is most preferably added before or during the chemical ripening of the grains (for example, during the formation or physical ripening of the grains).

The emulsion of the present invention may further contain, together with the sensitizing dye(s), dyes having no spectral sensitizing action by themselves or materials which do not substantially absorb visible light but show supersensitizing action. For example, the emulsion can contain nitrogen-containing heterocyclic group-substituted aminostyryl compounds (such as those described in U.S. Pat. Nos. 2,933,390, 3,635,721, etc.), aromatic organic acid-formaldehyde condensation products (such as those described in U.S. Pat. No. 3,743,510, etc.), cadmium salts, azindene compounds, etc. The combinations described in U.S. Pat. Nos. 3,615,613, 3,615,641, 3,617,295, 3,635,721, etc. are especially preferable.

The silver halide emulsion of the present invention is generally chemically sensitized. For the chemical sensitization, for example, the method described in H. Frieser, *Die Grundlagen der Photographischen Prozesse mit Silver-halogeniden* (by Akademische Verlagsgesellschaft, 1968) can be utilized.

Specifically, a sulfur sensitization method using active gelatin or a sulfur-containing compound capable of reacting with silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a noble metal compound (e.g., gold complex salts and complex salts of metals belonging to group VIII of the Periodic Table, such as platinum, iridium, palladium, etc.) can be used individually or as in combination.

The photographic emulsion of the present invention can contain various compounds for the purpose of preventing fog during the manufacture step, storage or photographic processing of photographic materials or for the purpose of stabilizing the photographic property of the materials. For example, various kinds of compounds which are known as an anti-foggant or stabilizer can be added to the emulsion, including azoles such as benzothiazolium salts, nitroindazoles, triazoles, benzotriazoles, benzimidazoles (especially nitro- or halogen-substituents), etc., heterocyclic mercapto compounds such as mercaptothiazoles, mercaptobenzothiazoles, mercaptobenzmidazoles, mercaptothiadiazoles, mercaptotetrazoles (especially 1-phenyl-5-mercaptotetrazole), mercaptopyridines, etc., the above-mentioned heterocyclic mercapto compounds having a water-soluble group such as a carboxyl group or a sulfone group; thioketo compounds such as oxazolinethiones, etc., azaindenes such as tetrazaindenes (especially 4-hydroxy substituted-(1,3,3*a*,7)-tetrazaindenes), etc.; benzenethiosulfonic acids; benzenesulfinic acids, etc.

The addition of the said anti-foggant or stabilizer is effected generally after the chemical sensitization of the emulsion, more preferably during the chemical ripening of the emulsion or at any stage selected from the period before the initiation of the chemical ripening. That is, the anti-foggant or stabilizer can be added to the emulsion during the step of the formation of the silver halide emulsion grains, for example, at any stage during the addition of a silver salt solution, or after the addition of the said solution up to the initiation of the chemical ripening of the resulting emulsion, or during that chemical ripening (or in the course of the chemical ripening time, preferably up to 50% of the time from the initiation of chemical ripening, and more preferably up to 20% of the time therefrom).

There may be mentioned hydroxyazaindene compounds, benzotriazole compounds and heterocyclic compounds substituted by at least one mercapto compound and having at least two aza-nitrogen atoms in the molecule.

As examples of hydroxyazaindene compounds, those of formulae (II) or (III) can be mentioned.

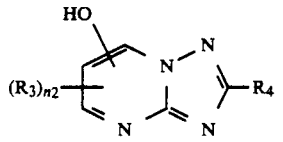

(II)

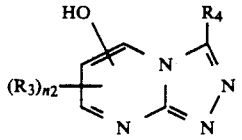

(III)

In these formulae, $R_3$ and $R_4$may be same or different and each represents a hydrogen atom; an aliphatic group (for example, an alkyl group (e.g., a methyl group, an ethyl group, a propyl group, a pentyl group, a hexyl group, an octyl group, an isopropyl group, a sec-butyl group, a t-butyl group, a cyclohexyl group, a cyclopentylmethyl group, a 2-norbornyl group, etc.), an alkyl group substituted by an aromatic group (e.g., a benzyl group, a phenethyl group, a benzhydryl group, a 1-naphthylmethyl group, a 3-phenylbutyl group, etc.), an alkyl group substituted by an alkoxy group (e.g., a methoxymethyl group, a 2-methoxyethyl group, a 3-ethoxypropyl group, a 4-methoxybutyl group, etc.), an alkyl group substituted by a hydroxyl group, a carboxyl group or an alkoxycarbonyl group (e.g., a hydroxymethyl group, a 2-hydroxymethyl group, a 3-hydroxybutyl group, a carboxymethyl group, a 2-carboxyethyl group, a 2-(methoxycarbonyl)ethyl group, etc.)); or an aromatic group (for example, an aryl group (e.g., a phenyl group, 1-naphthyl group, etc.), a substituted aryl group (e.g., a p-tolyl group, a m ethylphenyl group, a m-cumenyl group, a mesityl group, a 2,3-xylyl group, a p-chlorophenyl group, an o-bromophenyl group, a p-hydroxyphenyl group, a 1-hydroxy-2-naphthyl group, a m-methoxyphenyl group, a p-ethoxyphenyl group, a p-carboxyphenyl group, an o-(methoxycarbonyl)phenyl group, a m-(ethoxycarbonyl)phenyl group, a 4-carboxy-1-naphthyl group, etc.).

The total number of carbon atoms in $R_3$ and $R_4$ is preferably 12 or fewer.

$n_2$ represents 1 or 2.

Specific examples of the hydroxytetrazaindene compounds represented by the formula (II) or (III) are mentioned below. However, these examples are not intended to limit the scope of the present invention.

II-1: 4-Hydroxy-6-methyl-1,3,3α, 7-tetrazaindene
II-2: 4-Hydroxy-1,3,3*a*,7-tetrazaindene
II-3: 4-Hydroxy-6-methyl-1,2,3*a*,7-tetrazaindene
II-4: 4-Hydroxy-6-phenyl-1,3,3*a*,7-tetrazaindene
II-5: 4-Methyl-6-hydroxy-1,3,3*a*,7-tetrazaindene
II-6: 2,6-Dimethyl-4-hydroxy-1,3,3*a*,7-tetrazaindene
II-7: -4-Hydroxy-5-ethyl-6-methyl-1,3,3*a*,7-tetrazaindene
II-8: 2,6-Dimethyl-4-hydroxy-5-ethyl-1,3,3*a*,7-tetrazaindene
II-9: 4-Hydroxy-5,6-dimethyl-1,3,3*a*,7-tetrazaindene
II-10: 2,5,6-Trimethyl-4-hydroxy-1,3,3*a*,7-tetrazaindene
II-11: 2-Methyl-4-hydroxy-6-phenyl-1,3,3*a*,7-tetrazaindene
II-12: 4-Hydroxy-6-ethyl-1,2,3*a*,7-tetrazaindene
II-13: 4-Hydroxy-6-phenyl-1,2,3*a*,7-tetrazaindene
II-14: 4-Hydroxy-1,2,3*a*,7-tetrazaindene
II-15: 4-Methyl-6-hydroxy-1,2,3*a*,7-tetrazaindene
II-16: 5,6-Trimethylene-4-hydroxy-1,3,3*a*,7-tetrazaindene As examples of benzotriazole compounds, those represented by the following formula (IV) can be mentioned:

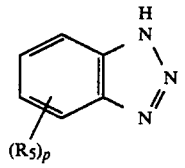

(IV)

wherein p represents 0 or an integer of from 1 to 4; $R_5$ represents a halogen atom (e.g., chlorine, bromine or iodine atom); an aliphatic group (including a saturated aliphatic group and an unsaturated aliphatic group), preferably, for example, an unsubstituted alkyl group having from 1 to 8 carbon atoms (e.g., a methyl group, an ethyl group, an n-propyl group, a hexyl group, etc.), a substituted alkyl group (preferably that in which the alkyl moiety has from 1 to 4 carbon atoms, such as a vinylmethyl group, or an aralkyl group (e.g., a benzyl group, a phenethyl group, etc.), a hydroxyalkyl group (e.g., a 2-hydroxyethyl group, a 3-hydroxypropyl group, a 4-hydroxybutyl group, etc.), an acetoxyalkyl group (e.g., a 2-acetoxyethyl group, a 3-acetoxypropyl group, etc.), an alkoxyalkyl group (e.g., a 2-methoxyethyl group, a 4-methoxybutyl group, etc.), etc.; or an aryl group (e.g., a phenyl group). $R_5$ is more preferably a halogen atom (chlorine or bromine atom) or an alkyl group having from 1 to 3 carbon atoms (e.g., a methyl group, an ethyl group or a propyl group).

Specific examples of benzotriazole compounds which can be used in the present invention are mentioned below. However, these examples are not intended to limit the scope of the present invention.

IV-1: Benzotriazole
IV-2: 5-Methyl-benzotriazole
IV-3: 5,6-Dimethylbenzotriazole
IV-4: 5-Bromo-benzotriazole
IV-5: 5-Chloro-benzotriazole
IV-6: 5-Nitro-benzotriazole
IV-7: 4-Nitro-6-chlorobenzotriazole
IV-8: 5-Nitro-6-chlorobenzotriazole Next, heterocyclic compounds substituted by at least one mercapto group and having at least two aza-nitrogen atoms in the molecule (hereinafter referred to as "mercapto group-substituted nitrogen-containing heterocyclic compounds") will be explained hereunder. The hetero ring of the compounds can have, in addition to the nitrogen atoms, other hetero atoms such as oxygen atom, sulfur atom, selenium atom, etc. Preferred are 5- or 6-membered mono-cyclic hetero-ring compounds having at least two aza-nitrogen atoms or di-cyclic or tri-cyclic hetero-ring compounds formed by condensation of two or three hetero-rings having at least one aza-nitrogen atom, in which the mercapto group is substituted on the carbon atom adjacent to the aza-nitrogen atom.

As examples of hetero-rings which can be applied to the mercapto group-substituted nitrogen-containing heterocyclic compounds for use in the present invention, there may be mentioned pyrazole rings, 1,2,4-triazole rings, 1,2,3-triazole rings, 1,3,4-thiadiazole rings, 1,2,3-thiadiazole rings, 1,2,4-thiadiazole rings, 1,2,5-thiadiazole rings, 1,2,3,4-tetrazole rings, pyridazine rings, 1,2,3-triazine rings, 1,2,4-triazine rings, 1,3,5-triazine rings, as well as condensation rings comprising two or more of the rings, for example, triazolotriazole rings, diazaindene rings, triazaindene rings, tetrazaindene rings, pentazaindene rings, etc. Condensation hetero-rings formed by condensation of monocyclic hetero-ring(s) and aromatic ring(s), for example, phthalazine rings, indazole rings, etc., can also be applied.

To represent the hetero-ring, 1,2,4-triazole rings, 1,3,4-thiadiazole rings, 1,2,3,4-tetrazole rings, 1,2,4-triazine rings, triazolotriazole rings and tetrazaindene rings are preferred.

The mercapto group may be substituted on any carbon atom in the rings, and preferably, the following structures can be mentioned:

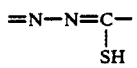

a)

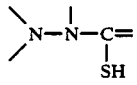

b)

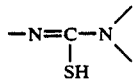

c)

The hetero-rings can have other substituent(s) besides the mercapto group. As examples of the substituents which can be applied to the hetero-rings, there may be mentioned an alkyl group having up to 8 carbon atoms (e.g., a methyl group, an ethyl group, a cyclohexyl group, a cyclohexymethyl group, etc.), a substituted alkyl group (e.g., a sulfoethyl group, a hydroxymethyl group, etc.), an alkoxy group having up to 8 carbon atoms (e.g., a methoxy group, an ethoxy group, etc.), an alkylthio group having up to 8 carbon atoms (e.g., a methylthio group, a butylthio group, etc.), a hydroxyl group, an amino group, a hydroxyamino group, an alkylamino group having up to 8 carbon atoms (e.g., a methylamino group, a butylamino group, etc.), a dialkylamino group having up to 8 carbon atoms (e.g., a dimethylamino group, a diisopropylamino group, etc.), an arylamino group (e.g., an anilino group, etc.), an acylamino group (e.g., an acetylamino group, etc.), a halogen atom (e.g., a chlorine atom, a bromine atom, etc.), a cyano group, a carboxyl group, a sulfo group, a sulfato group, a phospho group, etc.

Examples of the mercapto group-substituted nitrogen-containing heterocyclic compounds which can be used in the present invention are mentioned below. However, these examples are not intended to limit the scope of the present invention.

V-1

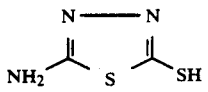

V-2

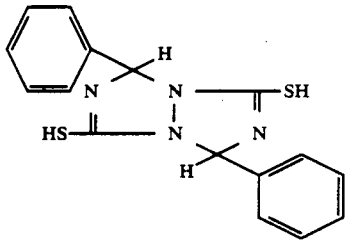

V-3

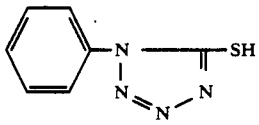

V-4

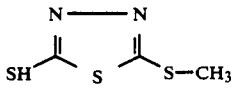

V-5

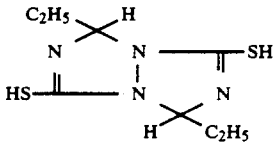

V-6

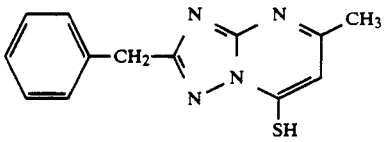

V-7

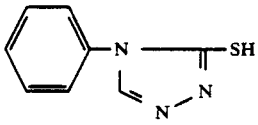

V-8

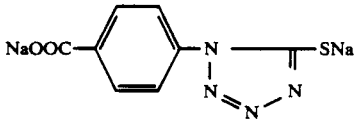

Although the amount of the compounds of the above-mentioned formulae (II), (III), (IV) and (V) for use in the present invention are not generically limited, as depending upon the method for the addition thereof or the amount of the silver halide in the emulsion, the preferred amount is from $10^{-7}$ mol to $10^{-2}$ mol, and more preferably from $10^{-5}$ mol to $10^{-2}$ mol, per mol of the silver halide.

The multilayer silver halide color photographic material of the present invention, which contains the above-mentioned emulsion of the present invention, has a multilayered structure comprising plural emulsion layers for separately recording blue light, green light and red light, each of the emulsion layer containing a binder and silver halide grains. Further, the respective emulsion layers comprise at least two layers of a high-sensitive layer and a low-sensitive layer. Especially practical layer structures for the materials of the present invention are mentioned below:

(1) BH/BL/GH/GL/RH/RL/S
(2) BH/BM/BL/GH/BM/GL/RH/RM/RL/S
(3) BH/BL/GH/RH/GL/RL/S (described in U.S. Pat. No. 4,184,876)
(4) BH/GH/RH/BL/GL/RL/S (described in Research Disclosure No. 22534, Japanese Patent Application (OPI) Nos. 177551/84 and 177552/84)

In the above-mentioned layer structures, B means a blue-sensitive layer, G means a green-sensitive layer, R means a red-sensitive layer, H means a highly sensitive layer, M means a moderately sensitive layer, L means a low sensitivity layer and S means a support. Non-light-sensitive layers such as protective layers, filter layers, interlayers, anti-halation layers, subbing layers, etc. are not shown.

Among the structures, (1), (2) and (4) are preferred.

In addition, the following layer structures described in Japanese Patent Application (OPI) No. 34541/86 are also preferred.

(5) BH/BL/CL/GH/GL/RH/RL/S
(6) BH/BL/GH/GL/CL/RH/RL/S

In the structures, CL means an interlayer effect-imparting layer, and others have the same meanings as mentioned above.

In the case of the layer structure (1), the emulsion of the present invention is to be used in at least one layer of BH, BL, GH, GL, RH and RL. Preferably, the emulsion of the present invention having an aspect ratio of from 5 to 8 is used in BH and BL, and the emulsion of the present invention having an aspect ratio of 5 or less is used in GH, GL, RH and RL.

More preferably, the emulsion of the present invention having an aspect ratio of 5 or less is used in all the layers of GH, GL, RH and RL. Monodispersed silver halide grains can be used in BH, as so disclosed in Japanese Patent Application (OPI) No. 14145/88.

In the case of the layer structure (5), it is preferred to also use the emulsion of the present invention in the CL layer.

In the case of (6), it is preferred to use the emulsion of the present invention, especially that having an aspect ratio of 5 or less, in the CL layer.

In the layer structures (5) and (6), the emulsions to be used in the other layers than CL are same as those in the layer structure (1).

Also, as described in Japanese Patent Application (OPI) Nos. 112751/82, 200350/87, 206541/87, 206543/87, etc., a low sensitivity emulsion layer can be provided on the side far from the support and a highly sensitive layer on the side near the support.

Although the silver halide emulsion of the present invention is most effectively used in color photographic materials, as mentioned above, this can of course be used in any other photographic light-sensitive materials, for example, photographic light-sensitive materials for X-ray, photographic light-sensitive materials for black-and-white picture-taking, photographic light-sensitive materials for photomechanical process, photographic papers, etc.

Various additives for the silver halide emulsion of the present invention, for example, binder, chemical sensitizer, spectral sensitizer, stabilizer, gelatin hardening agent, surfactant, antistatic agent, polymer latex, matt agent, color coupler, ultraviolet absorbent, anti-fading agent, dye, etc., as well as supports for photographic materials containing the said emulsion, and coating means, exposure means and development and processing means for the said photographic materials are not specifically limited from use in the practice of the present invention. *Research Disclosure,* Vol. 176, Item 17643 (RD-17643), ibid., Vol. 187, Item 18716 (RD-18716) and ibid., Vol. 225, Item 22534 (RD-22534) is one source that can be referred to for instruction on and descriptions of various additives.

The related descriptions in these *Research Disclosures* are listed hereunder.

| Type of Additives | RD 17643 | RD 18716 | RD 22534 |
|---|---|---|---|
| 1. Chemical Sensitizer | p. 23 | p. 648, right column | p. 24 |
| 2. Sensitivity-elevating Agent | — | p. 648, right column | — |
| 3. Spectral Sensitizer, Super Color Sensitizer | pp. 23–24 | from p. 648, right column to p. 649, right column | pp. 24–28 |
| 4. Whitening Agent | p. 24 | — | — |
| 5. Anti-foggant, Stabilizer | pp. 24–25 | p. 649, right column | pp. 24, 30 |
| 6. Light-absorbing Agent, Filter Dye, Ultraviolet Absorbent | pp. 25–26 | from p. 649, right column to p. 650, left column | — |
| 7. Stain Preventing Agent | p. 25, right column | p. 650, from left to right column | — |
| 8. Color Image Stabilizer | p. 25 | — | p. 32 |
| 9. Hardening Agent | p. 26 | p. 650, left column | p. 28 |
| 10. Binder | p. 26 | p. 650, left column | — |
| 11. Plasticizer, Lubricant | p. 27 | p. 650, right column | — |
| 12. Coating Aid, Surfactant | pp. 26–27 | p. 650, right column | — |
| 13. Antistatic Agent | p. 27 | p. 650, right column | — |
| 14. Coupler | p. 25 | p. 649 | — |

It is preferred that the color couplers for use in the present invention are nondiffusible due to having a ballast group or being polymerized. 2-Equivalent couplers substituted by a coupling-releasable group are more preferred than 4-equivalent couplers having a hydrogen atom at the coupling active position, as the use of the former can reduce the amount of silver for color photographic materials. Couplers giving colored dyes having a proper diffusibility, non-color-forming couplers, DIR couplers releasing a development inhibitor with coupling reaction, or DAR couplers releasing a development accelerator with coupling reaction can also be used in the present invention.

As the yellow couplers for use in the present invention, typical examples include oil protective type acylacetamide couplers. Specific examples of these couplers are described in U.S. Pat. Nos. 2,407,210, 2,875,057, 3,265,605, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom-releasing type yellow couplers described in Japanese Patent Publication No. 10739/83, U.S. Pat. Nos. 4,401,752, 4,326,024, *Research Disclosure,* No. 18053 (April, 1979), British Patent 1,425,020, West German Patent Application (OLS) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

As the magenta couplers for use in the present invention, there are oil protective type indazolone series or cyanoacetyl series couplers, and preferably 5-pyrazolone series magenta couplers and other pyrazoloazole series couplers such as pyrazolotriazole, etc. As the 5-pyrazolone series couplers, those substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896, 3,936,015, etc. Also, as the releasable groups for the 2-equivalent 5-pyrazolone series couplers, the nitrogen atom releasing groups described in U.S. Pat. No. 4,310,619 and the arylthio groups described in U.S. Pat. No. 4,351,897 are preferred. Furthermore, the 5-pyrazolone series magenta couplers having a ballast group described in European Patent 73,636 give high coloring density.

As the pyrazoloazole series couplers, there may be mentioned the pyrazolobenzimidazoles described in U.S. Pat. No. 3,061,432, preferably the pyrazolo(5,1-c)(1,2,4)triazoles described in U.S. Pat. No. 3,725,067, the pyrazolotetrazoles described in *Research Disclosure,* No. 24220 (June, 1984) and Japanese Patent Application (OPI) No. 33552/85, and the pyrazolopyrazoles described in *Research Disclosure,* No. 24230 (June, 1984) and Japanese Patent Application (OPI) No. 43659/85. The imidazo(1,2-b)pyrazoles described in U.S. Pat. No. 4,500,630 are preferred because of the small yellow side-absorption of the colored dye and of the sufficient light-fastness thereof, and in particular, the pyrazolo(1,5-b)(1,2,4)triazoles described in U.S. Pat. No. 4,540,654 are especially preferred.

As the cyan couplers for use in the present invention, there are oil protective type naphthol series or phenol series couplers. Specific examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233, 4,296,200. Also, specific examples of the phenol series cyan couplers are described in U.S. Pat. Nos.

2,369,929, 2,801,171, 2,772,162, 2,894,826, etc. Cyan couplers having high fastness to humidity and temperature are preferably used in the present invention and specific examples of these cyan couplers include the phenol series cyan couplers having an alkyl group or 2 or more carbon atoms at the meta-position of the phenol nucleus described in U.S. Pat. No. 3,772,002; the 2,5-diacylamino-substituted phenol series cyan couplers described in U.S. Pat. Nos. 2,772,162, 3,758,308, 4,126,396, 4,334,011, 4,327,173, West German Patent Application (OLS) No. 3,329,729, European Patent 121,365; etc.; and the phenol series couplers having a phenylureido group at the 2-position thereof and an acylamino group at the 5-position thereof described in U.S. Pat. Nos. 3,446,622, 4,333,999, 4,451,559, 4,427,767, etc. The naphthol cyan couplers having a substituent of a sulfonamido group or amido group at the 5-position thereof, described in U.S. Pat. No. 4,690,889, are excellent in fastness of colored dyes formed, and therefore these can preferably be used in the present invention.

In order to correct the unnecessary absorption in the short wavelength range of the dyes to be formed from magenta and cyan couplers, colored couplers are preferably used together with the couplers in the color negative photographic materials for picture-taking. Specific examples of such colored couplers include the yellow-colored magenta couplers described in U.S. Pat. No. 4,163,670, Japanese Patent Publication No. 39413/82, the magenta-colored cyan couplers described in U.S. Pat. Nos. 4,004,929, 4,138,258 and British Patent 1,146,368, etc.

In the present invention, by using couplers giving colored dyes having a proper diffusibility together with the aforesaid color couplers, the graininess of color images formed can be improved. Specific examples of couplers giving such diffusible dyes are described in U.S. Pat. No. 4,366,237 and British Patent 2,125,570 and specific examples of yellow, magenta and cyan couplers of this type are described in European Patent 96,570 and West German Patent Application (OLS) No. 3,234,533.

The dye-forming couplers and the above-mentioned specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Patent 2,102,173, U.S. Pat. No. 4,367,282, Japanese Patent Application (OPI) No. 232455/86, and Japanese Patent Application No. 113596/85, etc.

The photographic materials of the present invention may further contain a so-called DIR coupler capable of releasing a development inhibitor with development.

DIR couplers for use in the present invention include, for example, those releasing a heterocyclic mercapto series development inhibitor, which are described in U.S. Pat. No. 3,227,554, etc.; those releasing a benzotriazole derivative as a development inhibitor, which are described in Japanese Patent Publication No. 9942/83; so-called DIR couplers which are described in Japanese Patent Publication No. 16141/76; those releasing a nitrogen-containing heterocyclic development inhibitor as accompanied by decomposition of methylol after the release, which are described in Japanese Patent Application No. 90932/77; those releasing a development inhibitor as accompanied by intramolecular nucleophilic reaction after the release, which are described in U.S. Pat. No. 4,248,962 and Japanese Patent Application (OPI) No. 56837/82; those releasing a development inhibitor by electron transference through the conjugated system after the release, which are described in Japanese Patent Application (OPI) Nos. 114946/81, 154234/82, 188035/82, 98728/83, 09736/83, 209737/83, 209738/83, 209739/80, 209740/83, etc.; those releasing a diffusible development inhibitor which may deactivate in a developer, as described in Japanese Patent Application (OPI) Nos. 151944/82, 21793/83, etc.; those releasing a reactive compound which may form a development inhibitor by the reaction in the film during the development thereof or may deactivate the development inhibitor by the same reaction, as described in Japanese Patent Application (OPI) No. 182438/85, 184248/85, etc. Among the above-mentioned DIR couplers, preferred ones for use in combination with the emulsions of the present invention are the developer-deactivating type DIR couplers typically described in Japanese Patent Application No. 151944/82; the timing type DIR couplers typically described in U.S. Pat. No. 4,248,962 and Japanese Patent Application (OPI) No. 154234/82; and the reactive type DIR couplers typically described in Japanese Patent Application (OPI) No. 184248/85. Especially preferred among them are the developer-deactivating type DIR couplers described in Japanese Patent Application (OPI) Nos. 151944/82, 217932/83, 218644/85, 225156/85 and 233650/85, etc.; and the reactive type DIR couplers described in Japanese Patent Application (OPI) No. 184248/85, etc.

The photographic light-sensitive materials of the present invention can contain a compound capable of imagewise releasing a nucleating agent or a development accelerator or a precursor thereof (hereinafter referred to as "development accelerator, etc.") during development. Typical examples of such compounds are described in British Patents 2,097,140, 2,131,188, etc., which are DAR couplers capable of releasing a development accelerator, etc. by the coupling reaction with the oxidation product of an aromatic primary amine developing agent.

It is preferred that the development accelerator, etc. to be released from the DAR coupler has an adsorbability to silver halides, and concrete examples of such DAR couplers are described in Japanese Patent Application (OPI) Nos. 157638/84, 170840/84, etc. In particular, DAR couplers capable of forming an N-acyl-substituted hydrazine compound which can be released from the coupling active position of the coupler through the sulfur atom or nitrogen atom and which has a mono-cyclic or condensed hetero-ring as an adsorbing group are especially preferred, and concrete examples of such couplers are described in Japanese Patent Application (OPI) No. 128446/85, etc.

Further, as other couplers which can be used in the photographic light-sensitive materials of the present invention, there may be mentioned the competing couplers described in U.S. Pat. No. 4,130,427; the polyvalent couplers described in U.S. Pat. Nos. 4,283,472, 4,338,393, 4,310,618, etc.; the DIR redox compound- or DIR coupler-releasing couplers described in Japanese Patent Application (OPI) Nos. 185950/85, 24252/87, etc.; the couplers of releasing a dye which may re-color after released, described in European Patent 173,302A; the bleaching accelerator-releasing couplers described in *Research Disclosure*, Nos. 11449 and 24241, Japanese Patent Application (OPI) No. 201247'86, etc.; the ligand-releasing couplers described in U.S. Pat. No. 4,553,477, etc.
Specific examples of the color couplers which can be used in the present invention are mentioned hereunder. However, these examples are not intended to limit the scope of the present invention.
C-(1)
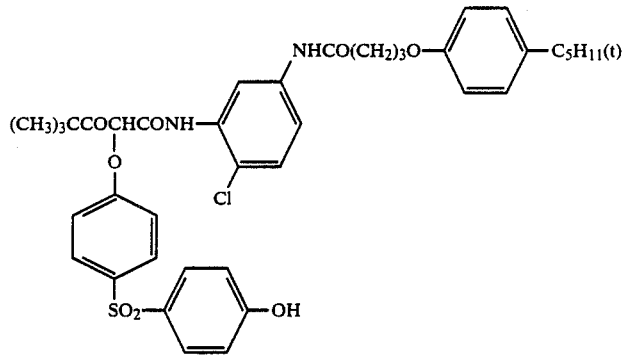
C-(2)
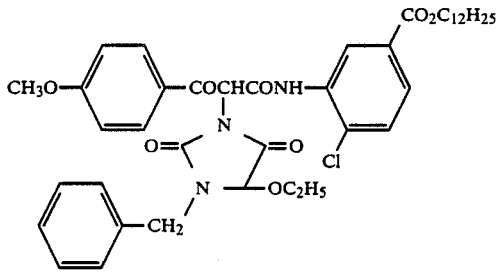
C-(3)
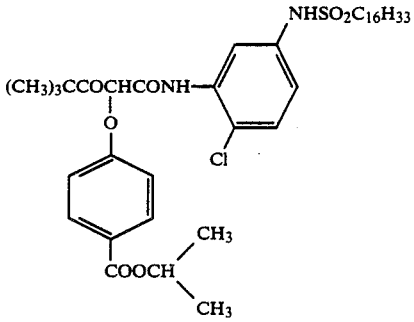
C-(4)
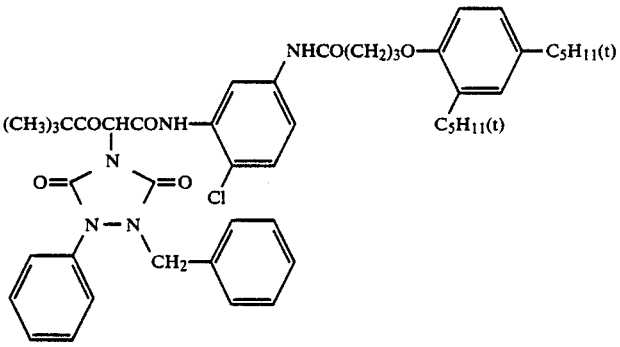

-continued
C-(5)
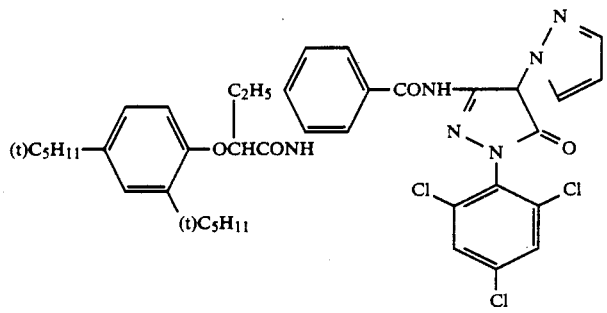
C-(6)
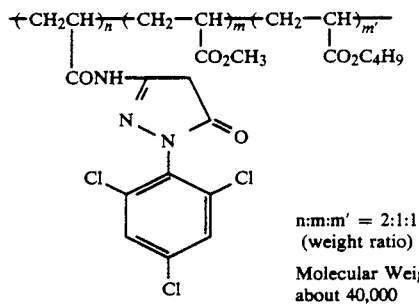
n:m:m' = 2:1:1
(weight ratio)
Molecular Weight:
about 40,000
C-(7)
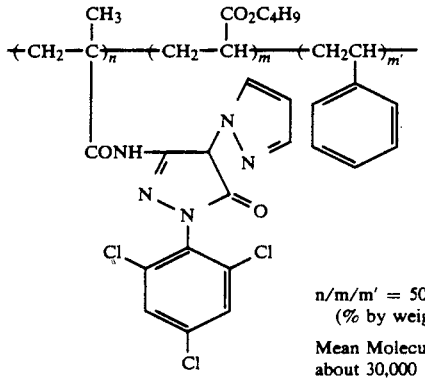
n/m/m' = 50/25/25
(% by weight)
Mean Molecular Weight:
about 30,000
C-(8)
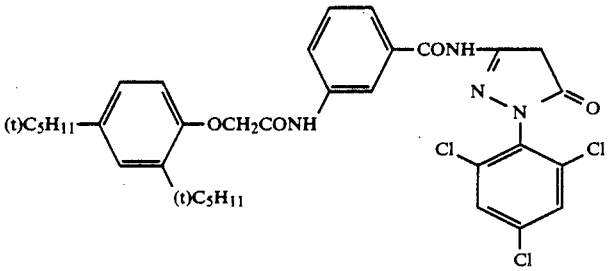
C-(9)
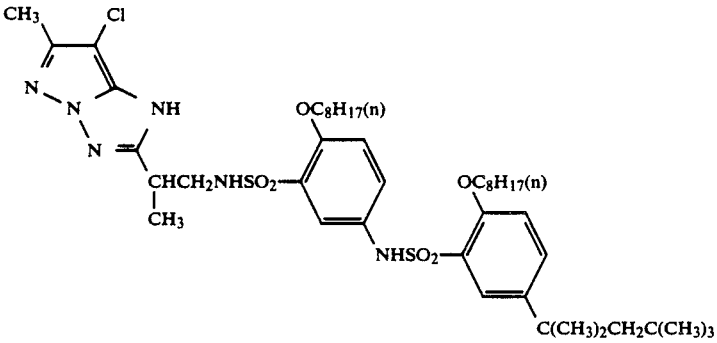

-continued
C-(10)
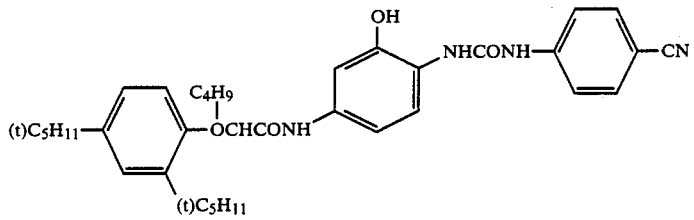
C-(11)
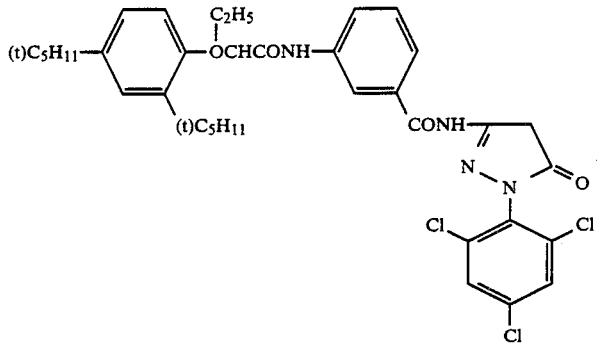
C-(12)
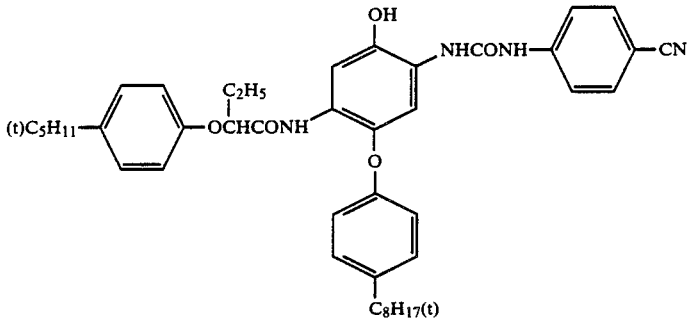
C-(13)
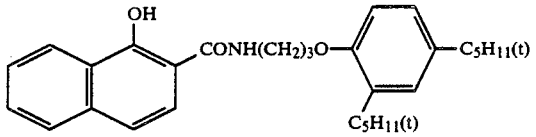
C-(14)
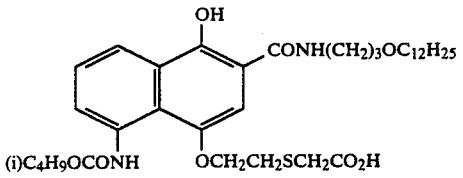
C-(15)
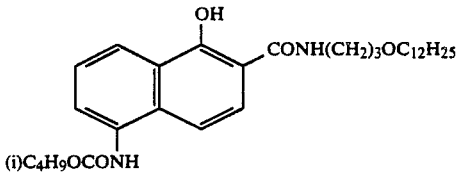

-continued
C-(16)
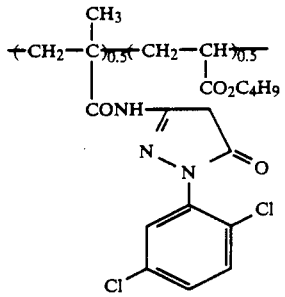
(Numerals mean weight ratio.)
C-(17)
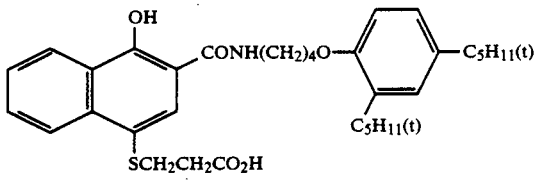
C-(18)
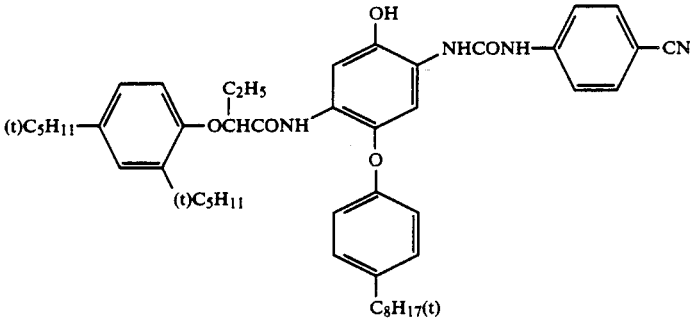
C-(19)
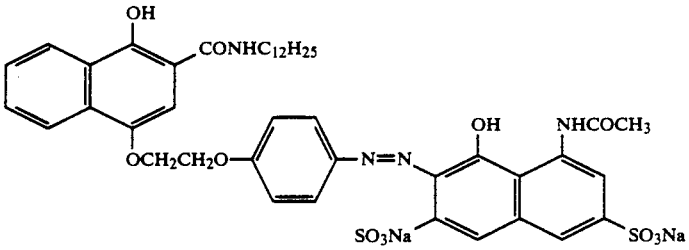
C-(20)
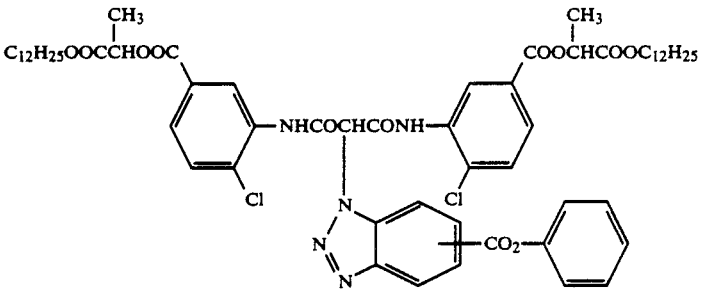

-continued
C-(21)
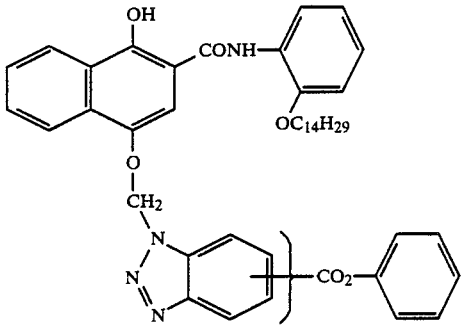
C-(22)
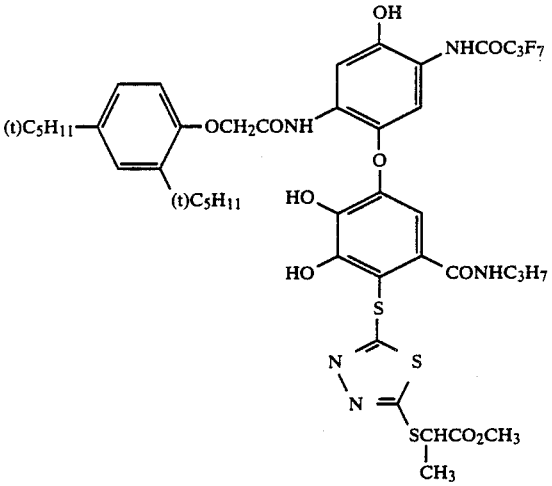
C-(23)
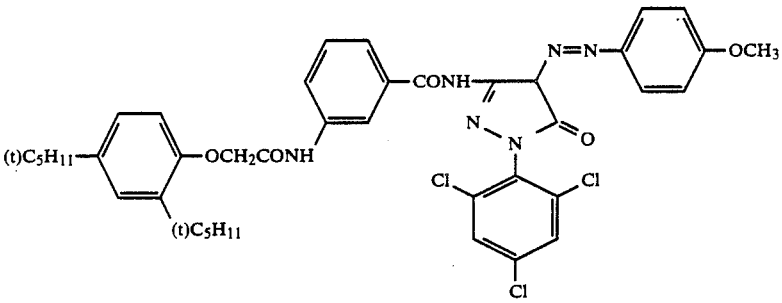
C-(24)
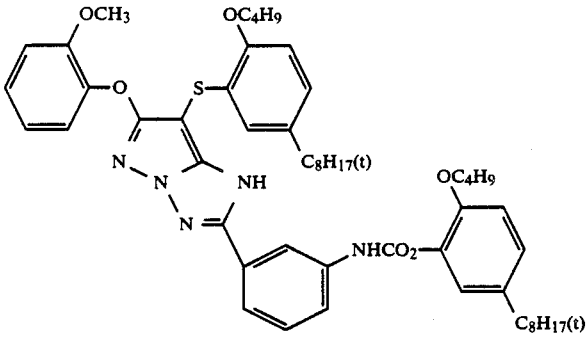

-continued
C-(25)
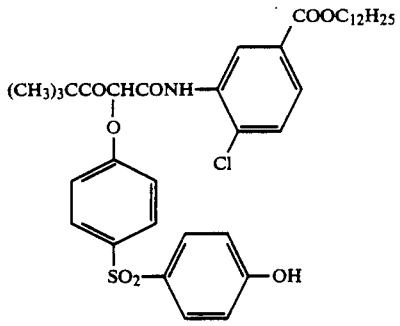
C-(26)
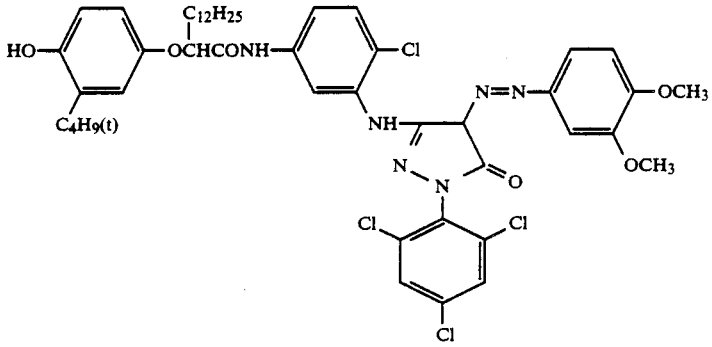
C-(27)
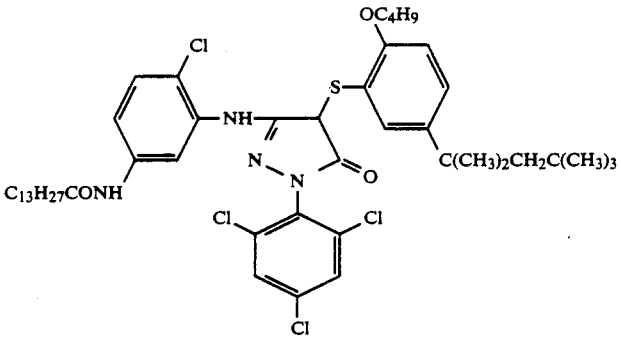
C-(28)
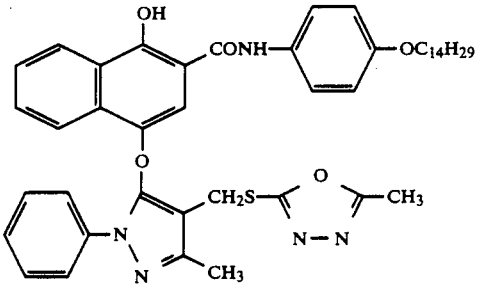
C-(29)
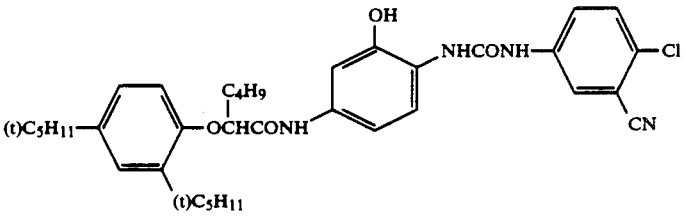

-continued
C-(30)
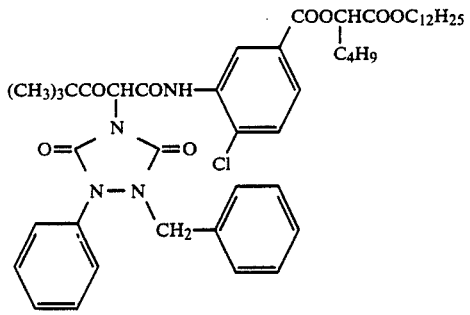
C-(31)
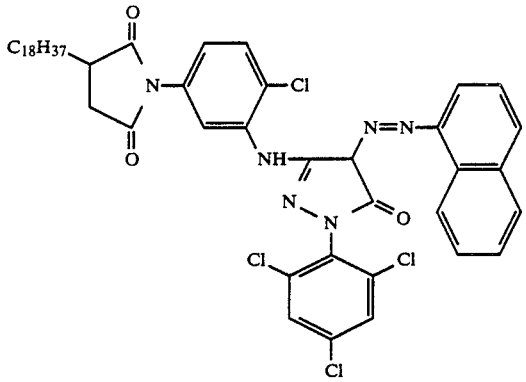
C-(32)
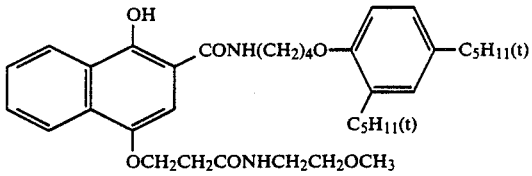
C-(33)
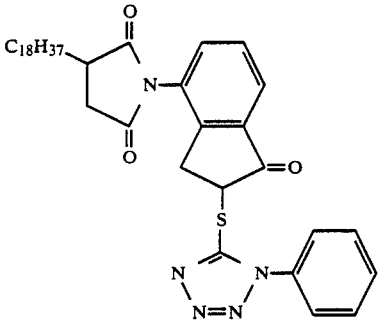
C-(34)
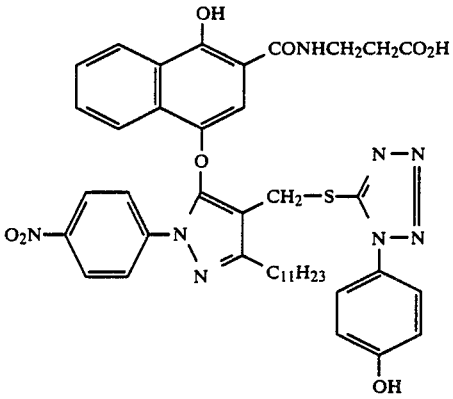

-continued
C-(35)
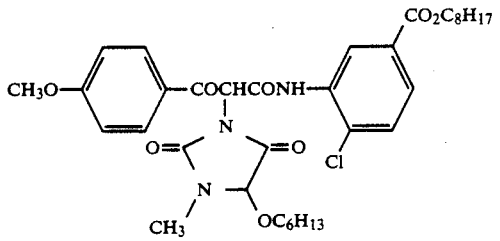
C-(36)
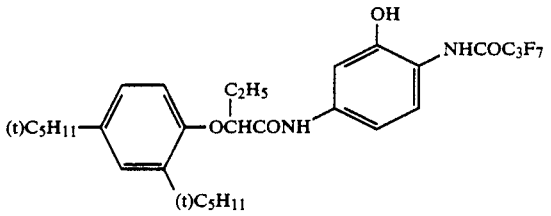
C-(37)
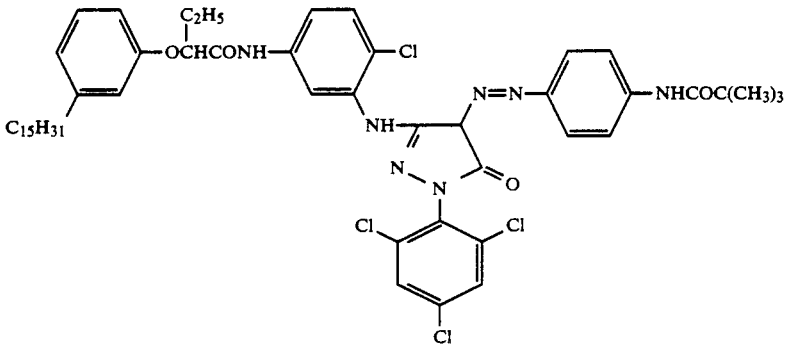
C-(38)
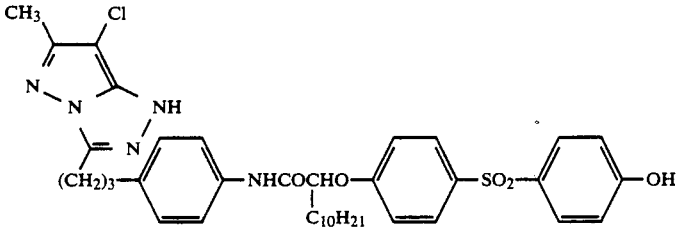
C-(39)
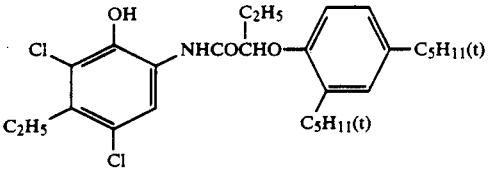
C-(40)
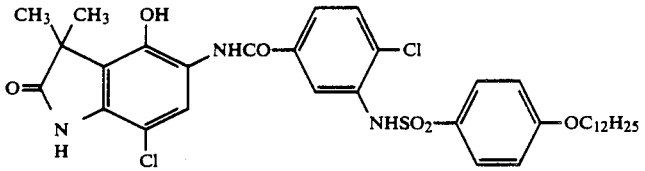
C-(41)
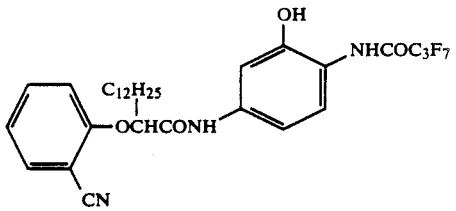

-continued
C-(42)
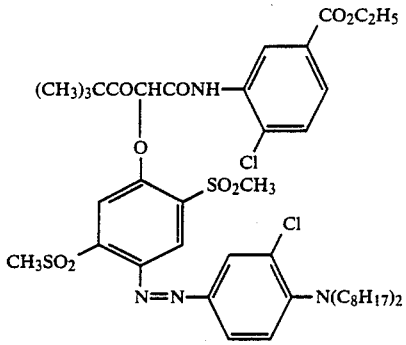
C-(43)
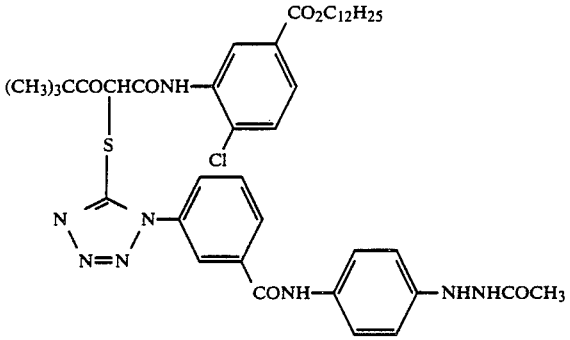
C-(44)
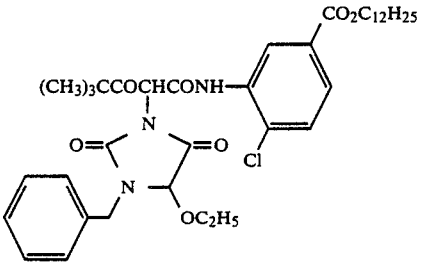
C-(45)
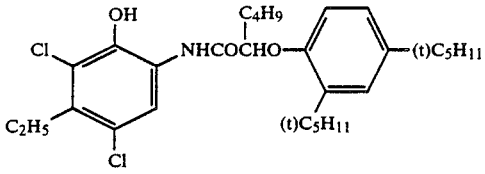
C-(46)
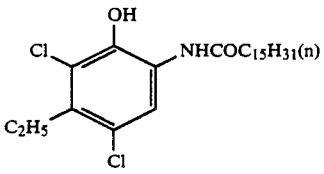
C-(47)
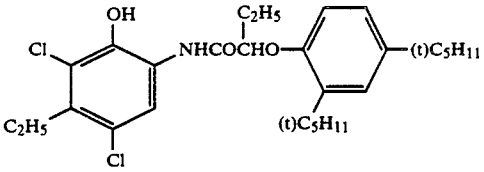

-continued
C-(48)
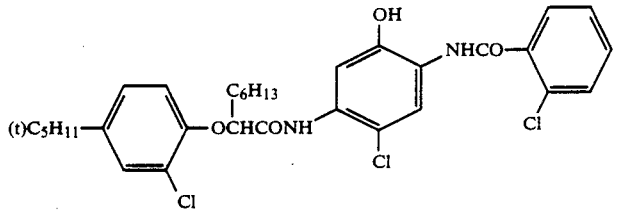
C-(49)
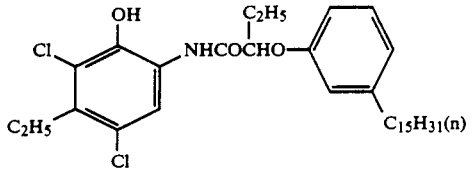
C-(50)
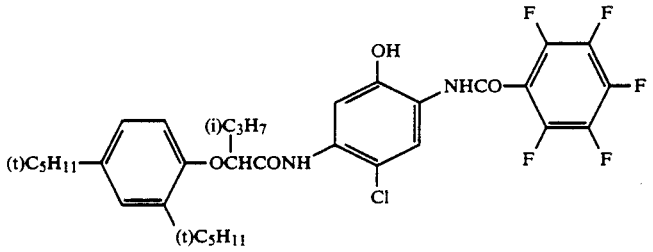
C-(51)
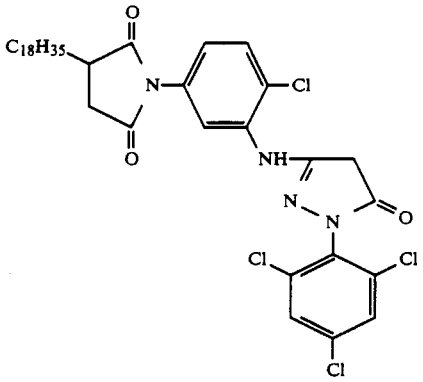
C-(52)
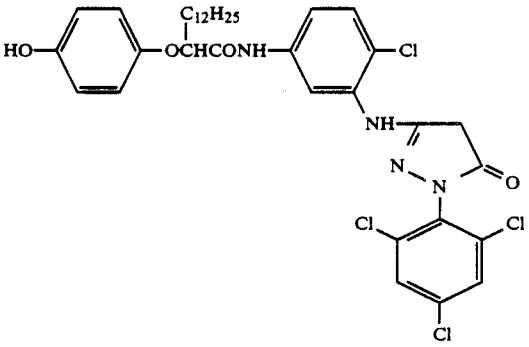

-continued
C-(53)
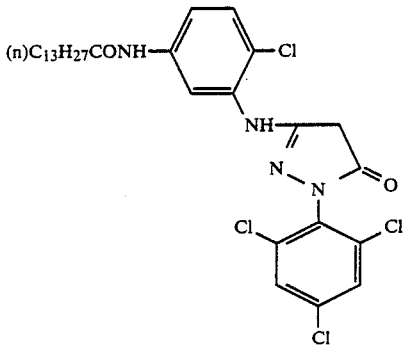
C-(54)
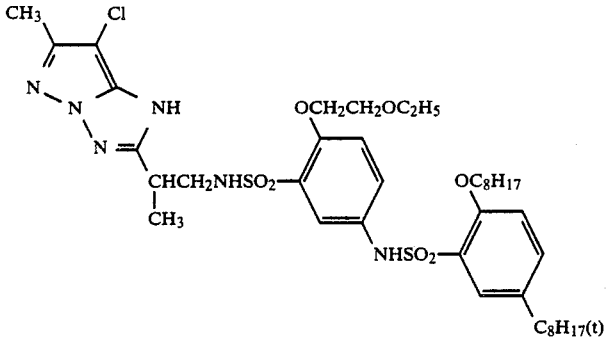
C-(55)
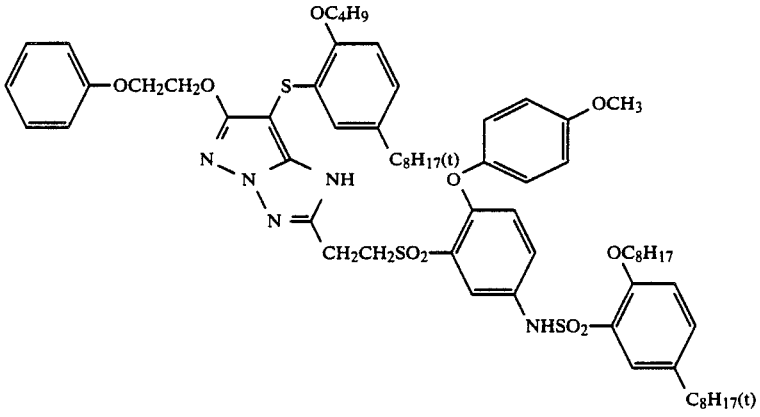
C-(56)
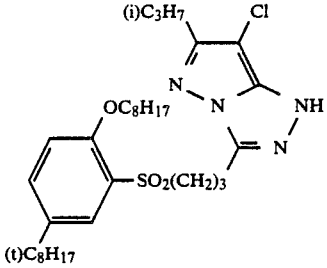

-continued

C-(57)

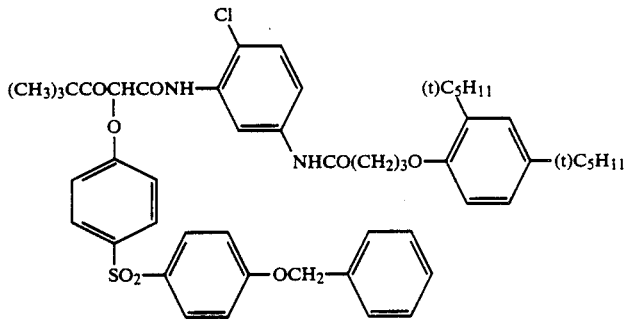

C-(58)

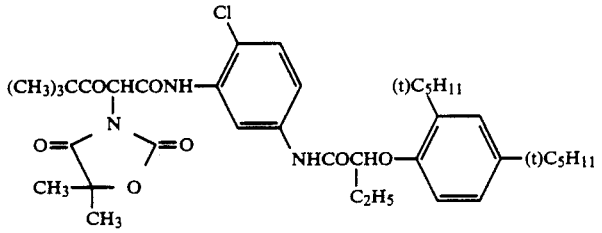

C-(59)

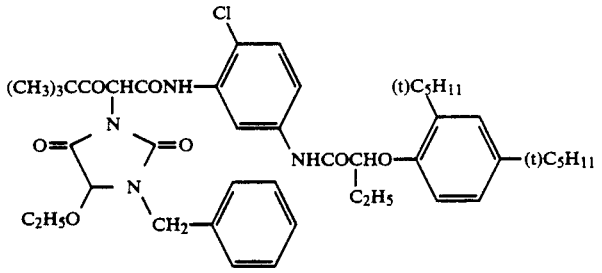

C-(60)

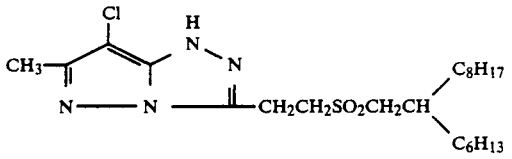

For dispersion of the above-mentioned color couplers high boiling organic solvents are used. Specific examples of such solvents include phthalic acid esters (e.g., dibutyl phthalate, dicyclohexyl phthalate, di-2-ethylhexyl phthalate, decyl phthalate, etc.), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphonate, etc.), benzoic acid esters (e.g., 2-ethylhexyl benzoate, dodecyl benzoate, 2-ethylhexyl-p-hydroxybenzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (paraffin, dodecylbenzene, diisopropylnaphthalene, etc.), etc. As an auxiliary solvent, organic solvents which have a boiling point of about 30° C. or higher, preferably from 50° C. to about 160° C. can be used. Specific examples of such solvents include ethyl acetate, butyl acetate, ethyl propionate, methyl ethyl ketone, cyclohexanone, 2-ethoxyethyl acetate, dimethylformamide, etc.

Supports which can suitably be used for the silver halide photographic emulsion of the present invention are described, for example, in *Research Disclosure*, No. 17643, page 28 and ibid., No. 18716, from page 647, right-hand column to page 648, left-hand column.

Although gelatins (e.g., lime-processed gelatin, acid-processed gelatin, etc.) are preferred as the binder for the silver halide photographic emulsion of the present invention, gelatin derivatives such as phthalated gelatin as well as albumin, agar, gum arabi, cellulose derivatives, polyvinyl acetate, polyacrylamide, polyvinyl alcohol, etc. can also be used in addition to gelatins.

As a gelatin hardening agent, for example, active halogen compounds (e.g., 2,4-dichloro-6-hydroxy-1,3,5-triazine and sodium salt thereof, etc.) and active vinyl compounds (e.g., 1,3-bisvinylsulfonyl-2-propanol, 1,2-bis(vinylsulfonylacetamido)ethane or vinyl series polymers having a vinylsulfonyl group in the side chain, etc.) are preferred, as these can rapidly harden hydrophilic colloids such as gelatin, etc. to give a stable photographic characteristic. Further, N-carbamoylpyridinium salts (e.g., 1-morpholinocarbonyl-3-pyridinio)methanesulfonate, etc.) and haloamidinium salts (e.g., 1-(1-chloro-1-pyridinomethylene)pyrrolidinium-2-naphthalene-sulfonate, etc.) are also excellent because they harden rapidly.

The color photographic light-sensitive materials of the present invention which contain the silver halide photographic emulsion of the present invention can be developed by the conventional method described in *Research Disclosure,* No. 17643, pages 28 to 29 and ibid., No. 18716, page 651, from left-hand to right-hand column.

The color developer to be used for development of the photographic light-sensitive materials of the present invention is preferably an alkaline aqueous solution consisting essentially of an aromatic primary amine series color developing agent. As the color developing agent, p-phenylenediamine series compounds are preferably used, although aminophenol series compounds can also be used. Typical examples of p-phenylenediamine series compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides or p-toluenesulfonates thereof. These compounds can be used in a combination of two or more of them, in accordance with the object of the compounds.

The color developer generally contains a pH buffer such as alkali metal carbonates, borates or phosphate, and a development inhibitor or anti-foggant such as one of the bromides, iodides, benzimidazoles, benzothiazoles or mercapto compounds, etc. This color developer may further contain, if desired, various kinds of preservatives such as hydroxylamine, diethylhydroxylamine, hydrazine sulfites, phenylsemicarbazides, triethanolamine, catechol-sulfonic acids, triethylenediamine(1,4-diazabicyclo[2,2,2]octanes), etc.; organic solvents such as ethylene glycol, diethylene glycol, etc.; development accelerators such as benzyl alcohol, polyethylene glycol, quaternary ammonium salts, amines, etc.; color forming couplers; competing couplers; fogging agents such as sodium boronhydride, etc.; auxiliary developing agents such as 1-phenyl-3-pyrazolidone, etc.; tackifiers; various kinds of chelating agents such as aminopolycarboxylic acids, aminopolyphosphonic acids, alkylphosphonic acids, phosphonocarboxylic acids, etc. (for example, ethylenediamine-tetraacetic acid, nitrilo-triacetic acid, diethylenetriamine-pentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylene-phosphonic acid, ethylenediamine-di-(o-hydroxyphenylacetic acid) and their salts), etc.

For reversal processing, in general, the photographic material is first subjected to black-and-white development and then to color development. For the black-and-white development conventional black-and-white developing agents, for example, dihydroxybenzenes such as hydroquinone, etc., 3-pyrazolidones such as 1-phenyl-3-pyrazolidone, etc., or aminophenols such as N-methyl-p-aminophenol, etc., singly or in combination of the agents, can be used.

In general, the color developer and the black-and-white developer has a pH value of from 9 to 12. The amount of the replenisher for the developers may generally be 3 liters or less per $m^2$ of the color photographic material being processed, depending upon the kind of the material. By reducing the bromide ion concentration in the replenisher, the amount of the replenisher may be 500 ml or less per $m^2$ of the material. If the amount of the replenisher is to be decreased, it is preferred to reduce the contact area of the processing tank with air so as to prevent the evaporation and aerial oxidation of the processing liquid in the tank. Further, the amount of the replenisher may also be decreased by using a means of inhibiting the accumulation of bromide ion in the developer used.

After the color development, the photographic emulsion layer is generally bleached. The bleaching of the layer can be carried out simultaneously with fixation (bleach-fixation), or (alternatively) separately therefrom. For rapid processing, the bleaching may be followed by the successive bleach-fixation. Further, processing through a bleach-fixation bath comprising two serial tanks, fixation prior to bleach-fixation, or bleach-fixation followed by bleaching can also be carried out, if desired, in accordance with the object of the photographic processing. As the bleaching agent, for example, compounds of polyvalent metals such as iron (III), cobalt (III), chromium (VI), copper (II), etc. as well as peracids, quinones, nitro compounds, etc. can be used. Specific examples of the bleaching agents include ferricyanides; bichromates; organic complexes of iron (III) or cobalt (III), for example, complexes with aminopolycarboxylic acids (e.g., ethylenediamine-tetraacetic acid, diethylenetriamine-pentaacetic acid, cyclohexanediamine-tetraacetic acid, methyliminodiacetic acid, 1,3-diaminopropane-tetraacetic acid, glycoletherdiamine-tetraacetic acid, etc.) or with citric acid, tartaric acid, malic acid, etc.; persulfates; bromates; permanganates; nitrobenzenes, etc. Among them, aminopolycarboxylic acid iron (III) complexes such as ethylenediamine-tetraacetic acid iron (III) complex as well as persulfates are especially preferred from the viewpoint of the rapid processability and prevention of environmental pollution. Further, aminopolycarboxylic acid iron (III) complexes are especially useful both in a bleaching solution and in a bleach-fixing solution. The bleaching solution or bleach-fixing solution containing the aminopolycarboxylic acid iron (III) complex has, in general, a pH value of from 5.5 to 8, but this may have a lower pH value for the purpose of more rapidly carrying out the processing.

A bleaching accelerator can be added to the bleaching solution and bleach-fixing solution and the previous bath thereof, if desired. As examples of useful bleaching accelerators, there may be mentioned the mercapto group- or disulfido bond-containing compounds described in U.S. Pat. No. 3,893,858, West German Patent No. 1,290,812, Japanese Patent Application (OPI) No. 95630/78, *Research Disclosure,* No. 17129 (July, 1978), etc.; the thiazolidine derivatives described in Japanese Patent Application (OPI) No. 140129/75, etc.; the thiourea derivatives described in U.S. Pat. No. 3,706,561, etc.; the iodide salts described in Japanese Patent Application (OPI) No. 16235/83, etc.; the polyoxyethylene compounds described in West German Patent 2,748,430, etc.; the polyamine compounds described in Japanese Patent Publication No. 8836/70, etc.; bromide ion, etc. Above all, the mercapto group- or disulfido bond-containing compounds are preferred in view of their great accelerating effect, and in particular, the compounds described in U.S. Pat. No. 3,893,858, West German Patent 1,290,812 and Japanese Patent Application (OPI) No. 95630/78 are especially preferred. Further, the compounds described in U.S. Pat. No. 4,552,834 are also preferable. The bleaching accelerators can be incorporated into photographic light-sensitive materials. When color photographic materials for picture-taking are bleach-fixed, the bleaching accelerators are especially effective.

As the fixing agents, there may be mentioned thiosulfates, thiocyanates, thioether series compounds, thioureas, a large amount of iodide salts, etc. The use of thiosulfates is general, and in particular, ammonium thiosulfate can be used most widely. As a preservative for the bleach-fixing solution, sulfites, bisulfites or carbonylbisulfite adducts are preferred.

The silver halide color photographic material of the present invention is, in general, subjected to rinsing in water and/or stabilization, after desilvered. The amount of water for the rinsing-in-water step may be determined in a broad range, in accordance with the characteristics of the photographic material (for example, from the raw materials used, such as couplers, etc.) and the use thereof as well as the temperature of the rinsing water, the number of the rinsing tanks (rinsing stages), the replenishing system of countercurrent or normal current and other various conditions. Among the conditions, the relation between the number of the rinsing tanks and the amount of the rinsing water in a multistage countercurrent system rinsing can be obtained by the method described in *Journal of the Society of Motion Pictures and Television Engineers*, Vol. 64, pages 248–253 (May, 1955).

According to the multistage countercurrent system described in the said literature, the amount of the rinsing water can be reduced noticeably, but there is a problem in that bacteria would propagate in the tanks because of the increase of the residence time of the rinsing water in the tanks and the floating materials formed would adhere to the photographic materials being processed. In order to overcome this problem in the processing of the photographic material of the present invention, the method of reducing calcium ion and magnesium ion in the rinsing water, described in Japanese Patent Application No. 131632/86 can be used extremely effectively. Further, the isothiazolone compounds and thiabendazoles described in Japanese Patent Application (OPI) No. 8542/82; chlorine series bactericides such as sodium chloroisocyanurate, etc. and other benzotriazoles; as well as bactericides and fungicides described in H. Horigushi, *Chemistry of Bactericidal and Fungicidal Agents*, Sanitary Technical Association, *Bactericidal and Fungicidal Techniques ot Microorganisms*, and Japan Bactericidal and Fungicidal Society, *Encyclopedia of Bactericides and Fungicides* can also be used for the said purpose.

The rinsing water for the processing of the photographic material of the present invention has a pH value of from 4 to 9, preferably from 5 to 8. The temperature of the rinsing water and the rinsing time may variously be determined in accordance with the characteristics of the photographic material and the use thereof, but in general, the range of from 15° to 45° C. for from 20 seconds to 10 minutes, preferably from 25° to 40° C. for from 30 seconds to 5 minutes, is pertinently selected. Further, the photographic material of the present invention can be processed directly with a stabilizer solution in place of the above-mentioned rinsing water. For the stabilization processing, all the known methods described in Japanese Patent Application (OPI) Nos. 543/82, 14834/83, 220345/85, etc. can be used.

Following the above-mentioned rinsing-in-water processing, an additional stabilization can also be carried out, and as one example of this type, there may be mentioned a stabilizer bath containing formalin and a surfactant, which is used as the final bath for processing color photographic materials for picture-taking. The said stabilizer bath can also contain various kinds of chelating agents and fungicides.

The overflow solution caused by the replenishment of the above-mentioned rinsing water and/or stabilizer solution can be re-used in the other steps such as the desilvering step, etc.

The silver halide color photographic material of the present invention can contain a color developing agent for the purpose of simplifying and accelerating the processing of the material. For the incorporation of the agent into the material, various kinds of precursors of color developing agents are preferably used. For example, such precursors include the indaniline series compounds described in U.S Pat. No. 3,342,597, the Shiff base type compounds described in U.S. Pat. No. 3,342,599, *Research Disclosure*, Nos. 14850 and 15159, the aldol compounds described in *Research Disclosure*, No. 13924, the metal complexes described in U.S. Pat. No. 3,719,492, the urethane series compounds described in Japanese Patent Application (OPI) No. 135628/78, etc.

The silver halide color photographic material of the present invention can contain, if desired, various kinds of 1-phenyl-3-pyrazolidones for the purpose of accelerating the color development. Typical compounds usable for the purpose are described in Japanese Patent Application (OPI) Nos. 64339/81, 144547/82, 115438/83, etc.

The various kinds of processing solutions to be used for processing of the photographic material of the present invention are used at a temperature of from 10° to 50° C. In general, a temperature of from 33° to 38° C. is standard, but the temperature may be higher so as to shorten the processing time, or on the contrary, the temperature may be lower so as to improve the quality of images to be formed and to elevate the stability of the processing solutions used. Further, for the purpose of economizing the silver in the photographic material, the processing under cobalt intensification or hydrogen peroxide intensification described in West German Patent 2,226,770 and U.S. Pat. No. 3,674,499 can also be carried out.

The following examples are intended to illustrate the present invention but not to limit it in any way.

EXAMPLE 1

The halogen composition characterizing the emulsion of the present invention is explained hereunder.

An aqueous solution containing gelatin and KBr was kept at 40° C., and an aqueous silver nitrate solution ($AgNO_3$, 32.7 g) and an aqueous halogen solution (KBr, 24.9 g; KI, 1.3 g) were added thereto over a period of 4 minutes with constant stirring. After the addition of the aqueous solution containing KBr and gelatin, the resulting mixture was heated up to 70° C., and then an aqueous silver nitrate solution ($AgNO_3$, 152.3 g) and an aqueous halogen solution (containing KI in an amount of 5.3% by weight of KBr) were added thereto over a period of 32.1 minutes, whereupon the silver potential of the reaction solution was kept to be 0 mV to the saturated calomel electrode. Afterwards, an aqueous silver nitrate solution ($AgNO_3$, 7.2 g) and an aqueous NaCl solution (NaCl, 6.7 g) were added over a course of 1.5 minutes. The resulting emulsion was desalted and gelatin and water were added thereto so that the pH was adjusted to 6.9 and the pAg to 8.0 at 40° C. This was designated as Em-A.

Em-A contained tabular grains having a thickness of 0.13 μm, circle-corresponding diameter of 0.68 μm and an aspect ratio of 5.2. The silver chloride content in Em-A was measured by XPS method and fluorescent X-ray method, and the results obtained are shown in Table 1 below.

TABLE 1

| Silver Chloride Content in Em-A Measured by XSP Method and Fluorescent X-ray Method | |
|---|---|
| EmA | Silver Chloride Content (%) |
| XPS Method | 9.5 mol % |
| Fluorescent X-ray Method | 5.1 mol % |

As shown in Table 1, the value of silver chloride content in Em-A measured by XPS method is higher than that measured by fluorescent X-ray method. This means that the silver chloride content in the surface part of the grains is higher than the mean silver chloride content throughout the grains.

Next, the effect that the silver chloride layer on the surface of the grains has upon the sensitivity of the emulsion is explained hereunder.

Em-B was prepared in the same manner as the preparation of the above-mentioned Em-A except that an aqueous KBr solution was added in place of the aqueous NaCl solution. Em-B thus obtained contained tabular grains having a thickness of 0.13 μm, a circle-corresponding diameter of 0.68 μm and an aspect ratio of 5.2 but did not contain silver chloride.

Dye I-1 was added to each of Em-A and Em-B each in an amount of $1.40\times10^{-3}$ mol per mol of the silver, and then the resulting emulsion was optimally chemical-sensitized with sodium thiosulfate, potassium chloroaurate and potassium thiocyanate at 64° C.

Next, a coating aid and a hardening agent were added and the resulting composition was coated on a cellulose triacetate film base in an amount of 2 g/m$^2$ as Ag. The thus coated emulsion was thereafter exposed to a tungsten lamp (color temperature, 2854K) through a continuous wedge. The thus exposed emulsion layer was developed with a surface developer (MAA-1) mentioned below, at 20° C. for 10 minutes.

| MAA-1 | |
|---|---|
| Metol | 2.5 g |
| D-ascorbic Acid | 10.0 g |
| Potassium Bromide | 1.0 g |
| Nabox | 35.0 g |
| Water to make | 1000 ml |

The sensitivity of the emulsion layer was represented by a relative value of the reciprocal of the exposure required for obtaining the optical density of (fog+0.1).

The results obtained are shown in Table 2 below.

TABLE 2

| Comparison of Sensitivity | | |
|---|---|---|
| | Characteristic of Grains | Relative Sensitivity |
| Em-A (The Invention) | Surface Silver Chloride Layer | 158 |
| Em-B (Comparison) | No Surface Silver Chloride Layer | 100 (Standard) |

The results of Table 2 apparently demonstrate that the emulsion of the present invention, which contains surface silver chloride-having grains, had a higher sensitivity than the conventional (comparative) emulsion.

EXAMPLE 2

Demonstrated hereunder is the following fact: The effect that the silver chloride layer on the grain surface has upon the photographic sensitivity is more effective for tabular grains having a higher aspect ratio.

An aqueous solution containing gelatin and KBr was kept at 40° C., and an aqueous silver nitrate solution ($AgNO_3$, 2.7 g) and an aqueous halogen solution (KBr, 22.8 g; KI, 1.4 g) were added thereto over the period of 4 minutes with constant stirring. After the addition of the aqueous solution containing KBr and gelatin, the resulting mixture was heated up to 70° C., and then an aqueous silver nitrate solution ($AgNO_3$, 52.7 g) and an aqueous halogen solution (containing KI in an amount of 5.6% by weight of KBr) were added thereto over 16.7 minutes, whereupon the silver potential of the reaction solution was kept to be +50 mV relative to the saturated calomel electrode. The emulsion thus prepared was designated as Em-C. On the other hand, the silver potential of the reaction solution was kept to be −20 mV relative to the saturated calomel electrode, and the thus-prepared emulsion was designated as Em-D. Dye I-14 was added to each emulsion in an amount of $2.2\times10^{-3}$ mol per mol of the silver, and then, after desalted, gelatin and water were added so that the resulting composition was adjusted to have a pH value of 6.6 and a pAg value of 8.1 at 40° C.

The same process as that for the preparation of Em-C and Em-D was repeated up to the step of elevating the temperature of the reaction system. Afterwards, an aqueous silver nitrate solution ($AgNO_3$, 46.4 g) and an aqueous halogen solution (containing KI in an amount of 5.6% by weight of KBr) were added over 14.7 minutes. Upon the addition, the silver potential of the reaction solution was kept to be +50 mV and −20 mV relative to the calomel electrode. Next, an aqueous silver nitrate solution ($AgNO_3$, 6.3 g) and an aqueous NaCl solution (NaCl, 8.5 g) were added over the period of 1.3 minutes, whereby a silver chloride layer was deposited on the grains. Dye I-14 was added in an amount of $2.2\times10^{-3}$ mol per mol of the silver, and, after the resulting composition was desalted, gelatin and water were added so that the composition was adjusted to have a pH value of 6.5 and pAg value of 8.0 at 40° C. The emulsion prepared at the silver potential of +50 mV was designated as Em-E, and the other emulsion prepared at the silver potential of −20 mV was as Em-F.

Em-C, Em-D, Em-E and EM-F were optimally chemical-sensitized with sodium thiosulfate, potassium chloroaurate and potassium thiocyanate at 64° C.

Each of these emulsions Em-C to EM-F and a protective layer were coated on a cellulose triacetate film base, which had a subbing layer, each in an amount mentioned in Table 3 below.

TABLE 3

| Condition for Coating Emulsion | |
|---|---|
| (1) Emulsion Layer: | |
| Emulsion: Em-C, Em-D, Em-E or Em-F | $2.1\times10^{-2}$ mol/m$^2$ as Ag |
| Coupler: | $1.5\times10^{-3}$ mol/m$^2$ |

TABLE 3-continued

| Condition for Coating Emulsion | |
|---|---|
| 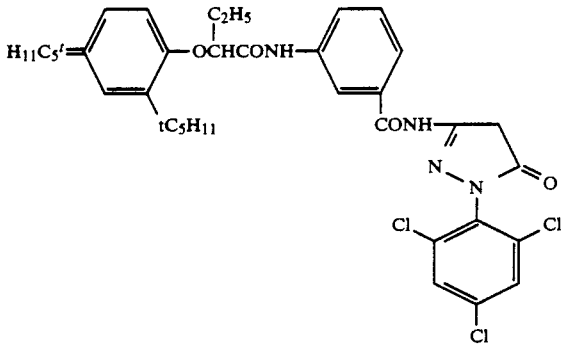 | |
| Tricresyl Phosphate: | 1.10 g/m$^2$ |
| Gelatin: | 2.30 g/m$^2$ |
| (2) Protective Layer: | |
| 2,4-Dichloro-6-hydroxy-s-triazine Sodium Salt: | 0.08 g/m$^2$ |
| Gelatin: | 1.80 g/m$^2$ |

These sample were left under the condition of a temperature of 40° C. and a relative humidity of 70% for 14 hours, and then exposed to light through BPN 42 Filter (gelatin filter by Fuji Photo Film Co.) (for measurement of intrinsic sensitivity) or SC 52 Filter (gelatin filter by Fuji Photo Film Co.) (for measurement of sensitized color sensitivity) and a continuous wedge, for 1/100 second. The thus exposed samples were thereafter subjected to color development as set forth below.

The density of the respective samples processed was measured with a green filter.

The development process herein carried out comprised the following steps under the condition of 38° C.

| | |
|---|---|
| 1. Color Development | 2 min 45 sec |
| 2. Bleaching | 6 min 30 sec |
| 3. Rinsing in Water | 3 min 15 sec |
| 4. Fixation | 6 min 30 sec |
| 5. Rinsing in Water | 3 min 15 sec |
| 6. Stabilization | 3 min 15 sec |

The compositions of the processing solutions used in the respective steps were as follows.

| Color Developer: | |
|---|---|
| Sodium Nitrilotriacetate | 1.0 g |
| Sodium Sulfite | 4.0 g |
| Sodium Carbonate | 30.0 g |
| Potassium Bromide | 1.4 g |

-continued

| | |
|---|---|
| Hydroxylamine Sulfate | 2.4 g |
| 4-(N-ethyl-N-β-hydroxyethylamino)-2-methyl-aniline Sulfate | 4.5 g |
| Water to make | 1 liter |
| **Bleaching Solution:** | |
| Ammonium Bromide | 160.0 g |
| Aqueous Ammonia (28 wt %) | 25.0 ml |
| Ethylenediamine-tetraacetic Acid Sodium/Iron Salt | 130 g |
| Glacial Acetic Acid | 14 ml |
| Water to make | 1 liter |
| **Fixing Solution:** | |
| Sodium Tetrapolyphosphate | 2.0 g |
| Sodium Sulfite | 4.0 g |
| Ammonium Thiosulfate (70 wt %) | 175.0 ml |
| Sodium Bisulfite | 4.6 g |
| Water to make | 1 liter |
| **Stabilizer Solution:** | |
| Formalin | 8.0 ml |
| Water to make | 1 liter |

The sensitivity was represented by the reciprocal of the exposure (as lux·sec) to give a density of (for 30 0.2).

The results thus obtained are shown in Table 4 below, together with the characteristics of the emulsions.

TABLE 4

| | | Comparison of Sensitivity | | | Relative Sensitivity | |
|---|---|---|---|---|---|---|
| Emulsion | Characteristics of Grains | Circle-corresponding Diameter (μm) | Thickness (μm) | Aspect Ratio | Intrinsic Sensitivity | Sensitized Color Sensitivity |
| Em-C (Comparison) | Surface Silver Chloride Layer: No | 0.26 | 0.12 | 2 | 100 (Standard) | 100 (Standard) |
| Em-D (Comparison) | Surface Silver Chloride Layer: No | 0.42 | 0.07 | 6 | 79 | 79 |
| Em-E (The Invention) | Surface Silver Chloride Layer: Yes | 0.26 | 0.12 | 2 | 126 | 126 |
| Em-F (The Invention) | Surface Silver Chloride Layer: Yes | 0.42 | 0.07 | 6 | 130 | 130 |

The results of Table 4 apparently demonstrate that the effect that the silver chloride layer deposits on the tabular grains has upon the sensitivity of the emulsion was more remarkable for the grains having a higher aspect ration, in the emulsion of the present invention. However, the silver chloride layer of the present invention was also effective for the tabular grains having an aspect ratio of 2.

EXAMPLE 3

The fact that the grains having a silver chloride layer as deposited on the surface thereof are superior to conventional epitaxial grains with respect to the improvement of the relation of sensitivity/graininess of tabular grains is explained hereunder.

An aqueous solution containing gelatin and KBr was kept at 40° C., and an aqueous silver nitrate solution ($AgNO_3$, 2.7 g) and an aqueous halogen solution (KBr, 23.8 g; KI, 2.8 g) were added thereto over the period of 4 minutes with constant stirring. After addition of a KBr-containing aqueous solution, the resulting mixture was heated up to 70° C., and then an aqueous silver nitrate solution ($AgNO_3$, 115.7 g)) and an aqueous halogen solution (containing KI in an amount of 12.3% by weight of KBr) were added over 54.9 minutes, whereupon the silver potential of the reaction solution was kept to be +20 mV to the saturated calomel electrode. Afterwards, an aqueous silver nitrate solution ($AgNO_3$, 2.9 g)) and an aqueous NaCl solution (NaCl, 4.1 g))

were added over 55 seconds. After the resulting composition was desalted, gelatin and water were added so that the composition was adjusted to have a pH value of 6.8 and a pAg value of 8.3 at 40° C. Dye I-1 was added in an amount of $7.3\times10^{-4}$ mol per mol of silver, and then the resulting emulsion was optimally chemical-sensitized with sodium thiosulfate, potassium chloroaurate and potassium thiocyanate at 64° C. The emulsion thus prepared was designated as Em-G.

On the other hand, the same process as above was repeated except that the deposition of the silver chloride layer was not formed. After the same desalting step, gelatin and water were added so that the composition was adjusted to have a pH value of 6.8 and a pAg value of 8.3 at 40° C., and then Dye I-1 was added thereto in an amount of $7.3\times10^{-4}$ mol per mol of silver. Afterwards, silver chloride was epitaxially deposited on the grains in the resulting emulsion, and the grains were optimally chemical-sensitized in the same manner as Em-G. The thus prepared emulsion was designated as Em-H.

Figure 2:
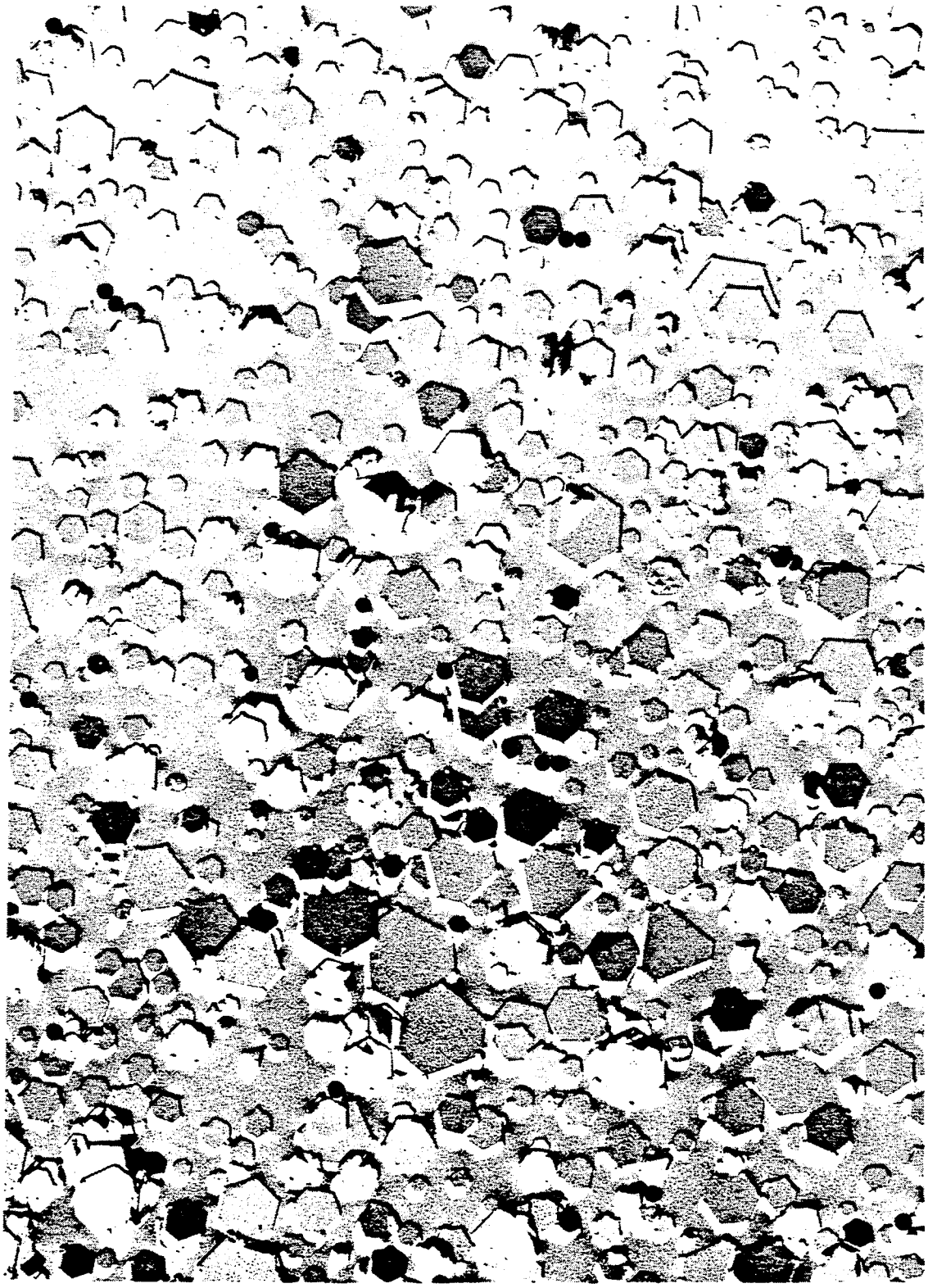
FIG. 2 is an electron-microphotograph of 6000 magnifications to show the crystal structure of silver halide grains of the silver halide emulsion Em-H prepared in Example 3 for comparison.

FIG. 1 and FIG. 2 show electron-microscopic photographs of Em-G and Em-H by carbon replica method. The grains in these emulsions had a circle-corresponding diameter of 0.90 μm, a thickness of 0.16 μm and an aspect ratio of 5.6.

These emulsions were coated on a support, exposed and developed in the same procedure as Example 2.

The graininess of the thus prepared samples was evaluated.

For measuring the RMS graininess of the samples, the samples were uniformly exposed with a light in a sufficient amount capable of giving a density of (fog+0.2) and developed by the development process as mentioned above, and then the graininess of the thus developed samples was measured by the method described in *The Theory of the Photographic Process* (by Macmillan), page 619, using a G filter.

The gamma value was represented by the reciprocal of the difference between the exposure of giving a density of 1.0 and the exposure of giving a density of 0.5 on sensitometry.

The results obtained are shown in Table 5 below.

TABLE 5

Comparison of Sensitivity, Fog, Graininess and Gamma Value

| Emulsion | Characteristic of Grains | Relative Sensitivity | Fog | RMS Graininess | Gamma Value |
|---|---|---|---|---|---|
| Em-G (The Invention) | Surface Silver Chloride Layer | 112 | 0.35 | 0.020 | 100 |
| Em-H (Comparison) | Epitaxial Silver Chloride | 100 (Standard) | 0.38 | 0.025 | 100 (Standard) |

The results of Table 5 demonstrate that the tabular grains of the present invention, which had a silver chloride layer as deposited on the surface thereof, were superior to the comparative grains, which had an epitaxially grown silver chloride part, with respect to the relation of sensitivity/fog. Further, as apparent from the photograph of FIG. 2, which shows the comparative epitaxial grains, the grains in which the silver chloride was epitaxially deposited on the surface of the grains as projections were thermodynamically unstable and therefore noticeably fogged in fact.

The most excellent point of the emulsion of the present invention is that the graininess is better than the graininess of the comparative emulsion even though the gamma value is the same in both. Accordingly, it is understood that the deposition of the silver chloride layer on the surface of the tabular grains in accordance with the present invention is effective for further improvement of the relation of sensitivity/graininess of the tabular grains.

EXAMPLE 4

Below is an explanation as to how the deposition of the silver chloride layer on the surface of base tabular grains in accordance with the present invention elevates the sensitivity of 2-layered tabular grains (base grains) having an iodine-rich part in the part of the grain underneath the grain's surface.

An aqueous solution containing gelatin and KBr was kept at 40° C., and an aqueous silver nitrate solution ($AgNO_3$, 32.7 g) and an aqueous halogen solution (KBr, 23.8 g; KI, 2.8 g) were added thereto over the period of 4 minutes with constant stirring. After addition of a KBr-containing aqueous solution, the resulting mixture was heated up to 70° C., and then an aqueous silver nitrate solution ($AgNO_3$, 115.7 g) and an aqueous halogen solution (containing KI in an amount of 5.8% by weight of KBr) was added over the period of 54.9 minutes, whereupon the silver potential of the reaction solution was kept to be +20 mV relative to the saturated calomel electrode. Afterwards, an aqueous silver nitrate solution ($AgNO_3$, 2.9 g) and an aqueous NaCl solution (NaCl, 4.1 g) were added over the period of 55 seconds. After the resulting composition was desalted, gelatin and water were added so that the composition was adjusted to have a pH value of 6.8 and a pAg value of 8.3 at 40° C. The emulsion thus prepared was designated as Em-1. On the other hand, the same process as above was repeated except that, after the temperature elevation, an aqueous silver nitrate solution (containing KI in an amount of 5.8% by weight of KBr) were added over the period of 56.3 minutes while the silver potential was kept to be +20 mV relative to the saturated calomel electrode. Without deposition of silver chloride layer, the resulting emulsion was desalted in the same manner as above. The emulsion thus prepared was designated as Em-J, which contained two-layered grains having an iodine-rich layer in the inner part of the grains. The previously prepared Em-I contained two-layered grains of the present invention having silver chloride layer as deposited there-over. The grains in these emulsions Em-J and Em-I had a circle-corresponding diameter of 0.95 μm, a thickness of 0.15 μm and an aspect ratio of 6.3.

The emulsions Em-I and Em-J were kept at 64° C. and, after Dye I-1 was added thereto in an amount of $7.3\times10^{-4}$ mol per mol of silver, Compound II-1 was further added in an amount of $1.4\times10^{-3}$ mol per mol of silver, and then these optimally chemical-sensitized with sodium thiosulfate, potassium chloroaurate and potassium thiocyanate.

Next, a coating aid and a hardening agent were added, and the resulting composition was coated on a cellulose triacetate film base in an amount of 1.6 g/m$^2$ as Ag. The emulsion layer thus formed was exposed to a tungsten lamp (color temperature 2854K) through a continuous wedge. The thus exposed emulsion layer was developed with a developer mentioned below, at 20° C. for 7 minutes or 10 minutes.

| | |
|---|---|
| Developer D-76: | |
| Metol | 2 g |
| Anhydrous Sodium Sulfite | 100 g |
| Hydroquinone | 5 g |
| Borax | 1.53 g |
| Water to make | 1000 ml |
| Developer D-19: | |
| Metol | 2 g |
| Hydroquinone | 8 g |
| Anhydrous Sodium Sulfite | 90 g |
| Anhydrous Sodium Carbonate | 45 g |
| Potassium Bromide | 5 g |
| Water to make | 1000 ml |

The sensitivity of the emulsion layer was represented by a relative value of the reciprocal of the exposure required for obtaining the optical density of (fog+0.1).

The results thus obtained are shown in Table 6 below.

TABLE 6

Comparison of Sensitivity

| Developer | Emulsion | Characteristic of Grains | Relative Sensitivity |
|---|---|---|---|
| D-76 | Em-I (The Invention) | Surface Silver Chloride Layer: Yes | 151 |
| D-76 | Em-J (Comparison) | Surface Silver Chloride layer: No | 100 (Standard) |
| D-19 | Em-I (The Invention) | Surface Silver Chloride Layer: Yes | 170 |
| D-19 | Em-J (Comparison) | Surface Silver Chloride Layer: No | 100 (Standard) |

The results of Table 6 apparently demonstrate that the deposition of the silver chloride layer on the surface of base tabular grains in accordance with the present invention is effective for elevating the sensitivity of two-layered tabular grains (base grains) having an iodine-rich part in the part of the grain underneath the grain surface.

EXAMPLE 5

The fact that the time of the deposition of the silver chloride layer by the present invention is not specifically limited but the deposition can be carried out in any stage will be explained hereunder.

An aqueous solution containing gelatin and KBr was kept at 30° C., and an aqueous silver nitrate solution ($AgNO_3$, 35.4 g) and an aqueous halogen solution (KBr, 22.9 g; KI, 1.2 g) were added thereto over the period of 4 minutes with constant stirring. After adding of a gelatin-containing aqueous solution, the resulting mixture was heated up to 70° C., and then an aqueous silver nitrate solution ($AgNO_3$, 50 g) and an aqueous halogen solution (containing KI in an amount of 5.2% by weight of KBr) were added over 16.7 minutes, whereupon the silver potential of the reaction solution was kept to be −20 mV to the standard calomel electrode. After desalting, gelatin and water were added so that the resulting composition was adjusted to have a pH value of 6.5 and a pAg value of 8.6 at 40° C.

The thus prepared emulsion contained tabular grains having a circle-corresponding diameter of 0.24 μm, a thickness of 0.06 μm and an aspect ratio of 4.

The emulsion thus prepared was optimally chemical-sensitized with sodium thiosulfate and potassium chloroaurate at 64° C. for 60 minutes. This was designated as Em-K.

Em-L was prepared in the same manner as the preparation of Em-K except that sodium chloride in an amount of 0.09 mol per mol of silver and silver nitrate in an amount of 0.03 mol per mol of silver were added 5 minutes before the addition of sodium thiosulfate in the chemical sensitization step and the successive chemical sensitization was carried out in the same manner.

Em-M was prepared in the same manner as the preparation of Em-K except that sodium chloride in an amount of 0.09 mol per mol of silver and silver nitrate in an amount of 0.03 mol per mol of silver were added 30 minutes after the addition of sodium thiosulfate in the chemical sensitization step and the successive chemical sensitization was carried out in the same manner.

The emulsion were coated, exposed and developed in the same manner as Example 3. The results thus obtained are shown in Table 7 below.

TABLE 7

Comparison of Sensitivity

| Emulsion | Characteristic of Grains | Relative Sensitivity | Gamma Value |
|---|---|---|---|
| Em-K (Comparison) | Surface Silver Chloride Layer: No | 100 (Standard) | 100 (Standard) |
| Em-L (The Invention) | Surface Silver Chloride Layer: Yes | 263 | 141 |
| Em-M (The Invention) | Surface Silver Chloride Layer: Yes | 210 | 137 |

The results of Table 7 apparently demonstrate that the deposition of the silver chloride layer by the present invention is effective prior to, during or after chemical sensitization.

EXAMPLE 6

This Example explains the dependence of the molar number of the silver chloride layer deposits of the present invention upon the base grains on which the layer deposit are to be formed.

The same emulsion preparation process as Example 5 was repeated, except that the amount of the silver chloride layer as deposited prior to the mineralization was varied to be 0 mol %, 1.9 mol %, 3.8 mol % and 7.5 mol %. The emulsions thus prepared were designated as Em-N, Em-O, Em-P and Em-Q, respectively. After desalting, gelatin and water were added so that the resulting compositions were adjusted to have a pH value of 6.5 and a pAg value of 8.6 at 40° C.

The thus prepared emulsions were kept at 64° C., and Dye I-10 was added in an amount of $2.2\times10^{-3}$ mol per mol of silver. Next, these were optimally chemical-sensitized with sodium thiosulfate and potassium chloroaurate.

These were coated, exposed and developed in the same manner as Example 3.

The results obtained are shown in Table 8.

TABLE 8

| Comparison of Sensitivity | | | |
|---|---|---|---|
| | | Relative Sensitivity | |
| Emulsion | Characteristic of Grains | Intrinsic Sensitivity | Sensitized Color Sensitivity |
| Em-N (Comparison) | Surface Silver Chloride Layer: No | 100 (Standard) | 100 (Standard) |
| Em-O (The Invention) | Surface Silver Chloride Layer: Yes | 166 | 165 |
| Em-P (The Invention) | Surface Silver Chloride Layer: Yes | 190 | 186 |
| Em-Q (The Invention) | Surface Silver Chloride Layer: Yes | 224 | 220 |

The results of Table 8 apparently demonstrate that the effect of the present invention could sufficiently be attained when the molar amount of the silver chloride layer deposited on the surface of the base tabular grains was 1.9 mol % or more of the base grains.

EXAMPLE 7

The following fact will be explained hereunder: The tabular grains of the present invention, which have a silver chloride layer on the grain surface, are superior to conventional tabular grains, which have no silver chloride layer on the grain surface, for use in multilayer color photographic materials because the grains of the present invention have a higher sensitivity and a better graininess.

Preparation of Sample No. 701 and No. 702

Plural layers, each having the composition as disclosed below, were coated on a cellulose triacetate film support having a subbing layer, to prepare multilayer color photographic material sample No. 701 and No. 702. In sample No. 701, the emulsion Em-A as prepared in Example 1 was incorporated into the eleventh layer; while in Sample No. 702, the emulsion Em-B was incorporated in the same layer.

Regarding the amount coated, the silver halide and colloidal silver were represented by the unit of g/m$^2$ as silver; the coupler, additives and gelatin were represented by the unit of g/m$^2$; and the sensitizing dye was represented by the unit of the molar number per mol of the silver halide in the same layer.

| | |
|---|---|
| First Layer: Anti-halation Layer | |
| Black Colloidal Silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Interlayer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: Red-sensitive Emulsion Layer of Low Sensitivity | |
| Silver Iodobromide Emulsion (AgI 4 mol %, uniform AgI type, sphere-corresponding diameter 0.5μ, fluctuation coefficient (=(standard deviation/mean grain size) × 100) of sphere-corresponding diameter 20%, tabular grains, aspect ratio 3.0) | 1.2 as Ag |
| Silver Iodobromide Emulsion (AgI 3 mol %, uniform AgI type, sphere-corresponding diameter 0.3μ, fluctuation coefficient of sphere-corresponding diameter 15%, tabular grains, aspect ratio 1.0) | 0.6 as Ag |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Fourth Layer: Red-sensitive Emulsion Layer of High Sensitivity | |
| Silver Iodobromide Emulsion (AgI 6 mol %, inside AgI-rich type with core/shell ratio of 1/1, sphere-corresponding diameter 0.5μ, fluctuation coefficient of sphere-corresponding diameter 15%, tabular grains, aspect ratio 3.0) | 0.7 as Ag |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Interlayer | |
| Gelatin | 0.5 |
| Cpd-1 | 0.1 |
| Solv-1 | 0.05 |
| Sixth Layer: Green-sensitive Emulsion Layer of Low Sensitivity | |
| Silver Iodobromide Emulsion (AgI 4 mol %, surface AgI-rich type with core/shell ratio of 1/1, sphere-corresponding diameter 0.5μ, fluctuation coefficient of sphere-corresponding diameter 15%, tabular grains, aspect ratio 4.0) | 0.35 as Ag |
| Silver Iodobromide Emulsion (AgI 3 mol %, uniform AgI type, sphere-corresponding diameter 0.3μ, fluctuation coefficient of sphere-corresponding diameter 25%, spherical grains, aspect ratio 1.0) | 0.20 as Ag |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer: Green-sensitive Emulsion Layer of High Sensitivity | |
| Silver Iodobromide Emulsion (AgI 4 mol %, inside AgI-rich type with core/shell ratio of 1/3, sphere-corresponding diameter 0.7μ, fluctuation coefficient of sphere-corresponding diameter 20%, tabular grains, aspect ratio 5.0) | 0.8 as Ag |
| Gelatin | 0.5 |

-continued

| | |
|---|---|
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer: Interlayer | |
| Gelatin | 0.5 |
| Cpd-1 | 0.05 |
| Solv-1 | 0.02 |
| Ninth Layer: Interlayer Effect Donor Layer for Red Sensitive Layer | |
| Silver Iodobromide Emulsion (AgI 2 mol %, inside AgI-rich type with core/shell ratio of 2/1, sphere-corresponding diameter 1.0μ, fluctuation coefficient of sphere-corresponding diameter 15%, tabular grains, aspect ratio 6.0) | 0.35 as Ag |
| Silver Iodobromide Emulsion (AgI 2 mol %, inside AgI-rich type with core/shell ratio of 1/1, sphere-corresponding diameter 0.4μ, fluctuation coefficient of sphere-corresponding diameter 20%, tabular grains, aspect ratio 6.0) | 0.20 as Ag |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow Colloidal Silver | 0.05 |
| Gelatin | 0.5 |
| Cpd-2 | 0.13 |
| Solv-1 | 0.13 |
| Cpd-1 | 0.10 |
| Eleventh Layer: Blue-sensitive Emulsion Layer of Low Sensitivity | |
| Em-A or Em-B | 0.45 as Ag |

-continued

| | |
|---|---|
| Gelatin | 1.6 |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Twelfth Layer: Blue-sensitive Emulsion Layer of High Sensitivity | |
| Silver Iodobromide Emulsion (AgI 10 mol %, inside AgI-rich type, sphere-corresponding diameter 1.0μ, fluctuation coefficient of sphere-corresponding diameter 25%, multi-layer twin plane tabular grains, aspect ratio 2.0) | 0.5 as Ag |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine Silver Bromide Grain Emulsion (AgI 2 mol %, uniform AgI type, sphere-corresponding diameter 0.07μ) | 0.5 |
| Gelatin | 0.45 |
| Polymethyl methacrylate grains (diameter 1.5μ) | 0.2 |
| H-1 | 0.4 |
| Cpd-5 | 0.5 |
| Cpd-6 | 0.5 |

In addition to the above-mentioned components, Emulsion Stabilizer Cpd-3 (0.04 g/m$^2$) and Surfactant Cpd-4 (0.02 g/m$^2$) were added to the respective layers as coating aids.

The compounds used are as follows:

UV-1:

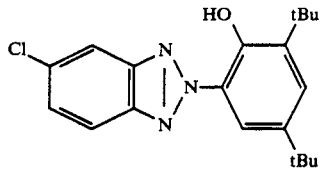

UV-2:

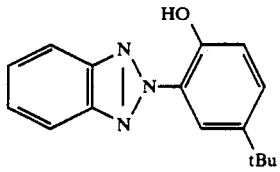

UV-3:

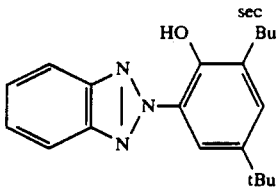

UV-4:

-continued
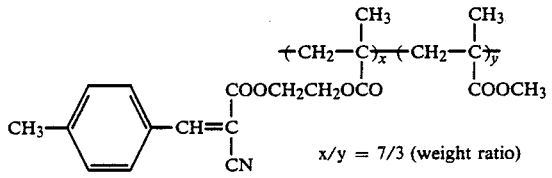
x/y = 7/3 (weight ratio)
UV-5:
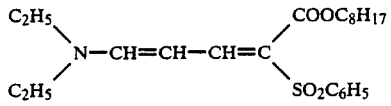
Solv-1:
Tricresyl Phosphate
Solv-2:
Dibutyl Phthalate
Solv-3:
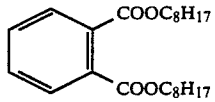
Solv-4:
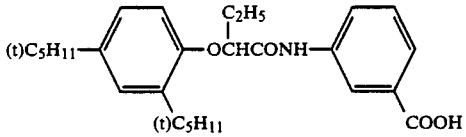
Cpd-1:
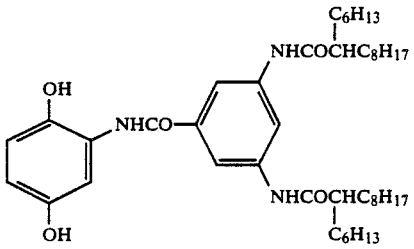
Cpd-2:
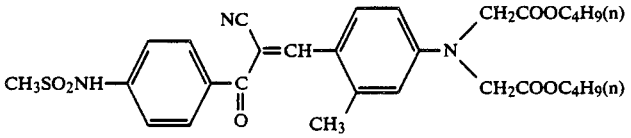
Cpd-3:
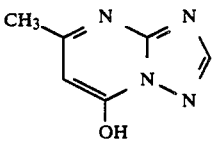
Cpd-4:
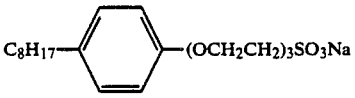
Cpd-5:

-continued
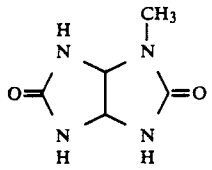
Cpd-6:
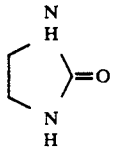
ExC-1:
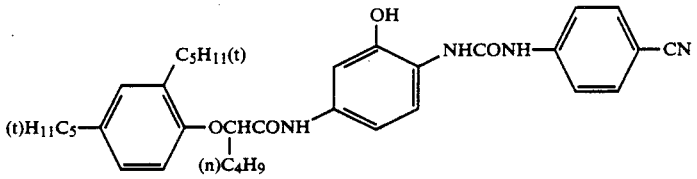
ExC-2:
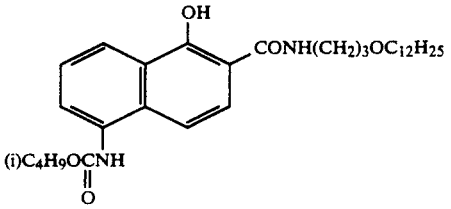
ExC-3:
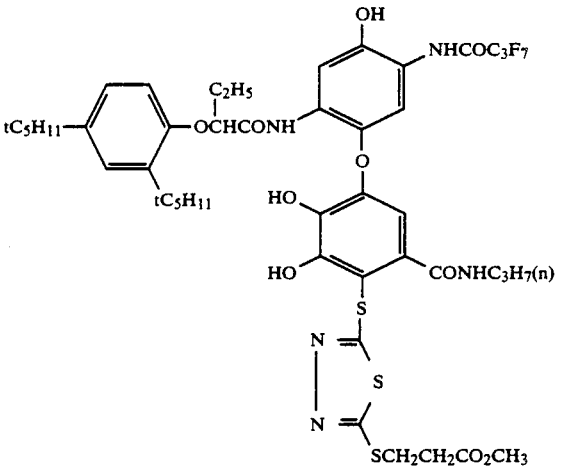
ExC-4:
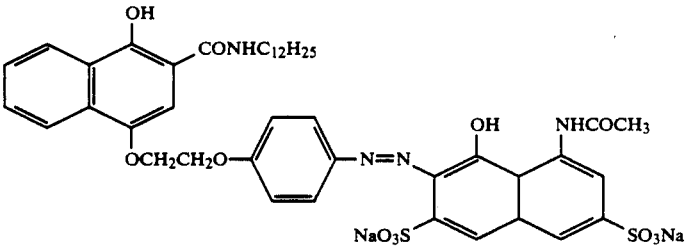
ExC-5:

-continued
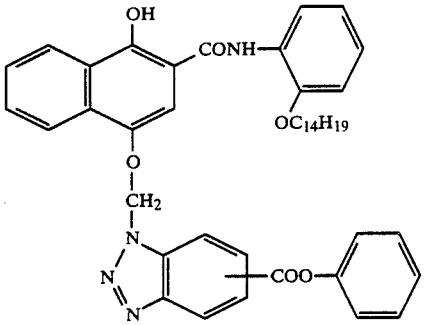
ExC-6:
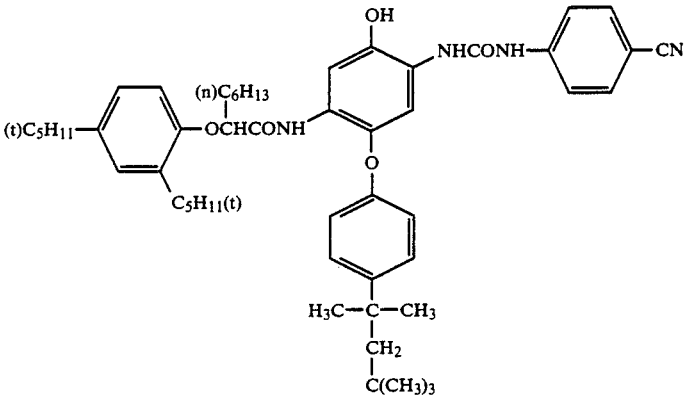
ExM-7:
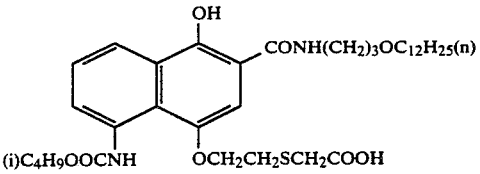
ExM-8:
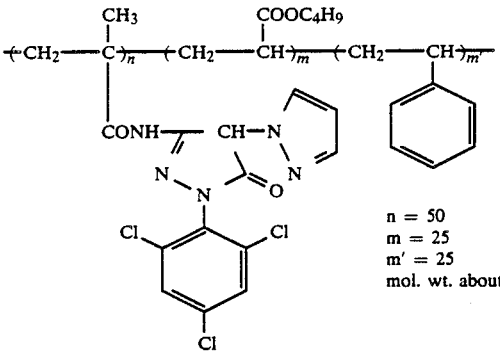
n = 50
m = 25
m' = 25
mol. wt. about 20,000
ExM-9:

-continued
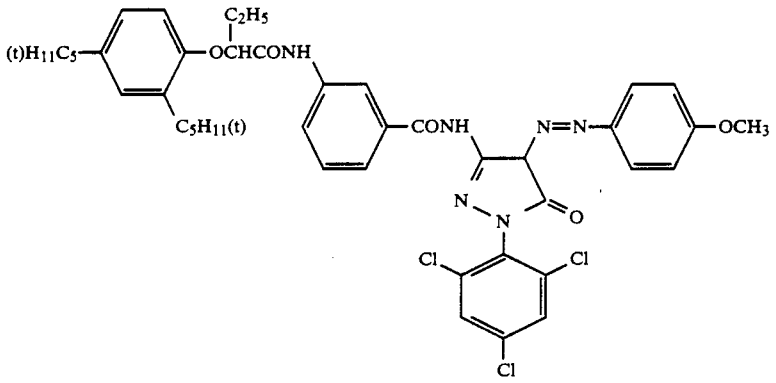
ExM-10:
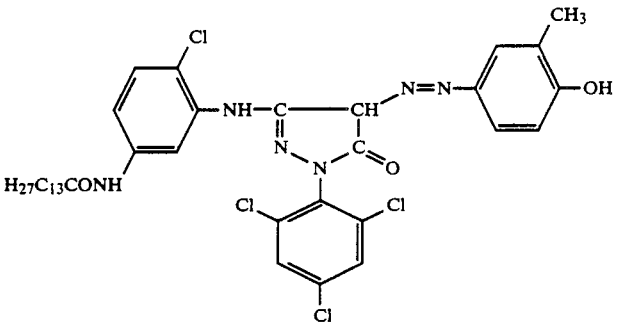
ExY-11:
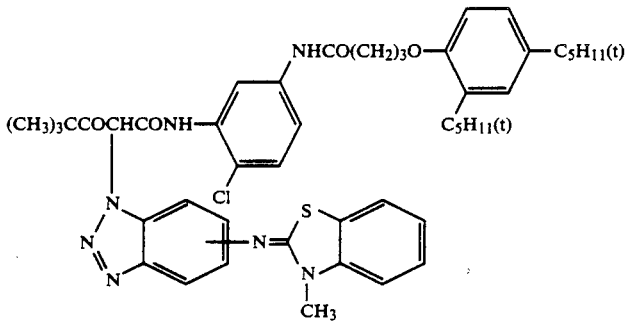
ExM-12:
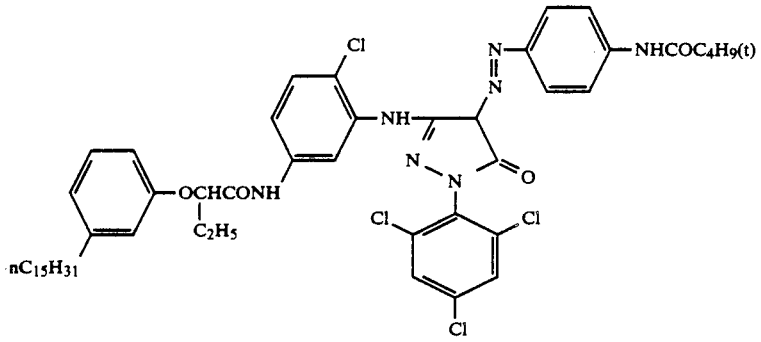
ExY-13:

-continued
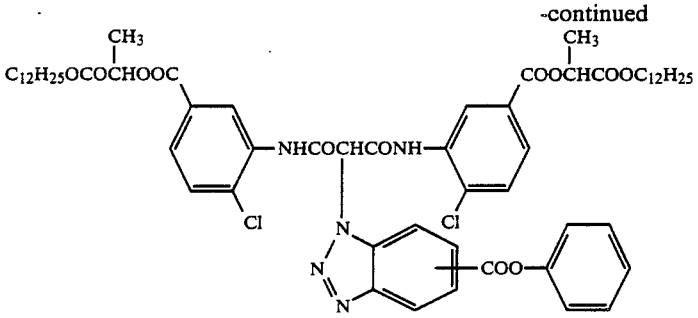
ExM-14:
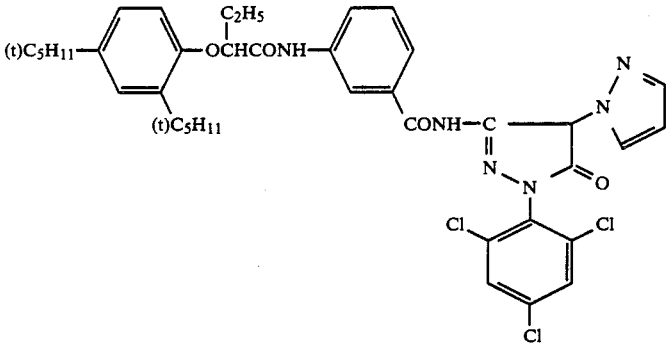
ExY-15:
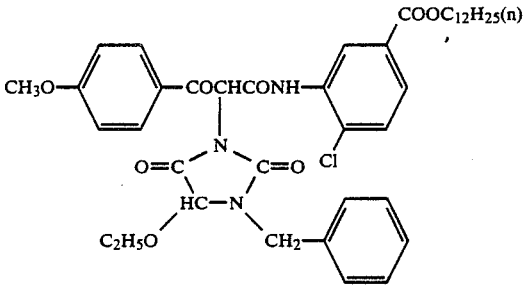
ExC-16:
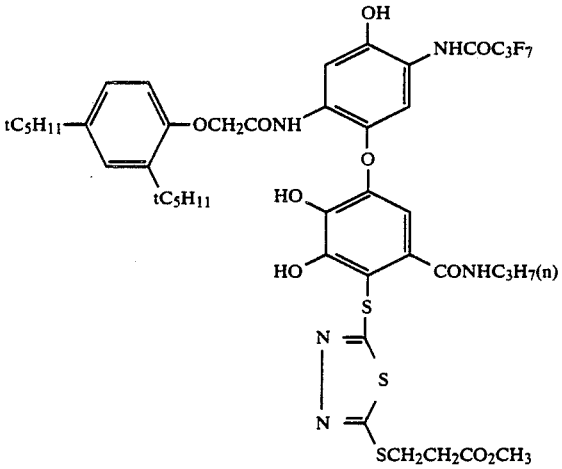
ExS-1:
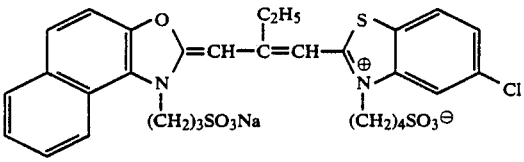

-continued

ExS-2:

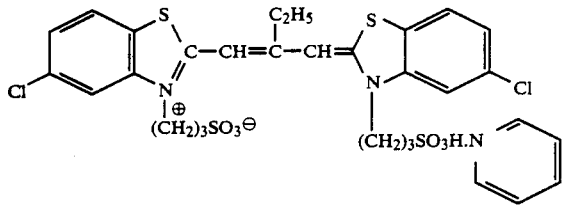

ExS-3:

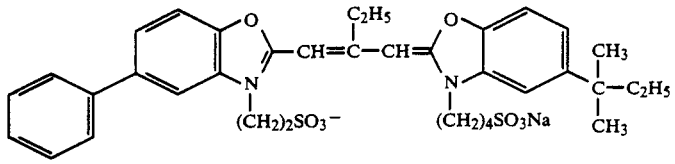

ExS-4:

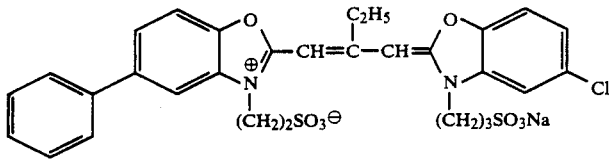

ExS-5:

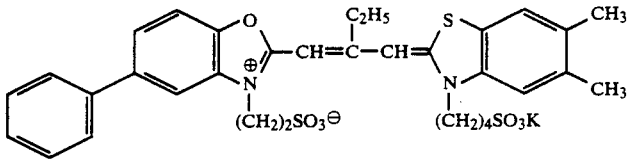

ExS-6:

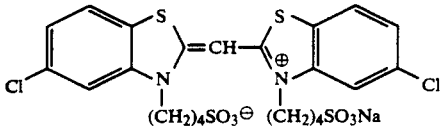

H-1:

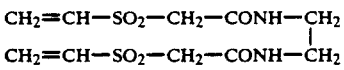

ExF-1:

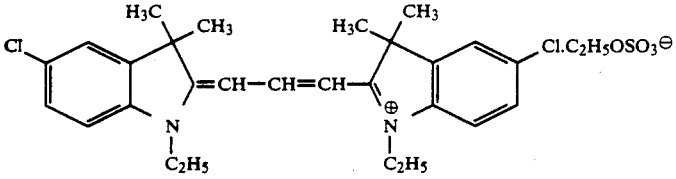

The thus prepared Sample No. 701 and No. 702 were imagewise exposed with a white light and then developed by the process set forth below. The characteristic curves of the cyan, magenta and yellow color images were obtained.

The color development was carried out at 38° C., which comprised the following steps.

| | |
|---|---|
| Color Development | 3 min 15 sec |
| Bleaching | 6 min 30 sec |
| Rinsing in Water | 2 min 10 sec |
| Fixation | 4 min 20 sec |
| Rinsing in Water | 3 min 15 sec |

-continued

| | |
|---|---|
| Stabilization | 1 min 05 sec |

The processing solutions used in the respective steps had the following compositions:

| Color Developer: | |
|---|---|
| Diethylenetriamine-pentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |

-continued

| | |
|---|---|
| Potassium Iodide | 1.3 mg |
| Hydroxylamine Sulfate | 2.4 g |
| 4-(N-ethyl-N-β-hydroxyethylamino)-2-methylaniline Sulfate | 4.5 g |
| Water to make | 1.0 liter |
| pH | 10.0 |
| Bleaching Solution: | |
| Ethylenediamine-tetraacetic Acid Ferric Ammonium Salt | 100.0 g |
| Ethylenediamine-tetraacetic Acid Disodium Salt | 10.0 g |
| Ammonium Bromide | 150.0 g |
| Ammonium Nitrate | 10.0 g |
| Water to make | 1.0 liter |
| pH | 6.0 |
| Fixing Solution: | |
| Ethylenediamine-tetraacetic Acid Disodium Salt | 1.0 g |
| Sodium Sulfite | 4.0 g |
| Aqueous Ammonium Thiosulfate Solution (70 wt %) | 175.0 ml |
| Sodium Bisulfite | 4.6 g |
| Water to make | 1.0 liter |
| pH | 6.6 |
| Stabilizer Solution: | |
| Formalin (40 wt %) | 2.0 ml |
| Polyoxyethylene-p-monononylphenyl Ether (mean polymerization degree 10) | 0.3 g |
| Water to make | 1.0 liter |

From the yellow color image characteristic curve, an exposure of giving a density of (fog+0.5) or a density of (fog+1.0) was obtained for the sensitivity of Em-A and Em-B. Further, the RMS graininess at the said density was also measured by the method described in *The Theory of the Photographic Process* (by Macmillan), page 619, using a B filter.

The results obtained are shown in Table 9 below.

TABLE 9

Comparison of Sensitivity and RMS Graininess between No. 701 and No. 702

| | | Density (fog + 0.5) | | Density (fog + 1.0) | |
|---|---|---|---|---|---|
| Sample | Emulsion | Sensitivity | RMS Graininess | Sensitivity | RMS Graininess |
| 701 (The Invention) | Em-A (The Invention) | 141 | 0.021 | 158 | 0.015 |
| 702 (Comparison) | Em-B (Comparison) | 100 (Standard) | 0.021 | 100 (Standard) | 0.015 |

As apparent from the results of Table 9, the multilayer color photographic material containing the tabular grains of the present invention, which had a silver chloride layer on the grain surface, gave a characteristic curve to show a higher sensitivity and a higher contrast gradation, as compared with the material containing conventional tabular grains, which did not have a silver chloride layer on the grain surface. Further, the RMS graininess at the same density was same in both grains. These results mean that the relation of sensitivity/-graininess was improved in the photographic material of the present invention.

EXAMPLE 8

The fact that the storage stability of the multilayer color photographic material of the present invention, which contains tabular grains having a silver chloride layer on the surface thereof, is better than that of the comparative multilayer color photographic material which contains conventional tabular grains having an epitaxial silver chloride deposit thereon, will be explained hereunder.

Preparation of Sample No. 803 and No. 804

Plural layers each having the composition as mentioned below were coated on a cellulose triacetate film support having a subbing layer, to prepare multilayer color photographic material sample Nos. 803 and 804. In Sample No. 803, the emulsion Em-G as prepared in Example 3 was incorporated into the eleventh layer; while in Sample No. 804, the emulsion Em-H was incorporated into the same layer.

| | |
|---|---|
| First Layer: Anti-halation Layer | |
| Black Colloidal Silver | 0.37 as Ag |
| U-1 | 0.027 |
| U-2 | 0.055 |
| U-3 | 0.064 |
| HBS-3 | 0.076 |
| Gelatin | 2.81 |
| Second Layer: Interlayer | |
| U-1 | 0.027 |
| U-2 | 0.054 |
| U-3 | 0.063 |
| HBS-3 | 0.076 |
| Gelatin | 1.52 |
| Third Layer: First Red-Sensitive Emulsion Layer | |
| Silver Iodobromide Emulsion (AgI 10 mol %, sphere-corresponding diameter 0.9μ, fluctuation coefficient 28.8%, aspect ratio 5.1) | 0.43 as Ag |
| Silver Iodobromide Emulsion (AgI 4 mol %, sphere-corresponding diameter 0.6μ, fluctuation coefficient 36.6%, aspect ratio 3.4) | 0.11 as Ag |
| Silver Iodobromide Emulsion (AgI 2 mol %, sphere-corresponding diameter 0.45μ, fluctuation coefficient 28%, aspect ratio 2.7) | 0.55 as Ag |
| Sensitizing Dye I | $4.7 \times 10^{-3}$ |
| C-1 | 0.14 |
| C-2 | 0.15 |
| C-3 | 0.08 |
| C-5 | 0.08 |
| HBS-1 | 0.06 |
| HBS-2 | 0.13 |
| C-10 | 0.14 |
| Gelatin | 1.66 |
| Fourth Layer: Second Red-sensitive Emulsion Layer | |
| Silver Iodobromide Emulsion (AgI 3.5 mol %, sphere-corresponding diameter 0.35μ, fluctuation coefficient 10.6%, aspect ratio 1.0) | 0.73 as Ag |
| Sensitizing Dye I | $4.0 \times 10^{-3}$ |
| C-1 | 0.27 |
| C-2 | 0.28 |
| C-3 | 0.07 |
| C-4 | 0.11 |
| HBS-1 | 0.12 |
| HBS-2 | 0.24 |
| C-10 | 0.007 |
| Gelatin | 2.34 |
| Fifth Layer: Interlayer | |
| Gelatin | 0.92 |
| Cpd-7 | 0.10 |
| HBS-1 | 0.053 |
| Dye I | 0.075 |
| U-4 | 0.023 |

-continued

| | |
|---|---|
| U-5 | 0.036 |
| HBS-4 | $7.7 \times 10^{-3}$ |
| Sixth Layer: First Green-sensitive Emulsion Layer | |
| Silver Iodobromide Emulsion (AgI 3.5 mol %, sphere-corresponding diameter 0.35μ, fluctuation coefficient 10.6%, aspect ratio 1.0) | 0.48 as Ag |
| Sensitizing Dye II | $3.6 \times 10^{-3}$ |
| Sensitizing Dye III | $1.7 \times 10^{-3}$ |
| C-6 | 0.33 |
| C-7 | 0.077 |
| HBS-1 | 0.29 |
| Gelatin | 1.13 |
| Seventh Layer: Second Green-sensitive Emulsion Layer | |
| Silver Iodobromide Emulsion (AgI 10 mol %, sphere-corresponding diameter 0.9μ, fluctuation coefficient 28.8%, aspect ratio 5.1) | 0.21 as Ag |
| Silver Iodobromide Emulsion (AgI 4 mol %, sphere-corresponding diameter 0.6μ, fluctuation coefficient 36.6%, aspect ratio 3.4) | 0.09 as Ag |
| Silver Iodobromide Emulsion (AgI 2 mol %, sphere-corresponding diameter 0.45μ, fluctuation coefficient 28%, aspect ratio 2.7) | 0.24 as Ag |
| Sensitizing Dye II | $2.2 \times 10^{-3}$ |
| Sensitizing Dye III | $1.0 \times 10^{-3}$ |
| C-6 | 0.20 |
| C-8 | 0.071 |
| C-4 | 0.079 |
| C-5 | 0.038 |
| HBS-1 | 0.18 |
| Gelatin | 0.79 |
| Eighth Layer: Third Green-sensitive Emulsion Layer | |
| Silver Iodobromide Emulsion (AgI 10 mol %, sphere-corresponding diameter 1.2μ, fluctuation coefficient 29.4%, aspect ratio 6.3) | 0.44 as Ag |
| Sensitizing Dye II | $5.6 \times 10^{-4}$ |
| Sensitizing Dye III | $2.1 \times 10^{-4}$ |
| Sensitizing Dye IV | $3.6 \times 10^{-5}$ |
| C-6 | 0.036 |
| C-5 | 0.020 |

-continued

| | |
|---|---|
| HBS-1 | 0.032 |
| Gelatin | 0.34 |
| Ninth Layer: Yellow Filter Layer | |
| Yellow Colloidal Layer | 0.11 as Ag |
| Cpd-7 | 0.28 |
| HBS-1 | 0.15 |
| Gelatin | 1.19 |
| Tenth Layer: First Blue-sensitive Emulsion Layer | |
| Silver Iodobromide Emulsion (AgI 1 mol %, sphere-corresponding diameter 0.45μ, fluctuation coefficient 20.1%, aspect ratio 1.8) | 0.33 as Ag |
| Sensitizing Dye V | $1.7 \times 10^{-3}$ |
| C-9 | 0.65 |
| C-11 | 0.10 |
| HBS-1 | 0.22 |
| Gelatin | 0.85 |
| Eleventh Layer: Second Blue-sensitive Emulsion Layer | |
| Silver Iodobromide Emulsion containing Sensitizing Dye V ($3.0 \times 10^{-3}$) (AgI 4.1 mol %, sphere-corresponding diameter 0.43μ, fluctuation coefficient 25%, aspect ratio 3.6) | 0.17 as Ag |
| Em-G or Em-H | 0.21 as Ag |
| C-9 | 0.28 |
| C-4 | 0.044 |
| HBS-1 | 0.10 |
| Gelatin | 0.75 |
| Twelfth Layer: First Protective Layer | |
| Gelatin | 0.60 |
| U-4 | 0.10 |
| U-5 | 0.15 |
| HBS-4 | 0.033 |
| Dye II | 0.15 |
| Thirteenth Layer: Second Protective Layer | |
| Polymethyl Methacrylate Grains (diameter, about 1.5 μm) | 0.14 |
| Gelatin | 0.87 |

The respective layers contained a gelatin hardening agent (H-1) and a surfactant, in addition to the above-mentioned components.

The components used were as follows.

Sensitizing Dyes

I

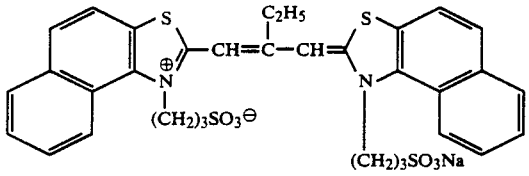

II

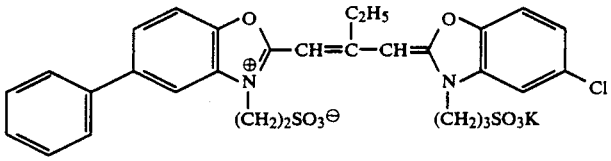

III

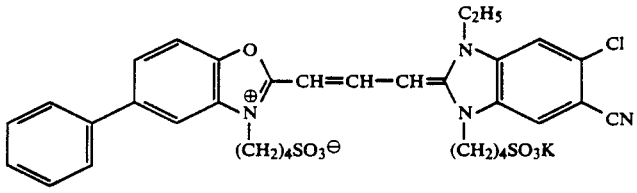

-continued
IV
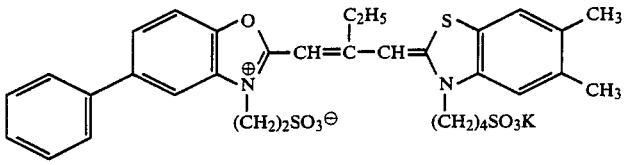
V
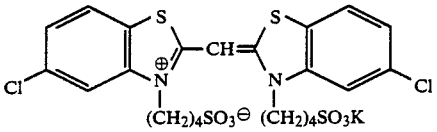
U-1
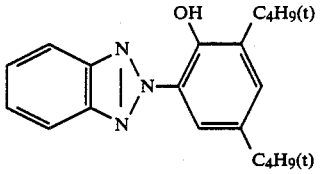
U-2
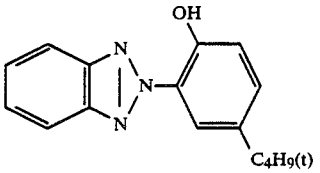
U-3
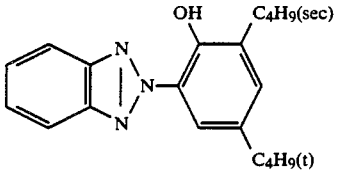
U-4
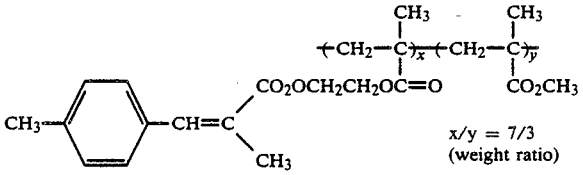
x/y = 7/3
(weight ratio)
U-5
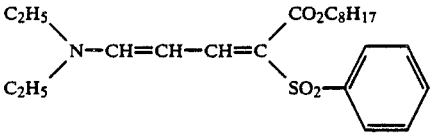
Dye I
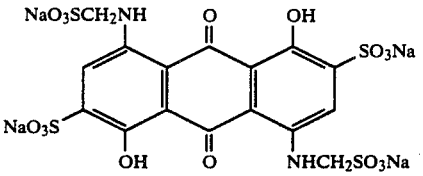

-continued
Dye II
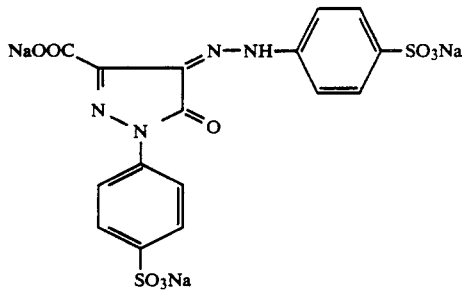
C-1
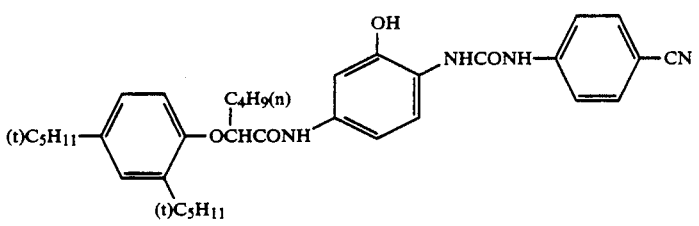
C-2
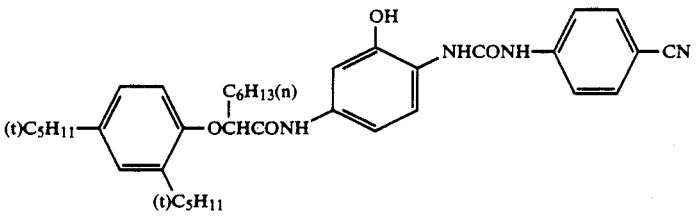
C-3
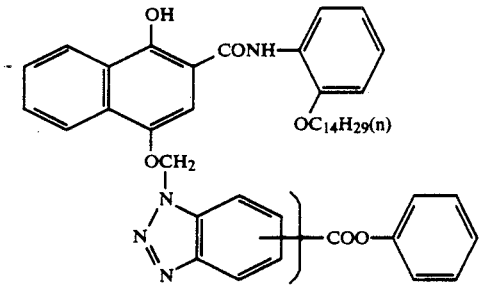
C-4
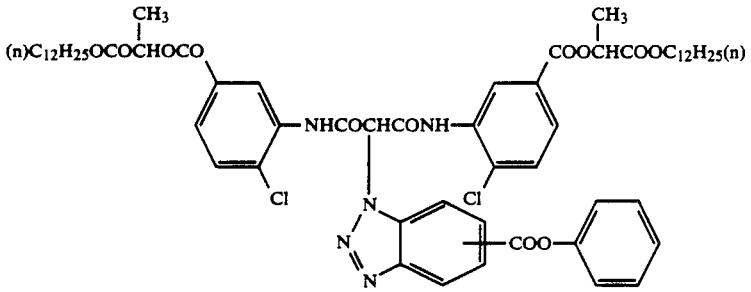

-continued
C-5
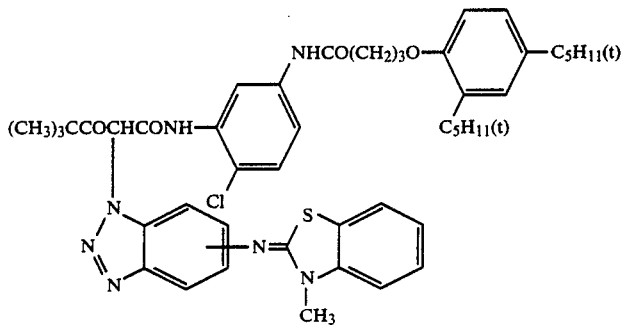
C-6
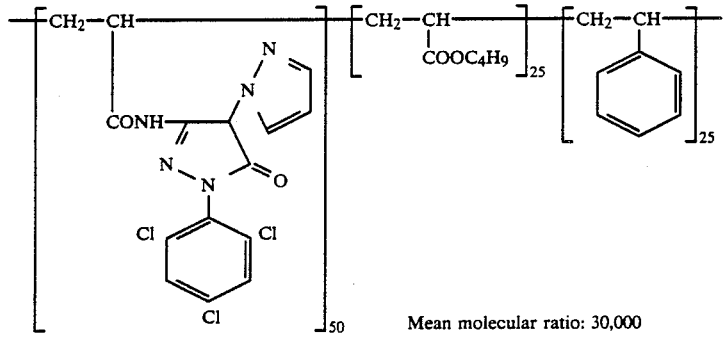
Mean molecular ratio: 30,000
C-7
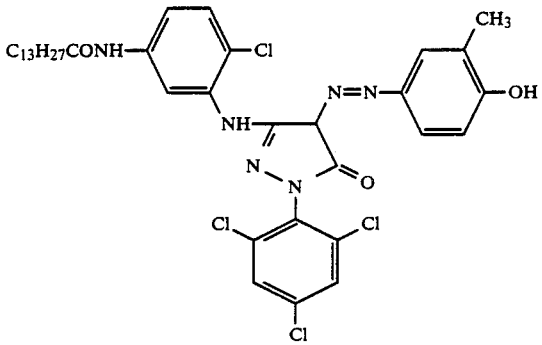
C-8
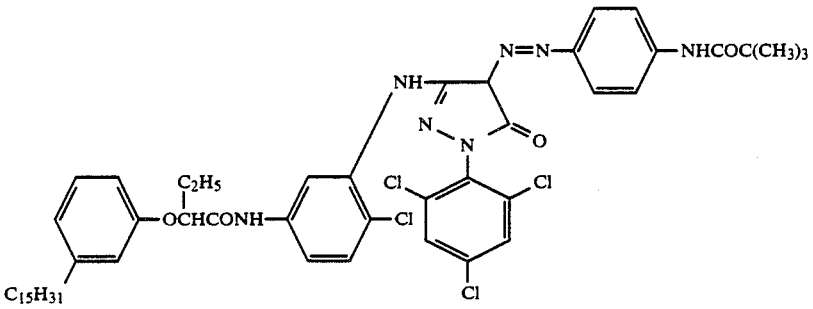
C-9
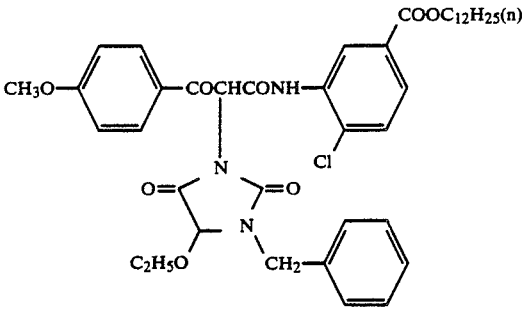

-continued

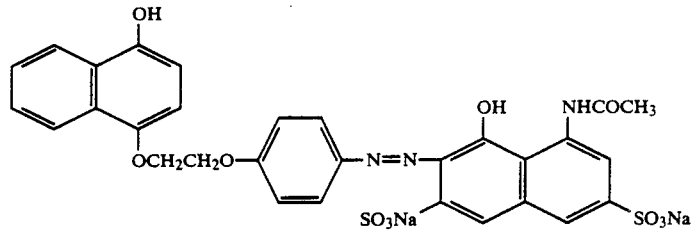

C-10

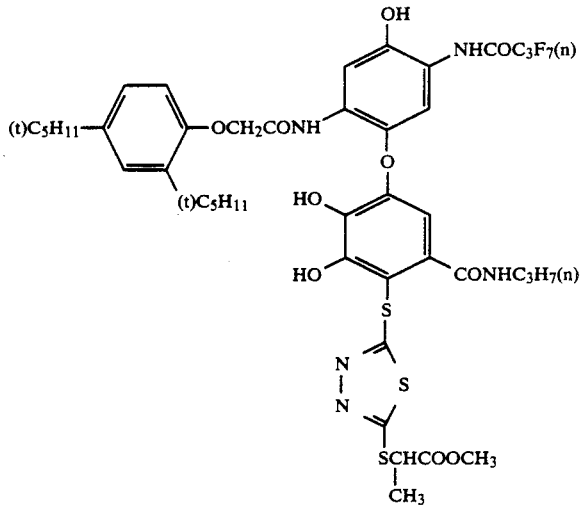

C-11

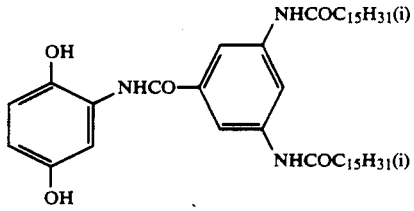

Cpd-7

| | |
|---|---|
| Tricresyl Phosphate | HBS-1 |
| Dioctyl Phthalate | HBS-2 |
| Dibutyl Phthalate | HBS-3 |
| Bis(2-ethylhexyl) Phthalate | HBS-4 |

The Sample Nos. 803 and 804 thus prepared were stored under the condition as set forth below.

Condition-A: Two weeks after the emulsion coating, Samples were stored under the condition of −4° C.

Condition-B: Two weeks after the emulsion coating, Samples were stored under the condition of 50° C. and humidity 30% for 3 days.

Condition-C: Two weeks after the emulsion coating, Samples were stored under the condition of 25° C. and humidity 68% for 3 months.

Condition-D: Two weeks after the emulsion coating, Samples were stored under the condition of 25° C. and humidity 68% for 6 months.

After stored under each of the above-mentioned conditions, Samples were imagewise exposed to a white light and then developed in the same manner as Example 7. The characteristic curves of the cyan, magenta and yellow color images formed were obtained.

From the yellow color image characteristic curve, an exposure of giving a density of 2.0 was obtained for evaluation of the sensitivity of the respective samples. The results obtained are shown in Table 10 below.

TABLE 10

Fluctuation of Sensitivity of Sample Nos. 803 and 804 under Various Conditions

| Condition for Storage | Sample No. 803 (The Invention) | Sample No. 804 (Comparison) |
|---|---|---|
| Condition-A | 100 | 100 (Standard) |
| Condition-B | 155 | 178 |
| Condition-C | 135 | 151 |
| Condition-D | 170 | 263 |

The results of Table 10 apparently demonstrate that the storage stability of the multilayer color photographic material of the present invention, which contained tabular grains having a silver chloride layer on the surface thereof, was improved, as compared with the comparative multilayer color photographic material which contained conventional tabular grains having an epitaxial silver chloride deposit thereon.

EXAMPLE 9

The fact that the tabular grains of the present invention, which have a silver chloride layer on the surface thereof, are superior to conventional monodispersed normal crystal grains with respect to the properties of sensitivity, graininess and sharpness will be explained hereunder.

Monodispersed normal crystal grains for the comparative emulsion were prepared by applying a silver chloride shell to monodispersed cubic silver bromide core grains, in accordance with British Patent 1,027,146. The grains obtained were cubic grains having a sphere-corresponding diameter of 0.08 μm. The dye was added thereto in the same manner as the case of the emulsion Em-A of Example 1 and then optimally chemical-sensitized with sodium thiosulfate, potassium chloroaurate and potassium thiocyanate. The emulsion thus prepared was designated as Em-R.

Preparation of Sample No. 905 and No. 906

Plural layers each having the composition as mentioned below were coated on a cellulose triacetate film base having a subbing layer to prepare multilayer color photographic material sample Nos. 905 and 906. In Sample No. 905, Em-A was incorporated into the eleventh layer; while in Sample No. 906, Em-R was incorporated into the same layer.

| | |
|---|---|
| First Layer: Anti-halation Layer | |
| Black colloidal Silver | 0.18 as Ag |
| Gelatin | 0.40 |
| Second Layer: Interlayer | |
| 2,5-Di-t-pentadecylhydroquinone | 0.18 |
| Ex-1 | 0.07 |
| Ex-3 | 0.02 |
| U-6 | 0.08 |
| U-7 | 0.08 |
| HBS-1 | 0.10 |
| HBS-3 | 0.02 |
| Gelatin | 1.04 |
| Third Layer: First Red-sensitive Emulsion Layer | |
| Silver Iodobromide Emulsion (AgI 6 mol %, mean grain size 0.8μ) | 0.55 as Ag |
| Sensitizing Dye I' | $6.9 \times 10^{-5}$ |
| Sensitizing Dye II' | $1.8 \times 10^{-5}$ |
| Sensitizing Dye III' | $3.1 \times 10^{-4}$ |
| Sensitizing Dye IV' | $4.0 \times 10^{-5}$ |
| EX-2 | 0.350 |
| HBS-1 | 0.005 |
| EX-11 | 0.008 |
| Gelatin | 1.20 |
| Fourth Layer: Second Red-sensitive Emulsion Layer | |
| Silver Iodobromide Emulsion (AgI 8 mol %, mean grain size 0.85μ) | 1.20 as Ag |
| Sensitizing Dye I' | $5.1 \times 10^{-5}$ |
| Sensitizing Dye II' | $1.4 \times 10^{-5}$ |
| Sensitizing Dye III' | $2.3 \times 10^{-4}$ |
| Sensitizing Dye IV' | $3.0 \times 10^{-5}$ |
| EX-2 | 0.300 |
| EX-3 | 0.050 |
| EX-10 | 0.004 |
| HBS-3 | 0.050 |
| Gelatin | 1.30 |
| Fifth Layer: Third Red-sensitive Emulsion Layer | |
| Silver Iodobromide Emulsion (AgI 14 mol %, mean grain size 1.5μ) | 1.60 as Ag |
| Sensitizing Dye IX' | $5.4 \times 10^{-5}$ |
| Sensitizing Dye II' | $1.4 \times 10^{-5}$ |
| Sensitizing Dye III' | $2.4 \times 10^{-4}$ |
| Sensitizing Dye IV' | $3.1 \times 10^{-5}$ |
| EX-5 | 0.150 |
| EX-3 | 0.055 |
| EX-4 | 0.060 |
| EX-11 | 0.005 |
| HBS-1 | 0.32 |
| Gelatin | 1.63 |
| Sixth Layer: Interlayer | |
| Gelatin | 1.06 |
| Seventh Layer: First Green-sensitive Emulsion Layer | |
| Silver Iodobromide Emulsion (AgI 6 mol %, mean grain size 0.8μ) | 0.40 as Ag |
| Sensitizing Dye V' | $3.0 \times 10^{-5}$ |
| Sensitizing Dye VI' | $1.0 \times 10^{-4}$ |
| Sensitizing Dye VII' | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| Gelatin | 0.75 |
| Eighth Layer: Second Green-sensitive Emulsion Layer | |
| Silver Iodobromide Emulsion (AgI 9 mol %, mean grain size 0.85μ) | 0.80 as Ag |
| Sensitizing Dye V' | $2.1 \times 10^{-5}$ |
| Sensitizing Dye VI' | $7.0 \times 10^{-5}$ |
| Sensitizing Dye VII' | $2.6 \times 10^{-4}$ |
| EX-6 | 0.150 |
| EX-8 | 0.010 |
| EX-1 | 0.008 |
| EX-7 | 0.012 |
| HBS-1 | 0.60 |
| Gelatin | 1.10 |
| Ninth Layer: Third Green-sensitive Emulsion Layer | |
| Silver Iodobromide Emulsion (AgI 12 mol %, mean grain size 1.3μ) | 1.2 as Ag |
| Sensitizing Dye V' | $3.5 \times 10^{-5}$ |
| Sensitizing Dye VI' | $8.0 \times 10^{-5}$ |
| Sensitizing Dye VII' | $3.0 \times 10^{-4}$ |
| EX-6 | 0.065 |
| EX-1 | 0.025 |
| HBS-3 | 0.55 |
| Gelatin | 1.74 |
| Tenth Layer: Yellow Filter Layer | |
| Yellow Colloidal Silver | 0.05 as Ag |
| 2,5-Di-t-pentadecylhydroquinone | 0.03 |
| Gelatin | 0.95 |
| Eleventh Layer: First Blue-sensitive Emulsion Layer | |
| Em-A or Em-R | 0.24 as Ag |
| EX-9 | 0.85 |
| EX-8 | 0.12 |
| HBS-1 | 0.28 |
| Gelatin | 1.28 |
| Twelfth Layer: Second Blue-sensitive Emulsion Layer | |
| Silver Iodobromide Emulsion (AgI 10 mol %, mean grain size 1.0μ) | 0.45 as Ag |
| Sensitizing Dye VIII' | $2.1 \times 10^{-4}$ |
| EX-9 | 0.20 |
| HBS-1 | 0.03 |
| Gelatin | 0.46 |
| Thirteenth Layer: Third Blue-sensitive Emulsion Layer | |
| Silver Iodobromide Emulsion (AgI 10 mol %, mean grain size 1.8μ) | 0.77 as Ag |
| Sensitizing Dye VIII' | $2.2 \times 10^{-4}$ |
| EX-9 | 0.20 |
| HBS-1 | 0.07 |
| Gelatin | 0.69 |
| Fourteenth Layer: First Protective Layer | |
| Silver Iodobromide Emulsion (AgI 1 mol %, mean grain size 0.07μ) | 0.5 as Ag |
| U-6 | 0.11 |
| U-7 | 0.17 |
| HBS-1 | 0.90 |
| Gelatin | 1.00 |
| Fifteenth Layer: Second Protective Layer | |
| Polymethyl Methacrylate Grains (diameter, about 1.5 μm) | 0.54 |
| S-1 | 0.05 |
| S-2 | 0.20 |
| Gelatin | 0.72 |

In addition to the above-mentioned compounds, a gelatin hardening agent (H-1) and a surfactant were added to the respective layers.

The chemical structural formulae and chemical names of the compounds used are as follows:
U-6:
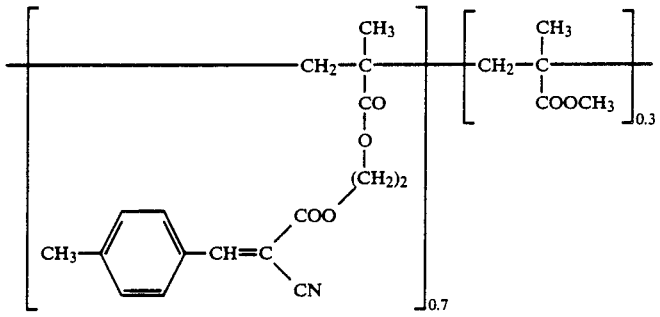
U-7:
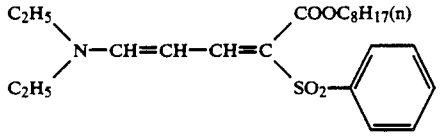
EX-1:
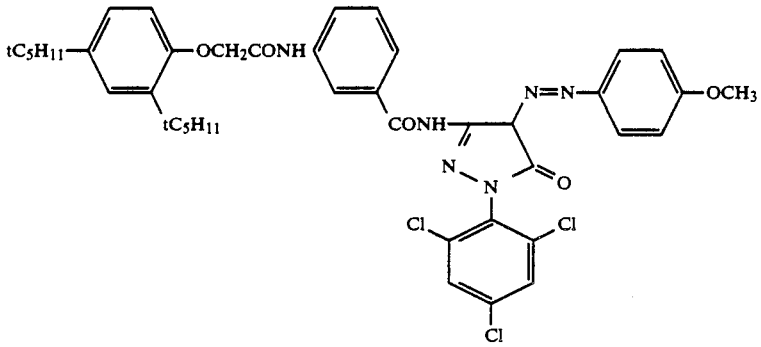
EX-2:
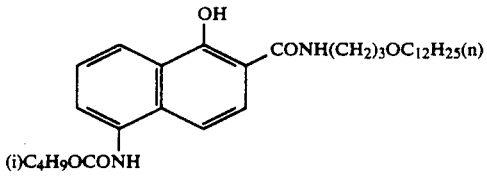
EX-3:
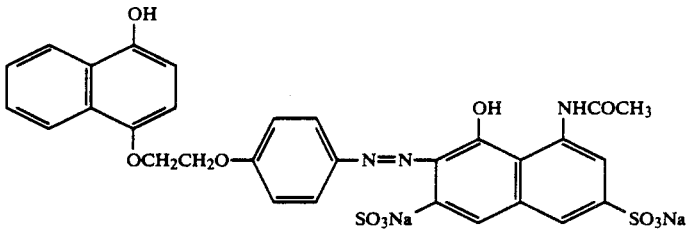
Ex-4:
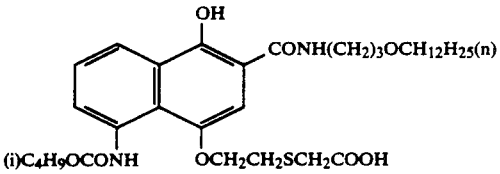
EX-5:

-continued
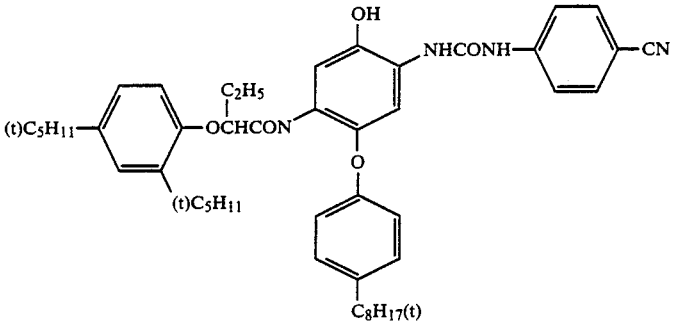
EX-6:
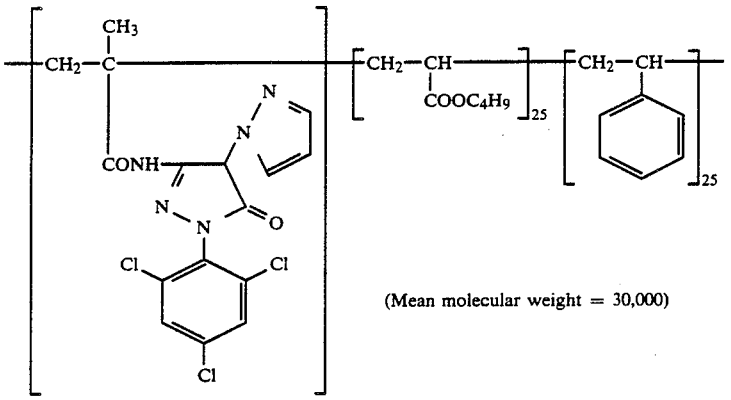
EX-7:
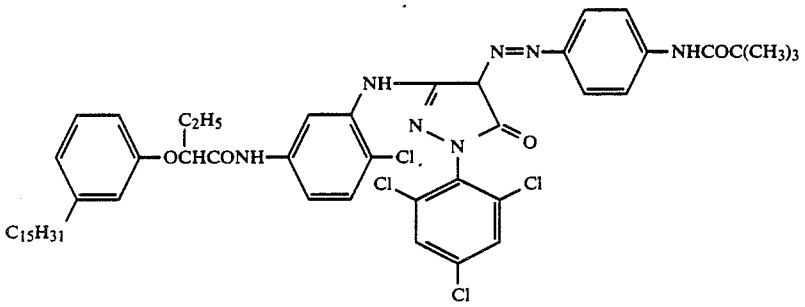
EX-8:
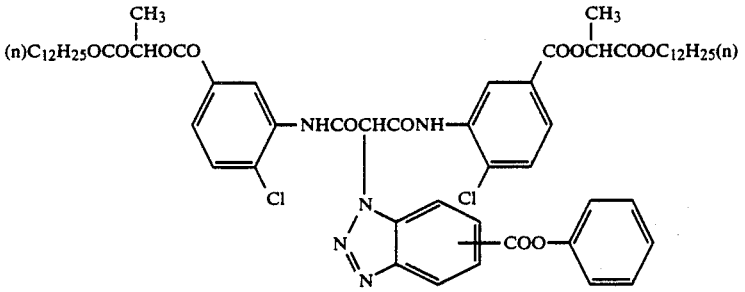
EX-9:

-continued
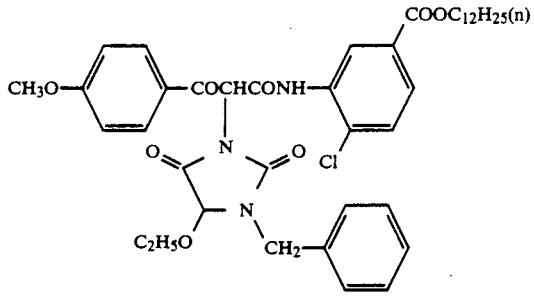
EX-10:
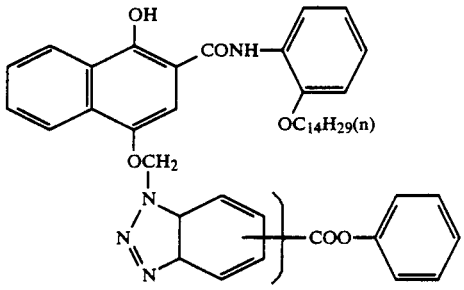
EX-11:
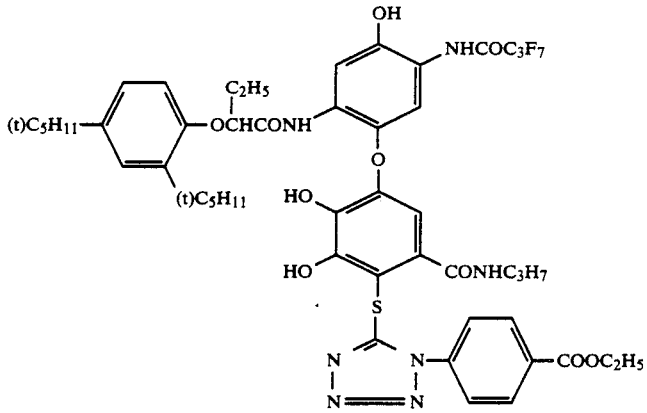
Sensitizing Dye
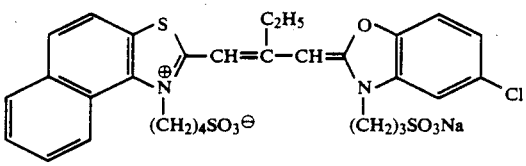
I'
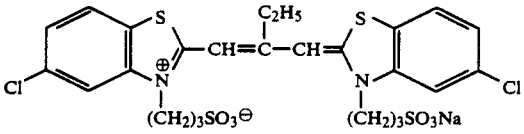
II'
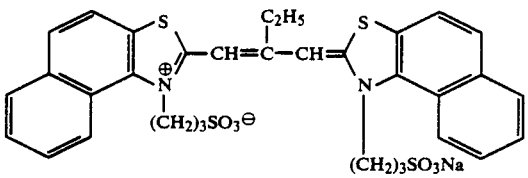
III'

-continued

S-1

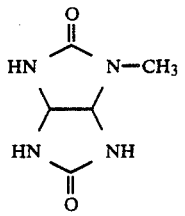

S-2

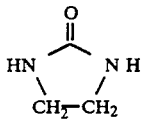

IV'

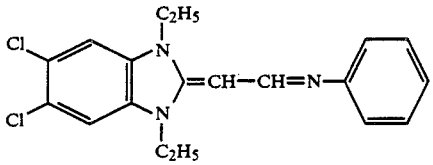

V'

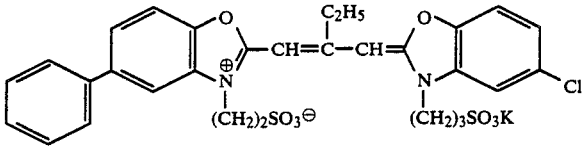

VI'

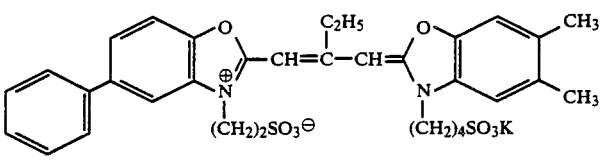

VII'

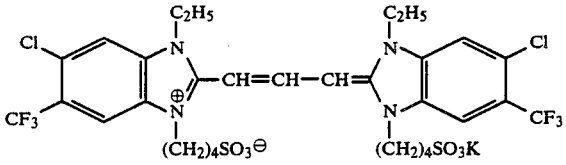

VIII'

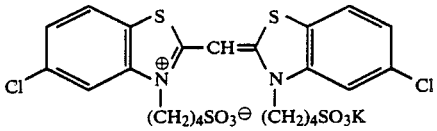

IX'

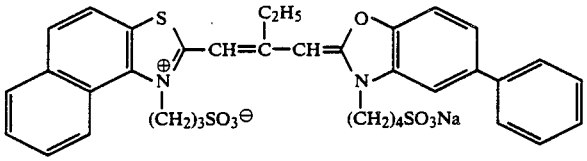

Sample Nos. 905 and 906 were pertinently exposed to a white light and then developed in the same manner as Example 7. The characteristic curve of the yellow density of Sample No. 905 had a good gradation, but no gradation was found in the high yellow density part of Sample No. 906.

The sharpness was evaluated from the result of MTF measured. The measurement of MTF was carried out in accordance with the method described in *Journal of Applied Photographic Engineering,* Vol. 6, 1-8 (1980), except that the development was carried out by the process of Example 7 mentioned above. The MTF values thus obtained are shown in Table 11 below, which are relative, values based on the MTF values of Sample No. 906 measured by G-filter and R-filter, respectively, as a standard value.

TABLE 11

Sharpness of Sample No. 905 and No. 906

| | G Filter MTF Value | R Filter MTF Value |
|---|---|---|
| 905 (The Invention) | 114 | 112 |
| 906 | 100 | 100 |

TABLE 11-continued

| Sharpness of Sample No. 905 and No. 906 | | |
|---|---|---|
| | G Filter MTF Value | R Filter MTF Value |
| (Comparison) | | |

The results of Table 11 apparently demonstrate that the sharpness of Sample No. 905, which contained tabular grains having a silver chloride layer on the surface thereof, was improved, as compared with the comparative Sample No. 906 which contained conventional monodispersed normal crystal grains.

The present invention has been described and illustrated with examples above. The effect of the present invention will be summarized as follows:

By the use of the silver halide emulsion of the present invention, photographic light-sensitive materials which are thermodynamically stable and which are excellent in manufacturing stability can be provided. Further, the emulsion of the present invention is also extremely stable with respect to the storage stability even in multilayer color photographic materials.

By the use of the silver halide emulsion of the present invention, the sensitivity of the photographic materials can be elevated without deteriorating the graininess, or that is, the relation of sensitivity/graininess can be improved.

Further, the elevation of sensitivity, including the elevation of color sensitization efficiency by sensitizing dyes, as well as the improvement of the relation of sensitivity/graininess, the improvement of sharpness and the improvement of covering power can all be attained by the present invention.

Specifically, when the emulsion of the present invention is used for preparation of a multilayer photographic light-sensitive material having two or more emulsion layers, the storage stability of the resulting material can noticeably be improved.

Further, a multilayer photographic light-sensitive material which is excellent in the relation of sensitivity/graininess and in sharpness can be obtained by the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing tabular silver bromide series grains having a mean aspect ratio of 2 or more, wherein (a) the grains have substantially planar parallel surfaces and have no projection on the grain planar surfaces;

(b) the silver chloride content in the planar surface part of the grain is higher than that in the part of the grain which is underneath the grain surface; and (c) the planar surface parts of the grains are present on the main planes of the tabular grains and comprise a region of from the surface to not more than 200 Å in the depth direction of the grains.

2. A silver halide photographic emulsion as in claim 1, wherein the surface part of the grain is a region of from the surface to not more than 100 Å in the depth direction.

3. A silver halide photographic emulsion as in claim 1, wherein the silver halide which constitutes a base grain for the tabular silver bromide series grains is selected from the group consisting of silver bromide, silver iodobromide, silver iodochlorobromide, and silver chlorobromide.

4. A silver halide photographic emulsion as in claim 3, wherein the silver halide is selected from the group consisting of silver bromide, silver iodobromide and silver iodochlorobromide.

5. A silver halide photographic emulsion as in claim 4, wherein the silver halide contains iodide ion in an amount of 1 mol % or more.

6. A silver halide photographic emulsion as in claim 5, wherein the silver halide contains iodide ion in an amount of 3 mol % or more.

7. A silver halide photographic emulsion as in claim 1, wherein the tabular silver bromide series grains have a mean silver chloride content of 10 mol % or less.

8. A silver halide photographic emulsion as in claim 5, wherein the tabular silver bromide series grains have a mean silver chloride content of 10 mol % or less.

9. A silver halide photographic emulsion as in claim 6, wherein the tabular silver bromide series grains have a mean silver chloride content of 10 mol % or less.

10. A silver halide photographic emulsion as in claim 1, wherein the tabular silver bromide series grains have a mean aspect ratio between 3 and 30.

11. A silver halide photographic emulsion as in claim 1, wherein the tabular silver bromide series grains have a mean aspect ratio between 4 and 20.

12. A silver halide photographic emulsion as in claim 1, wherein base grains for the tabular silver bromide series grains have a diameter from 0.15 μ to 5.0 μ.

13. A silver halide photographic emulsion as in claim 12, wherein the base grains have a thickness from 0.05 μ to 1.0 μ.

14. A silver halide photographic emulsion as in claim 1, wherein the proportion of the surface tabular grains is 30% or more of the total project area.

15. A silver halide photographic emulsion as in claim 14, wherein the proportion of the surface tabular grains is 50% or more of the total project area.

16. A silver halide photographic emulsion as in claim 15, wherein the proportion of the surface tabular grains is 80% or more of the total project area.

17. A silver halide photographic emulsion as in claim 1, which contains, as a sensitizing dye, a cyanine dye of a general formula (I):

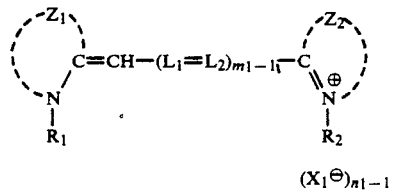

(I)

wherein $Z_1$ and $Z_2$ each represents an atomic group necessary for completing a heterocyclic nucleus for cyanine dyes, where such nucleus may optionally be substituted by one or more substituents selected from the group consisting of a lower alkyl group, a halogen atom, a phenyl group, a hydroxyl group, an alkoxy group having from 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group and a nitro group;

$L_1$ and $L_2$ each represents a methine group or a substituted methine group;

$R_1$ and $R_2$ each represents an alkyl group having from 1 to 5 carbon atoms, a substituted alkyl group having a carboxyl group, a substituted alkyl group having a sulfo group, an allyl group or a substituted alkyl group;

$m_1$ represents 1, 2 or 3;

$X_1\ominus$ represents an acid anion;

$n_1$ is 1 or 2, with the proviso that when the compound has a betaine structure, $n_1$ is 1.

18. A silver halide photographic emulsion as in claim 17, wherein the heterocyclic nucleus is selected from the group consisting of a thiazole nucleus, a thiazoline nucleus, a benzothiazoline nucleus, a naphthothiazole nucleus, an oxazole nucleus, an oxazoline nucleus, a benzoxazole nucleus, a naphthoaxazole nucleus, a tetrazole nucleus, a pyridine nucleus, a quinoline nucleus, an imidazoline nucleus, an imidazole nucleus, a benzimidazole nucleus, a naphthoimidazole nucleus, a selenazoline nucleus, a selenazole nucleus, a benzoselenazole nucleus, a naphthoselenazole nucleus, and an indolenine nucleus.

19. A silver halide photographic emulsion as in claim 1, which contains, as an anti-foggant or stabilizer, a hydroxyazaindene compound of formula (II) or (III):

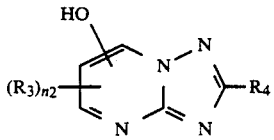

(II)

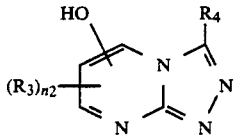

(III)

in which $R_3$ and $R_4$ may be the same or different and each represents a hydrogen atom, an aliphatic group or an aromatic group; and $n_2$ is 1 or 2.

20. A silver halide photographic emulsion as in claim 19, wherein the aliphatic group represented by $R_3$ or $R_4$ is selected from the group consisting of an alkyl group, an alkyl group substituted by an aromatic group, an alkyl group substituted by an alkoxy group, an alkyl group substituted by a hydroxyl group, an alkyl group substituted by a carbonyl group, and an alkyl group substituted by an alkoxy carbonyl group.

21. A silver halide photographic emulsion as in claim 19, wherein the aromatic group represented by $R_3$ or $R_4$ is selected from the group consisting of an aryl group and a substituted aryl group.

22. A silver halide photographic emulsion as in claim 1, which contains, as an anti-foggant or stabilizer, a benzotriazole compound of formula (IV):

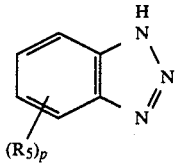

(IV)

in which p represents 0 or an integer of from 1 to 4; and $R_5$ represents a halogen atom, an aliphatic group or an aryl group.

23. A silver halide photographic emulsion as in claim 22, wherein the aliphatic group represented by $R_5$ is selected from the group consisting of an alkyl group and a substituted alkyl group.

24. A silver halide photographic emulsion as in claim 1, which contains, as an anti-foggant or stabilizer, a heterocyclic compound substituted by at least one mercapto group and having at least two aza-nitrogen atoms in the molecule.

25. A multilayer photographic light-sensitive material having at least two silver halide emulsion layers on a support in which at least one of the silver halide emulsion layers contains tabular silver bromide series grains having a mean aspect ratio of 2 or more, wherein the grains have substantially planar parallel surfaces and have no projection on the grain surface and wherein the silver chloride content in the planar surface part of the grain is higher than that in the part of the grains which is underneath the grain surface.

26. A multilayer photographic light-sensitive material as claimed in claim 25, wherein the tabular silver bromide series grains have a mean silver chloride content of 10 mol % or less.

27. A multilayer photographic light-sensitive material as claimed in claim 26, wherein silver halide which constitutes a basic grain for the tabular silver bromide series grains is silver iodobromide or silver iodochlorobromide which contains iodide ion in an amount of 3 mol % or more.

* * * * *